US006230699B1

(12) United States Patent
Mitsutani

(10) Patent No.: US 6,230,699 B1
(45) Date of Patent: May 15, 2001

(54) AIR FUEL RATIO CONTROL APPARATUS FOR INTERNAL COMBUSTION ENGINE

(75) Inventor: Noritake Mitsutani, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 09/456,468

(22) Filed: Dec. 8, 1999

(30) Foreign Application Priority Data

Mar. 29, 1999 (JP) ..... 11-085681

(51) Int. Cl.[7] ..... F02D 41/14
(52) U.S. Cl. ..... 123/674; 123/698
(58) Field of Search ..... 123/674, 698, 123/516, 520; 701/109

(56) References Cited

U.S. PATENT DOCUMENTS 5,406,927 * 4/1995 Kato et al. ..... 123/674
5,694,911 * 12/1997 Kawamoto et al. ..... 123/698
5,765,541 * 6/1998 Farmer et al. ..... 123/674
5,947,097 * 9/1999 Harada ..... 123/698

FOREIGN PATENT DOCUMENTS 62-174557 7/1987 (JP) .
5-248315 9/1993 (JP) .
6-10736 1/1994 (JP) .
7-166978 6/1995 (JP) .
7-189830 7/1995 (JP) .
7-233763 9/1995 (JP) .
7-293362 11/1995 (JP) .
9-42077 2/1997 (JP) .

* cited by examiner

*Primary Examiner*—Erick Solis
(74) *Attorney, Agent, or Firm*—Kenyon & Kenyon

(57) ABSTRACT

An air-fuel ratio control apparatus adapted for an internal combustion engine equipped with a purge system. The air-fuel ratio control apparatus estimates the amount of fuel vapor present in a fuel tank from a balance between an estimated produced vapor amount and an estimated purged amount of fuel vapor. When the estimated amount of fuel vapor present is small, the concentration of fuel vapor to be purged is low, so that a base air-fuel ratio feedback coefficient is learned in a period where the estimated value is small. As a result, the base air-fuel ratio feedback coefficient is appropriate learned. Even if the base air-fuel ratio feedback coefficient is learned incorrectly, the air-fuel ratio control apparatus can correct the feedback coefficient. Accordingly, the concentration of the fuel vapor to be purged into the intake air can be detected accurately, thus permitting the base air-fuel ratio feedback coefficient to be maintained at a more appropriate value.

32 Claims, 26 Drawing Sheets

AIR FUEL RATIO CONTROL APPARATUS FOR INTERNAL COMBUSTION ENGINE

BACKGROUND OF THE INVENTION

The present invention relates to an air-fuel ratio control apparatus for an internal combustion engine, and, more particularly, to an air-fuel ratio control apparatus for an internal combustion engine having a purge system, which can acquire the correct learned value by increasing the opportunities to learn an air-fuel ratio feedback coefficient.

In order to improve the fuel mileage and prevent air pollution, a fuel vapor purge system is being employed in recent vehicles. The purge system temporarily adsorbs fuel vaporized in the fuel tank of a vehicle by means of a canister and then feeds (purges) the adsorbed fuel vapor as part of the fuel delivered to the intake pipe at the proper timing. In an internal combustion engine that also employs air-fuel ratio control, however, the fuel vapor that is supplied via the purge system becomes an external disturbance to the air-fuel ratio control. In this respect, there is a demand for a purge method which has less influence on the air-fuel ratio control.

There is conventional air-fuel ratio control designed in consideration of a time-dependent change in the characteristics of an air flow meter or a fuel injection valve in an internal combustion engine. This air-fuel ratio control learns a base air-fuel ratio feedback coefficient which reflects the influence of a time-dependent change in the characteristics of the air flow meter or the fuel injection valve. It is therefore very important that when purging is carried out during learning of the base air-fuel ratio feedback coefficient, the purged fuel vapor should not affect the learned value.

An air-fuel ratio control apparatus, as a solution to the above problem, is disclosed in Japanese Unexamined Patent Publication No. 62-206262. This air-fuel ratio control apparatus is provided with a map having a plurality of drive sections set in accordance with the running state of an internal combustion engine. Base air-fuel ratio feedback coefficients are registered in the individual drive sections. When the running state of the internal combustion engine lies in a drive section in which an associated base air-fuel ratio feedback coefficient has not yet been registered, purging of fuel vapor is stopped.

The purge system must to carry out purging for as long a period as possible. Since the drive section frequently changes according to the running state, however, purging is frequently switched on and off when there are many drive sections in which associated base air-fuel ratio feedback coefficients have not yet been registered. The frequent purge-OFF action is contrary to against the demand to purge for a long period. Further, the frequent ON/OFF switching of purging results in inaccurate learning of the base air-fuel ratio feedback coefficient. When a lot of fuel vapor is accumulated in the canister, the ON/OFF switching of purging significantly affects the air-fuel ratio so that the air-fuel ratio control apparatus may not implement accurate control.

Japanese Unexamined Patent Publication No. 7-293362 and Japanese Unexamined Patent Publication No. 6-10736 disclose, as a solution to the above problem, air-fuel ratio control apparatuses that learn the base air-fuel ratio feedback coefficient based on the concentration of fuel vapor to be purged. Those control apparatuses measure the concentration of the fuel vapor to be purged and learn the base air-fuel ratio feedback coefficient. When that concentration is small, the base air-fuel ratio feedback coefficient is learned on the assumption that the fuel vapor to be purged does will not have much influence on the air-fuel ratio.

The control apparatus of Japanese Unexamined Patent Publication No. 7-293362 inhibits learning of the base air-fuel ratio feedback coefficient once that coefficient is learned. If the base air-fuel ratio feedback coefficient is learned inaccurately somehow, therefore, the learned value cannot be change to a correct value. In addition, since the base air-fuel ratio feedback coefficient is also used to learn the purge concentration, the purge concentration is also wrongly learned.

With the purge concentration set to the wrong value, therefore, when the running state enters a drive section having no registered associated base air-fuel ratio feedback coefficient, the control apparatus also inaccurately learns the base air-fuel ratio feedback coefficient in that section. Further, when the running state enters a drive section for which the base air-fuel ratio feedback coefficient has been learned correctly but where the wrong purge concentration has been learned, the air-fuel ratio of the internal combustion engine cannot be controlled precisely. This may bring about problems with emission and drivability.

The control apparatus described in the latter Japanese Unexamined Patent Publication No. 6-10736 frequently learns the base air-fuel ratio feedback coefficient when fuel vapor to be purged is lean. If the base air-fuel ratio feedback coefficient has been learned inaccurately, this coefficient seems to be set to the correct value in the next learning. This control apparatus however determines that fuel vapor to be purged is lean when the learned value of the purge concentration is small. The learned value of the purge concentration that is the criterion for the decision, like the base air-fuel ratio feedback coefficient, is acquired based on the amount of deviation of the air-fuel ratio feedback coefficient. The learned value of the purge concentration is complementary to the base air-fuel ratio feedback coefficient and is obtained in accordance with the air-fuel ratio feedback coefficient. That is, the learned value of the purge concentration indirectly indicates the concentration of fuel vapor to be purged and is likely to include a relatively large error with respect to the fuel concentration in the actual fuel vapor to be purged. If the learned value of the base air-fuel ratio feedback coefficient for a given drive section absorbs a deviation of the air-fuel ratio feedback coefficient based on the purged fuel vapor, for instance, the learned value of the purge concentration may indicate that the purged fuel vapor is lean. When the running state enters another drive section with the inadequate learned value of the purge concentration, the base air-fuel ratio feedback coefficient in that section is learned inadequately.

Japanese Unexamined Patent Publication No. 63-129159 discloses another control apparatus that halts purging every predetermined period and learns the base air-fuel ratio feedback coefficient. Because this control apparatus frequently misses opportunities to purge, however, it cannot overcome the aforementioned problems.

SUMMARY OF THE INVENTION

Accordingly, it is an object of the present invention to provide an air-fuel ratio control apparatus capable of adequately controlling the air-fuel ratio without reducing opportunities to purge fuel vapor.

To achieve the above objective, the present invention provides an air-fuel ratio control apparatus, adapted for an internal combustion engine equipped with a fuel tank, for controlling the air-fuel ratio of an air-fuel mixture to be supplied to the internal combustion engine. The air-fuel ratio control apparatus includes a purge means for purging fuel vapor from the fuel tank into an air-intake passage of the internal combustion engine, an air-fuel ratio sensor for detecting the air-fuel ratio, an air-fuel-ratio feedback control means for computing an air-fuel ratio feedback coefficient for controlling the air-fuel ratio to approach a predetermined target air-fuel ratio, a concentration learning means for learning the concentration of the fuel vapor purged in the air-intake passage based on the air-fuel ratio feedback coefficient, a base air fuel ratio feedback coefficient learning means for learning a base air-fuel ratio feedback coefficient based on the air-fuel ratio feedback coefficient, a fuel-injection-amount control means for controlling an injection amount of fuel based on the air-fuel ratio feedback coefficient, the concentration of the fuel vapor and the base air-fuel ratio feedback coefficient, a fuel-vapor-amount estimating means for estimating an amount of fuel vapor present in the fuel tank from a balance between an amount of fuel vapor generated in the fuel tank and a purged amount of the fuel vapor, and a learning control means for permitting learning of the base air-fuel ratio feedback coefficient and inhibiting learning of the concentration of the fuel vapor when the estimated amount of fuel vapor is less than a predetermined reference value, and inhibiting learning of the base air-fuel ratio feedback coefficient and permitting learning of the concentration of the fuel vapor when the estimated amount of fuel vapor is greater than the reference value.

Another aspect of the invention provides an air-fuel ratio control apparatus, adapted for an internal combustion engine equipped with a fuel tank, for controlling the air-fuel ratio of an air-fuel mixture to be supplied to the internal combustion engine. The air-fuel ratio control apparatus includes a purge means for purging fuel vapor from the fuel tank into an air-intake passage of the internal combustion engine, an air-fuel ratio sensor for detecting the air-fuel ratio, an air-fuel-ratio feedback control means for computing an air-fuel ratio feedback coefficient for controlling the air-fuel ratio to approach a predetermined target air-fuel ratio, a concentration learning means for learning the concentration of the fuel vapor purged in the air-intake passage based on the air-fuel ratio feedback coefficient, a base air fuel ratio feedback coefficient learning means for learning a base air-fuel ratio feedback coefficient based on the air-fuel ratio feedback coefficient, a fuel-injection-amount control means for controlling a fuel injection amount based on the air-fuel ratio feedback coefficient, the concentration of the fuel vapor and the base air-fuel ratio feedback coefficient, a purge valve, provided in the purge means, for regulating the purged amount of the fuel vapor, air-fuel-ratio-feedback-coefficient behavior detection means for detecting a first behavior of the air-fuel ratio feedback coefficient computed by the air-fuel-ratio feedback control means with the purge valve open and a second behavior of the air-fuel ratio feedback coefficient computed by the air-fuel-ratio feedback control means with the purge valve closed, and learning control means for permitting learning of the base air-fuel ratio feedback coefficient by the base air fuel ratio feedback coefficient learning means and inhibiting learning of the concentration of the fuel vapor by the concentration learning means when it is determined based on the first and second behaviors that the fuel vapor to be purged is lean and inhibiting learning of the base air-fuel ratio feedback coefficient by the base air fuel ratio feedback coefficient learning means and permitting learning of the concentration of the fuel vapor by the concentration learning means when it is determined that the fuel vapor to be purged is not lean.

Further aspect of the invention provides a computer-readable recording medium on which program codes for allowing a computer to control the air-fuel ratio of an air-fuel mixture to be supplied to an internal combustion engine equipped with a fuel tank are recorded. The program codes causes the computer to function as an air-fuel ratio control apparatus that includes a purge means for purging fuel vapor from the fuel tank into an air-intake passage of the internal combustion engine, an air-fuel-ratio feedback control means for computing an air-fuel ratio feedback coefficient for controlling the air-fuel ratio, which is detected by an air-fuel ratio sensor, to approach a predetermined target air-fuel ratio, a concentration learning means for learning a concentration of the fuel vapor purged in the air-intake passage based on the air-fuel ratio feedback coefficient, a base air fuel ratio feedback coefficient learning means for learning a base air-fuel ratio feedback coefficient based on the air-fuel ratio feedback coefficient, a fuel-injection-amount control means for controlling a fuel injection amount based on the air-fuel ratio feedback coefficient, the concentration of the fuel vapor and the base air-fuel ratio feedback coefficient, a purge valve, provided in the purge means, for regulating the purged amount of the fuel vapor, air-fuel-ratio-feedback-coefficient behavior detection means for detecting a first behavior of the air-fuel ratio feedback coefficient computed by the air-fuel-ratio feedback control means with the purge valve open and a second behavior of the air-fuel ratio feedback coefficient computed by the air-fuel-ratio feedback control means with the purge valve closed, and learning control means for permitting learning of the base air-fuel ratio feedback coefficient by the base air fuel ratio feedback coefficient learning means and inhibiting learning of the concentration of the fuel vapor by the concentration learning means when it is determined based on the first and second behaviors that the fuel vapor to be purged is lean and inhibiting learning of the base air-fuel ratio feedback coefficient by the base air fuel ratio feedback coefficient learning means and permitting learning of the concentration of the fuel vapor by the concentration learning means when it is determined that the fuel vapor to be purged is not lean.

Other aspects and advantages of the present invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

First Embodiment

Figure 1:
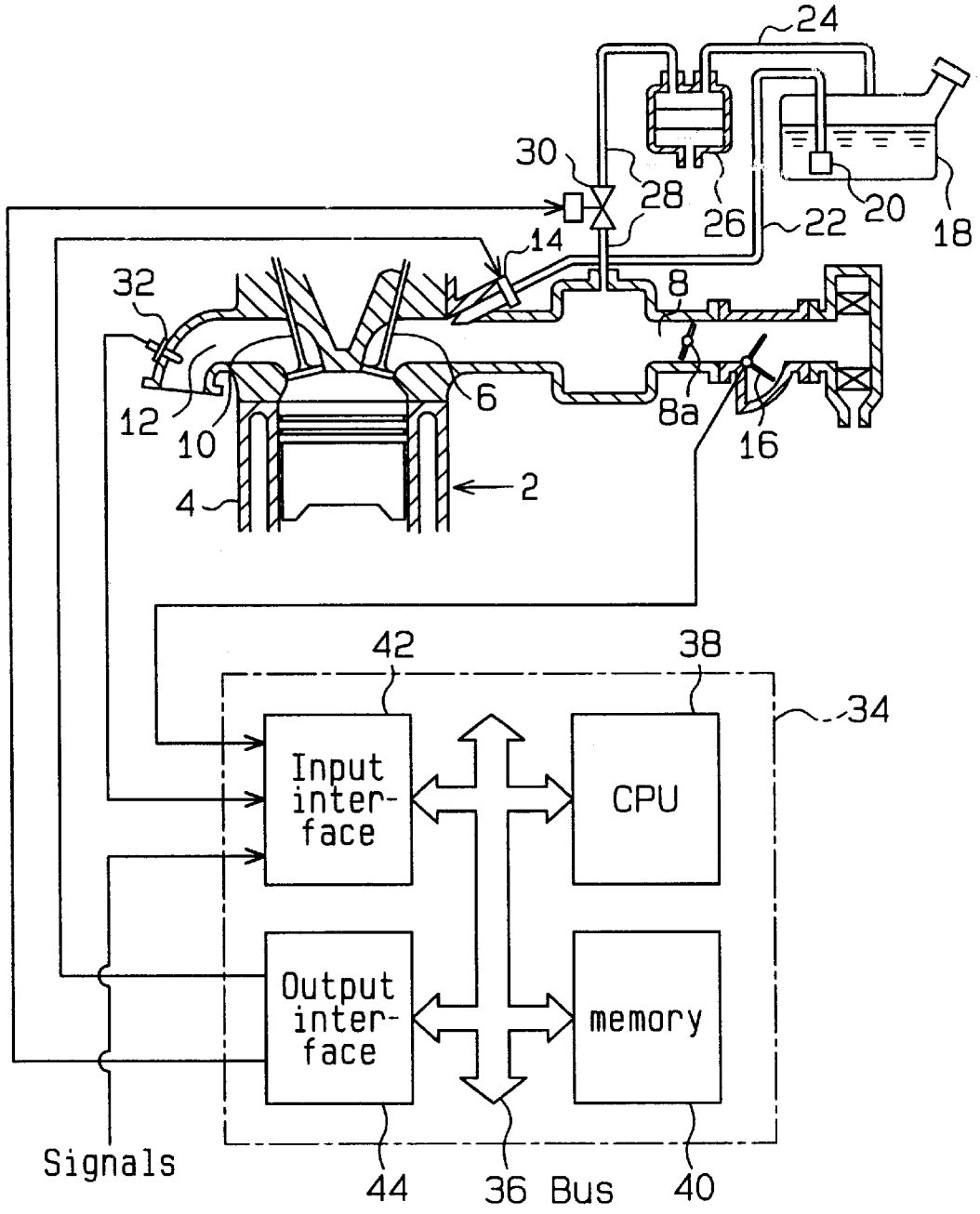
FIG. 1 is a block diagram showing an air-fuel ratio control apparatus according to a first embodiment of this invention.

FIG. 1 shows an internal combustion engine equipped with an air-fuel ratio control apparatus according to the first embodiment. In the first embodiment, a gasoline engine 2 for a vehicle is the internal combustion engine.

An air-intake passage 8 is connected via an intake valve 6 to each cylinder 4 of the gasoline engine 2, and an exhaust passage 12 is connected via an exhaust valve 10 to each cylinder 4. A fuel injection valve 14 is located upstream of the intake valve 6 in the air-intake passage 8. A throttle valve 8*a* regulates the amount of intake air flowing in the air-intake passage 8. The angle of the throttle valve 8*a* is altered directly by an unillustrated acceleration pedal or is altered indirectly as an electronic throttle. An air flow meter 16 for detecting the amount of intake air is located further upstream in the air-intake passage 8.

A fuel tank 18 retains fuel, which is pumped by a fuel pump 20 and then fed to the fuel injection valve 14 via a fuel pipe 22. Fuel vapor resulting from vaporization in the fuel tank 18 is supplied to a canister 26 via a vapor pipe 24.

The canister 26 is connected by a purge pipe 28 to the air-intake passage 8. A purge valve 30 is located midway in the purge pipe 28. Located in the exhaust passage 12 is an air-fuel ratio sensor 32, which detects the air-fuel ratio in the exhaust gas. This air-fuel ratio control apparatus is controlled by an electronic control unit (ECU) 34, which is a computer system.

The ECU 34 has a CPU 38, a memory 40, an input interface 42 and an output interface 44. The CPU 38, memory 40, input interface 42 and output interface 44 are mutually connected by a bus 36. Various sensors including the air-fuel ratio sensor 32 and the air flow meter 16 are connected to the input interface 42. Data representing the air-fuel ratio in the exhaust gas and the amount of intake air is delivered to the ECU 34 through the input interface 42. Though not shown, the ECU 34 receives other various kinds of data indicating the running state of the vehicle through the input interface 42. The various kinds of data include the temperature of the intake air, which is detected by a temperature sensor provided in the air-intake passage 8; a throttle angle signal; an idling signal, which is detected by a throttle sensor provided in the throttle valve 8*a*; the engine speed, which is detected by an engine speed sensor provided on the crankshaft; a coolant temperature, which is detected by a coolant temperature sensor provided in a cylinder block; and the vehicle speed. The ECU 34 is further connected to the fuel injection valve 14 and the purge valve 30 via the output interface 44.

The fuel vapor produced in the fuel tank 18 is temporarily adsorbed by the canister 26. When the purge valve 30 is opened, the air-intake pipe is depressurized. As a result, the fuel vapor adsorbed by the canister 26 is led via the purge pipe 28 to the air-intake passage 8 and is burned in the cylinder 4 together with the fuel that is injected from the fuel injection valve 14. Then, the ECU 34 changes the open time for the fuel injection valve 14 to properly adjust the air-fuel ratio based on the air-fuel ratio in the exhaust gas after combustion, which is detected by the air-fuel ratio sensor 32. This helps to keep the exhaust gas clean.

The air-fuel ratio control procedure executed by the ECU 34 will be described below.

Figure 2:
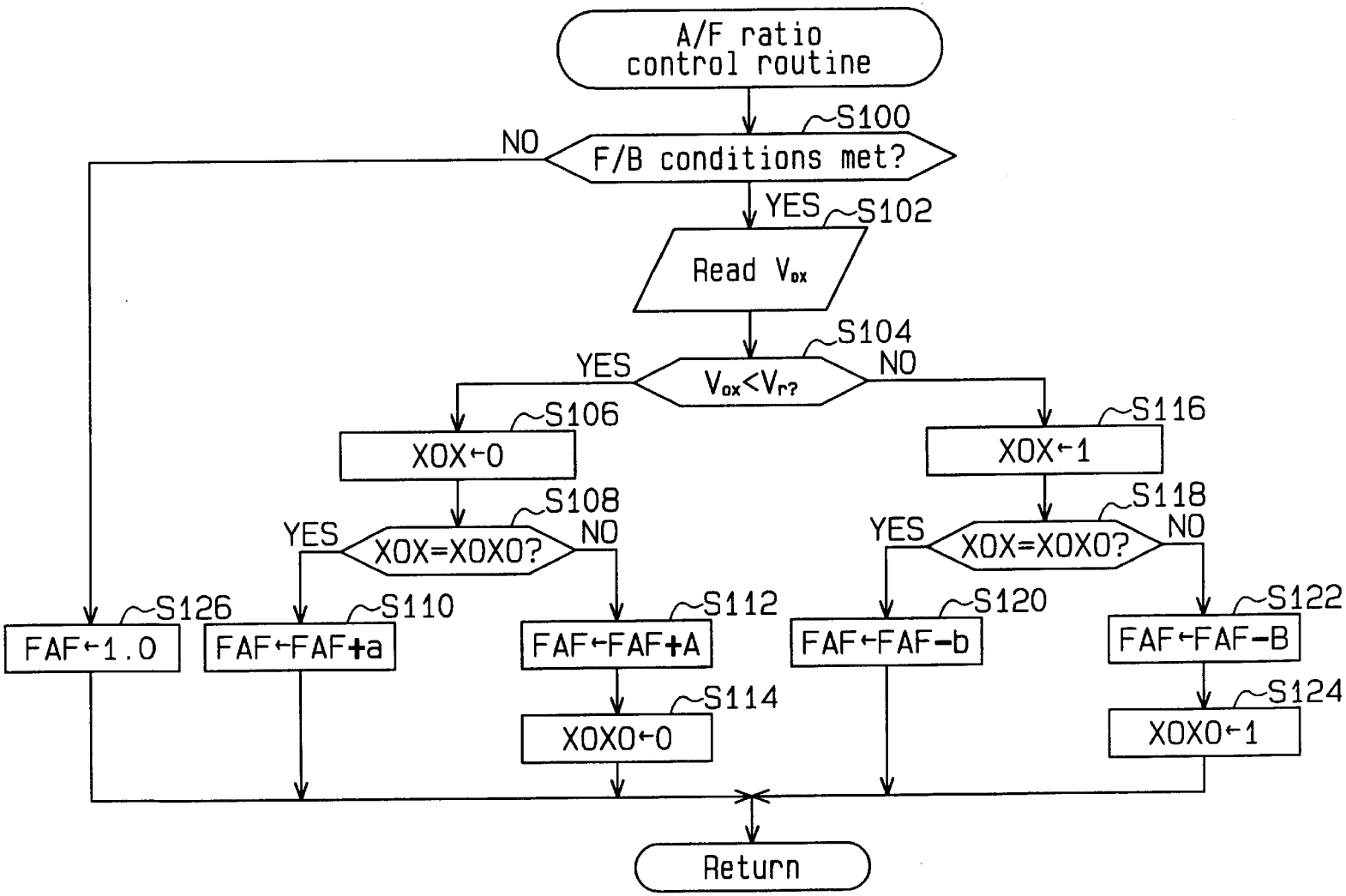
FIG. 2 is a flowchart illustrating an air-fuel-ratio control routine.

The air-fuel-ratio control routine shown in FIG. 2 is executed as an interrupt process every given crank angle.

In this routine, the ECU 34 first determines in step S100 if the following conditions (a) to (d) for feedback control of the air-fuel ratio have been met.

(a) Start-up is not occurring;

(b) Fuel is not being cut off;

(c) Warm-up has been completed (e.g., the coolant temperature THW≧40° C.); and (d) The air-fuel ratio sensor 32 is activated.

When all of the above conditions (a) to (d) is satisfied, the ECU 34 selects YES in step S100 in order to execute the air-fuel ratio feedback control. In the subsequent step S102, the ECU 34 reads the output voltage $V_{ox}$ of the air-fuel ratio sensor 32. In step S104, the ECU 34 determines whether the output voltage $V_{ox}$ is smaller than a predetermined reference voltage $V_r$ (e.g., 0.45 V). When $V_{ox}<V_r$, the air-fuel ratio in the exhaust gas is lean. In this case, the ECU 34 selects YES in step S104 and resets an air-fuel ratio flag XOX (XOX←0) in step S106.

The ECU 34 determines in step S108 whether the air-fuel ratio flag XOX coincides with a status flag XOXO. When XOX=XOXO, the ECU 34 determines that a lean state is being maintained and selects YES in step S108, and then adds a lean integration value a (a>0) to an air-fuel ratio feedback coefficient FAF in step S110. Then, the ECU 34 temporarily terminates this routine.

When XOX≠XOXO in step S108, on the other hand, the ECU 34 determines that a rich state has turned to a lean state and selects NO. In step S112, the ECU 34 adds a lean skip amount A (A>0) to the air-fuel ratio feedback coefficient FAF. This lean skip amount A is significantly larger than the lean integration value a. After the ECU 34 resets the status flag XOXO (XOXO←0) in step S114, it temporarily terminates this routine.

When $V_{ox}\geqq V_r$ in step S104, the air-fuel ratio in the exhaust gas is rich. In this case, the ECU 34 selects NO. In step S116, the ECU 34 sets the air-fuel ratio flag XOX (XOX←1). Next, the ECU 34 determines in step S118 if the air-fuel ratio flag XOX coincides with the status flag XOXO.

When XOX=XOXO, the ECU 34 considers that the rich state is continuing and selects YES in step S118, and then subtracts a rich integration value b (b>0) from the air-fuel ratio feedback coefficient FAF in step S120. Thereafter, the ECU 34 temporarily terminates this routine.

When XOX≠XOXO, the ECU 34 determines that a lean state has turned to a rich state and selects NO in step S118, and then the ECU 34 subtracts a rich skip amount B (B>0) from the air-fuel ratio feedback coefficient FAF in step S122. This rich skip amount B is significantly larger than the rich integration value b. Then, the ECU 34 sets the status flag XOXO (XOXO←1) in step S124. Thereafter, the ECU 34 temporarily terminates this routine.

When none of the above conditions (a) to (d) are satisfied in step S100 (NO in step S100), the ECU 34 sets the air-fuel ratio feedback coefficient FAF to 1.0 in step S126, and then temporarily terminates this routine.

In the above-described air-fuel-ratio control routine, the ECU 34 frequently renews the air-fuel ratio feedback coefficient FAF to make the actual air-fuel ratio equal to a target air-fuel ratio.

Figure 3:
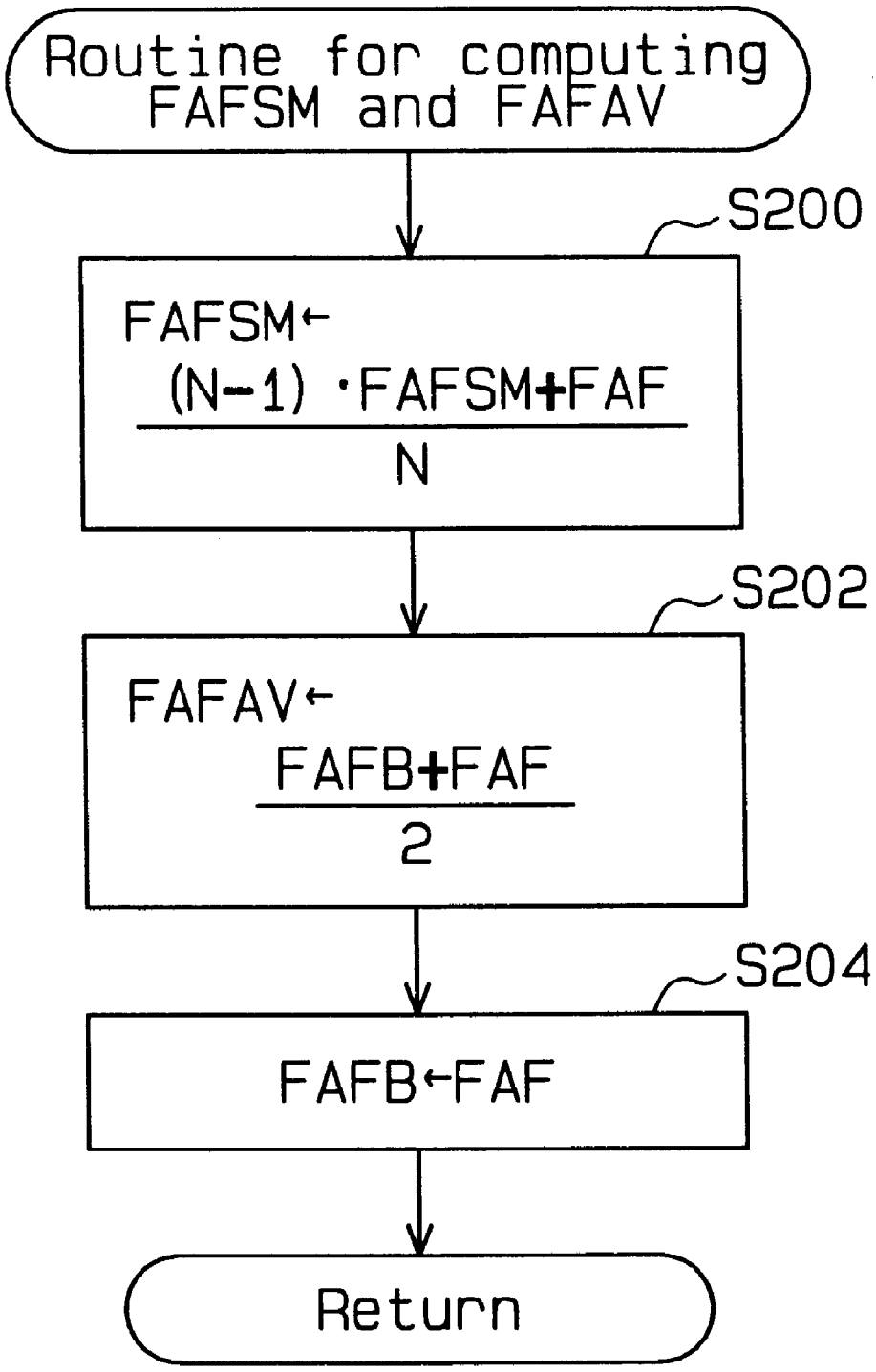
FIG. 3 is a flowchart illustrating a routine for computing the grading value FAFSM of an air-fuel ratio feedback coefficient FAF and the average value FAFAV of the air-fuel ratio feedback coefficient FAF.

FIG. 3 is a flowchart illustrating a routine for computing the grading value FAFSM of the air-fuel ratio feedback coefficient FAF and the average value FAFAV of the air-fuel ratio feedback coefficient FAF. The routine in FIG. 3 is carried out following the air-fuel-ratio control routine in FIG. 2.

In this routine, the ECU 34 first computes the grading value FAFSM of the air-fuel ratio feedback coefficient FAF according to an equation 1 in step S200.

$$FAFSM \leftarrow \{(N-1)\cdot FAFSM+FAF\}/N \quad (1)$$

where N is a relatively large integer like 100. A large value of N makes the grading degree larger. In the equation 1, the previous grading value FAFSM is given a weight of N−1 and the air-fuel ratio feedback coefficient FAF currently computed is given a weight of 1. The weighted mean value of both values is set as the current grading value FAFSM.

Next, in step S202, the ECU 34 computes the average value FAFAV of the air-fuel ratio feedback coefficient FAF and an immediately previous value FAFB according to an equation 2.

$$FAFAV \leftarrow (FAFB+FAF)/2 \quad (2)$$

In step S204, the ECU 34 replaces the value of FAFB with the value of the current air-fuel ratio feedback coefficient FAF to be ready for the next computation. Then, the ECU 34 temporarily terminates this routine.

Figure 4:
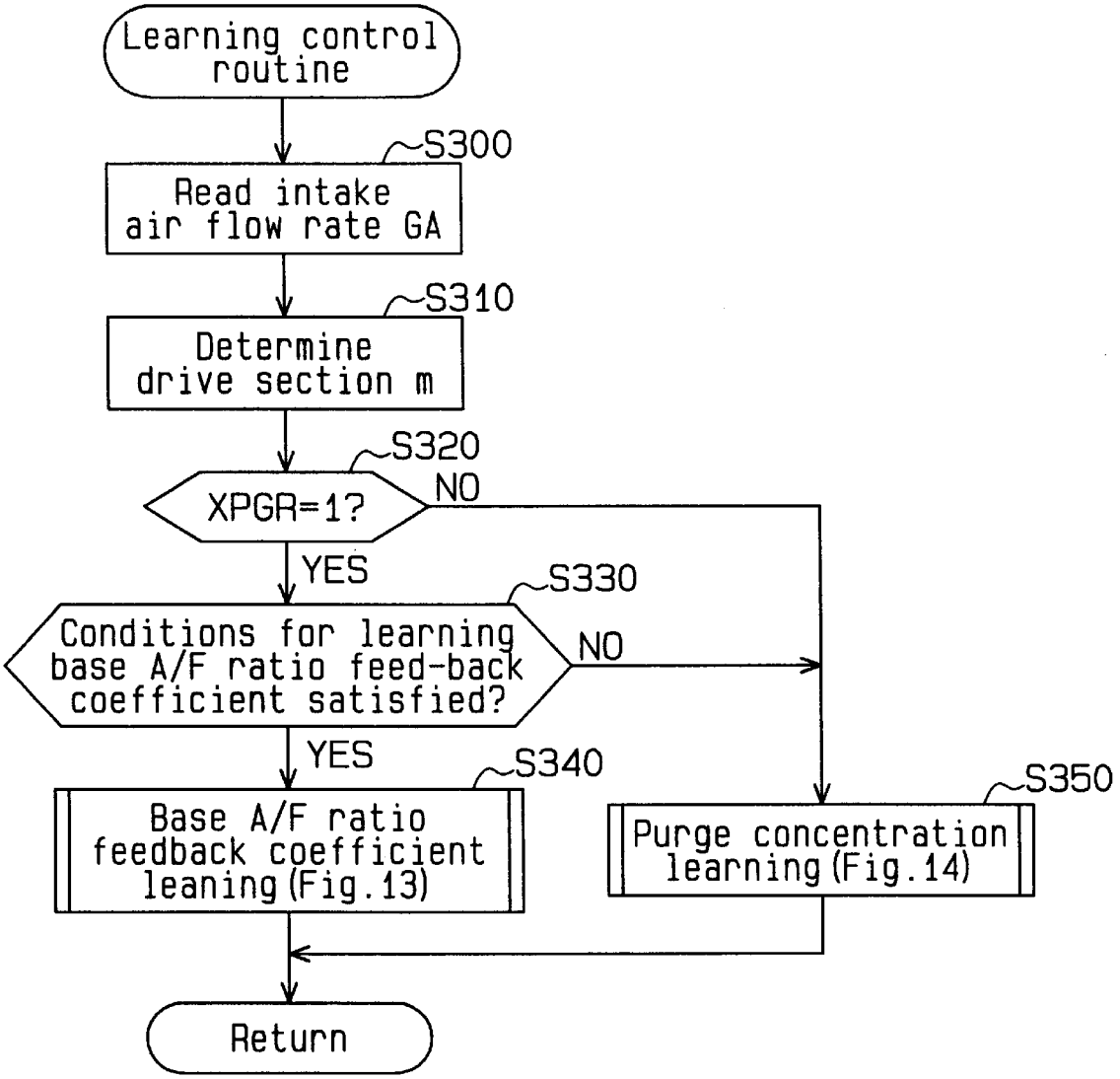
FIG. 4 is a flowchart illustrating a learning control routine.

FIG. 4 is a flowchart illustrating a learning control routine for controlling switching between a purge-concentration learning routine and a base air fuel ratio feedback coefficient learning routine. This routine is also carried out as an interruption process at every given crank angle.

In the learning control routine, the ECU 34 first reads an intake air flow rate GA (g/sec) detected by the air flow meter 16 in step S300. In step S310, the ECU 34 determines an index m, which indicates the drive section of the engine 2 based on the value of this intake air flow rate GA. In the step of determining the index m, first, the amount of intake air is divided into M parts within a range from the maximum intake air flow rate of 0% to 100%. That is, the drive section of the engine 2 is set according to the amount of intake air. Next, it is determined to which drive section the current intake air flow rate GA corresponds. The index m is determined according to the corresponding drive section. The index m indicates the section to which a base air-fuel ratio feedback coefficient KG belongs.

Figure 6:
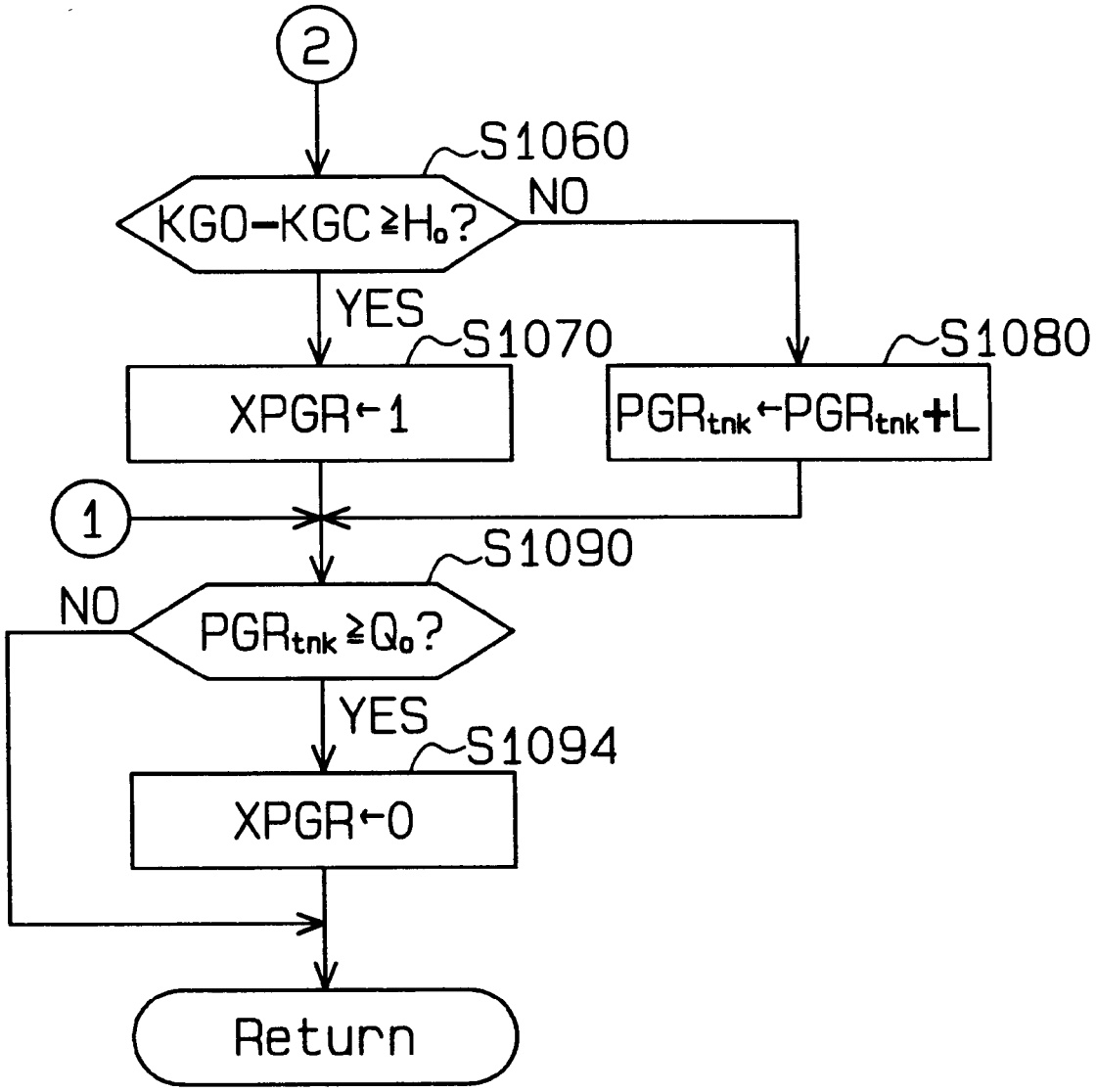
FIG. 6 is a flowchart illustrating the learning permission determining routine.

In the next step S320, the ECU 34 determines whether a permission flag XPGR for learning the base air-fuel ratio feedback coefficient shown in FIG. 6 is set (XPGR=1). When XPGR=1, the ECU 34 selects YES in step S320 and determines in the next step S330 whether the conditions for learning the base air-fuel ratio feedback coefficient are satisfied. Those conditions may be the same as those described with reference to step S100, but another condition that the air-fuel ratio feedback control is stable may be added. In this case, it is determined whether the air-fuel ratio feedback control is stable based on whether or not a certain amount of time has passed after the drive section of the engine 2 was changed.

If the conditions for learning the base air-fuel ratio feedback coefficient are met, the ECU 34 selects YES in step S330 and, in the next step S340, executes the base air fuel ratio feedback coefficient learning routine, which will be specifically discussed later with reference to FIG. 13, to learn the base air-fuel ratio feedback coefficient in the present drive section.

When the permission flag XPGR is in the reset state (XPGR=0), the ECU 34 selects NO in step S320 and advances to step S350. When the conditions for learning the base air-fuel ratio feedback coefficient are not satisfactory, the ECU 34 likewise selects NO in step S330 and goes to step S350. In step S350, the ECU 34 performs the purge-concentration learning routine illustrated in FIG. 14.

The base air fuel ratio learning permission determining routine shown in FIGS. 5 and 6 will now be explained. This routine sets the permission flag XPGR for learning the base air-fuel ratio feedback coefficient. This process is executed upon interruption at every given crank angle.

When this routine is commenced, the ECU 34 first determines in step S1010 if an estimated value $PGR_{tnk}$ for the amount of fuel vapor present in the fuel tank 18 is equal to or smaller than a predetermined reference value $M_0$ ($M_0>0$). The estimated amount of fuel vapor present $PGR_{tnk}$ is acquired in an amount of vapor estimating routine shown in FIG. 8. Through the decision in step S1010, it is determined whether or not the fuel vapor to be purged has a concentration high enough to accurately learn the base air-fuel ratio feedback coefficient without fully closing the purge valve 30.

When the estimated amount of fuel vapor present $PGR_{tnk}$ is a sufficiently small value, i.e., when $PGR_{tnk} \leqq M_0$, the ECU 34 selects YES in step S1010 and moves to step S1020. In step S1020, the ECU 34 determines whether atmospheric pressure $K_{pa}$, is equal to or higher than a necessary atmospheric pressure reference value $P_0$ and if the intake air temperature THA is smaller than a reference value $T_o$ for the high temperature determination. This decision is carried out to avoid both the situation where the atmospheric pressure $K_{pa}$ is lower to some degree than 1 atm, such that fuel vapor is likely to be produced, and the situation where the temperature of the fuel tank 18 that is estimated from the intake air temperature THA is higher to some degree than one of normal operation, such that fuel vapor is likely to be produced. The atmospheric pressure $K_{pa}$. is approximately computed from the angle of the throttle valve 8*a* and the intake air flow rate GA detected by the air flow meter 16. That is, the atmospheric pressure can be estimated from the fact that, when the atmospheric pressure is low, the intake air flow rate GA becomes smaller for a given angle of the throttle valve 8*a*. Alternatively, an atmospheric pressure sensor for directly detecting the atmospheric pressure $K_{pa}$ may be provided.

When $K_{pa} \geqq P_o$ and $THA<T_o$, the ECU 34 selects YES in step S1020 and goes to the next step S1030. In step S1030, the ECU 34 determines whether the current permission flag XPGR is in the reset state (XPGR=0). When the current permission flag XPGR is in the set state (XPGR=1), the process for setting the permission flag XPGR is skipped and the process moves to step S1090. When XPGR=0, on the other hand, the ECU) 34 selects YES in step S1030 and moves to the next step S1040. In step S1040, the ECU 34 determines whether the operation of the engine 2 is stable. Specifically, the ECU 34 determines in step S1040 whether the idling signal is enabled (XIDL=ON) and whether the ranges of variations in engine speed NE and intake air flow rate GA both lie within predetermined ranges. This determination is performed because, unless the engine 2 is stable, the conditions determined in steps S1010–S1030 and 1044 will probably change subsequently, which probably makes the result inadequate for satisfactory air-fuel ratio control.

When XIDL=ON and the engine speed NE and intake air flow rate GA both lie within the aforementioned ranges that indicate stable operation, the ECU 34 selects YES in step S1040 and moves to the next step S1044.

In step S1044, the ECU 34 determines whether the purge rate PGR is equal to or higher than a predetermined purge rate reference value $F_o$. The purge rate PGR is the ratio of the intake air drawn into the cylinder 4 from the intake valve 6 to the gas supplied through the purge valve 30. A purge rate PGR that is equal to or higher than the purge rate reference value F, indicates that the purge rate PGR is sufficiently high. A sufficiently high purge rate PGR is a condition because, if the volume of the gas to be purged is sufficiently large, it is possible to accurately discriminate whether the concentration of fuel vapor being purged is small. If the purge volume is small (the purge rate is small), the concentration of fuel vapor being purged may not be correctly discriminated in the next step S1050. If the condition of step S1044 is satisfied, the process goes to step S1050.

In step S1050, the ECU 34 executes a routine for detecting the behavior of the air-fuel ratio feedback coefficient FAF at the time of opening or closing a purge valve (hereinafter called the purge valve opening/closing mode FAF behavior detecting routine). This routine will be discussed referring to the flowchart of FIG. 7.

First, the ECU 34 stores the current angle of the purge valve 30 in step S1100. The current angle of the purge valve 30 is stored as a duty ratio DTY used in, for example, a purge valve driving routine in FIG. 18.

In the next step S1110, the purge valve 30 is opened to the angle for the upper limit of the purge rate which is determined according to the type of the engine. In step S1120, the ECU 34 checks the behavior of the air fuel ratio feedback coefficient FAF in this state. Specifically, the ECU 34 acquires a behavior detection value in purge mode KGO, in a way similar to the way used to obtain the base air-fuel ratio feedback coefficient KG(m), using a process similar to the learning routine shown in FIG. 13. In this manner, the behavior of the air-fuel ratio feedback coefficient FAF is checked.

In step S1130, based on the number of integrations of the air-fuel ratio feedback coefficient FAF or the number of skipped processes, the ECU 34 determines whether detection of the behavior detection value in purge mode KGO has been completed. When the conditions for completing the detection of the behavior detection value in purge mode KGO are not met, the ECU 34 selects NO in step S1130 and returns to step S1120 to repeat the process therein. When the conditions for completing the detection of the behavior detection value in purge mode KGO are met, on the other hand, the ECU 34 selects YES in step S1130 and proceeds to the next step S1132. In step S1132, the ECU 34 adds a purge compensation coefficient FPG to the behavior detection value in purge mode KGO to update the behavior detection value in purge mode KGO.

In step S1140, the ECU 34 fully closes the purge valve 30 (DTY=0%). In step S1150, the ECU 34 checks the behavior of the air-fuel ratio feedback coefficient FAF again with the purge valve 30 fixed at that position. In this case too, specifically, the ECU 34 acquires a behavior detection value in non-purge mode KGC, in a way similar to the way used to obtain the base air-fuel ratio feedback coefficient KG(m), using the same process as the learning routine shown in FIG. 13. In this manner, the behavior of the air-fuel ratio feedback coefficient FAF is checked.

In step S1160, based on the number of integrations of the air-fuel ratio feedback coefficient FAF or the number of skipped processes, the ECU 34 determines whether detection of the behavior detection value KGC in non-purge mode has been completed. When the detection of the behavior detection value KGC in non-purge mode has not been finished, the ECU 34 selects NO in step S1160 and repeats the process in step S1150.

When the detection of the behavior detection value KGC in non-purge mode is completed, the ECU 34 selects YES in step S1160 and proceeds to step S1170. In step S1170, the ECU 34 sets the angle of the purge valve 30 back to the one stored in step S1100, thereby making the angle of the purge valve 30 adjustable. This terminates the routine in step S1050 for detecting the behaviors of the air-fuel ratio feedback coefficient at the time of opening or closing a purge valve.

In the next step S1060, the ECU 34 determines whether the difference (KGO-KGC) between the behavior detection value in purge mode KGO and the behavior detection value KGC in non-purge mode is equal to or greater than a predetermined behavior difference reference value $H_o$. This reference value $H_o$ is a criterion for determining whether the concentration of fuel vapor being purged is lean enough not to affect learning of the base air-fuel ratio feedback coefficient KG(m) and $H_o$ varies in accordance with the aforementioned angle for the upper limit of the purge rate, which is determined according to the type of the engine.

If the concentration of fuel vapor in the gas to be purged is in a range from zero to a value equivalent to the theoretical air-fuel ratio (stoichiometric value), for example, then the concentration will not adversely affect learning of the base air-fuel ratio feedback coefficient KG (m). Therefore, the reference value H, is set equal to the difference between the behavior detection value KGC in purge mode in a case where the concentration of fuel vapor in the gas to be purged ranges from zero to the stoichiometric value and the behavior detection value KGC in non-purge mode.

That is, since the concentration of fuel vapor in the gas to be purged is stoichiometric, KGO=KGC is established, so that the reference value $H_o$=0. When the concentration of fuel vapor in the gas to be purged is zero, KGO>KGC so that the reference value $H_o$>0. While it seems better to set the reference value $H_o$ to zero, it is possible to properly learn the base air-fuel ratio feedback coefficient KG(m) even when the concentration of fuel vapor in the gas to be purged is slightly higher than the stoichiometric value. Therefore, the reference value Ho can be set to a value slightly smaller than zero (e.g., $H_o$=−0.1). Because the optimal reference value $H_o$ varies according to the angle for the upper limit of the purge rate, it may be altered as needed.

When KGO−KGC>$H_o$ in step S1060, the ECU 34 determines that the concentration of fuel vapor being purged is lean enough not to affect learning of the base air-fuel ratio feedback coefficient KG(m) and selects YES. In the subsequent step S1070, the ECU 34 sets the permission flag XPGR to permit learning of the base air-fuel ratio feedback coefficient.

When KGO−KGC <$H_o$, on the other hand, the concentration of the actual fuel vapor in the gas to be purged is high, although it has been determined in step S1010 that the estimated amount of fuel vapor present $PGR_{tnk}$ is sufficiently small. In this case, the ECU 34 adds an error equivalent value L to the estimated amount of fuel vapor present $PGR_{tnk}$ in step S1080. For example, the value of KGC−KGO is used as this error equivalent value L.

When the decision in any of steps 1010 to 1044 is NO or step S1070 or S1080 is completed, the ECU 34 determines in step S1090 whether the estimated amount of fuel vapor present $PGR_{tnk}$ is greater than a reference value $Q_o$ for determining the concentration. In other words, it is determined in step S1090 whether the concentration of fuel vapor being purged is rich enough to influence learning of the base air-fuel ratio feedback coefficient KG(m).

When $PGR_{tnk} \geqq Q_o$ ($Q_o$>$M_o$), the ECU 34 selects YES in step S1090. In this case, the base air-fuel ratio feedback coefficient KG(m) should not be learned, the ECU 34 resets the permission flag XPGR for learning the base air-fuel ratio feedback coefficient KG(m) in step S1094, and the routine is temporarily terminated. When $PGR_{tnk}$<$Q_o$, the ECU 34 selects NO in step S1090 and temporarily terminates the routine.

Figure 8:
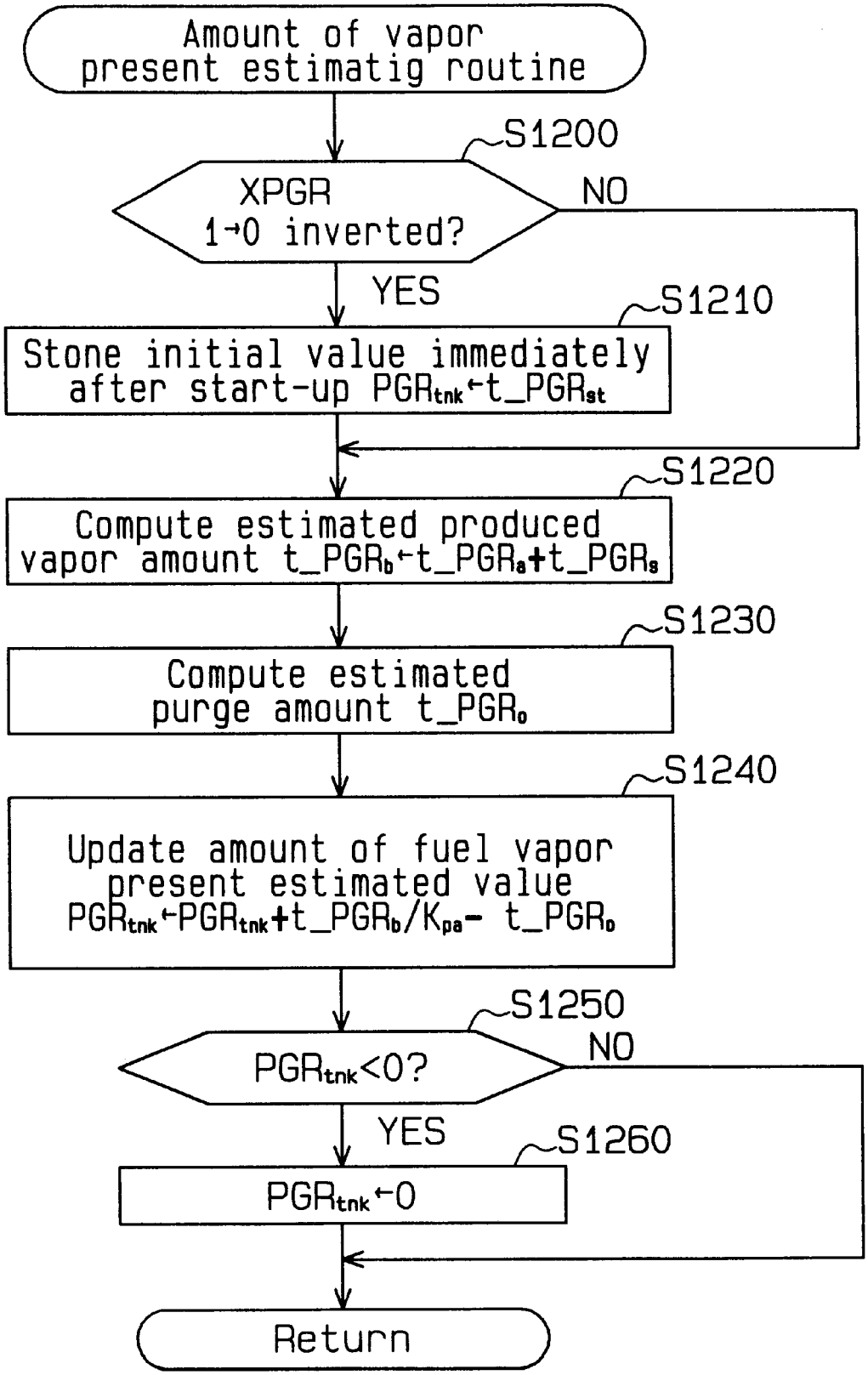
FIG. 8 is a flowchart illustrating an vapor amount estimating routine.

Referring now to FIG. 8, the vapor amount estimating routine for determining the estimated amount of fuel vapor present $PGR_{tnk}$ will be discussed. This vapor amount estimating routine is executed upon interruption made every given cycle.

In the vapor amount estimating routine, the ECU 34 first determines in step S1200 if the permission flag XPGR for learning the base air-fuel ratio feedback coefficient has been reset (XPGR=0) from the set state (XPGR=1) since the previous execution of this routine. When YES has been selected in step S1090 in the-learning permission determining routine illustrated in FIGS. 5 and 6 during the period from the previous execution of this routine to the present execution, it is understood that the permission flag XPGR has been reset. Note that YES is selected in step S1200 at the first execution of the vapor amount estimating routine after the engine 2 is started.

When the permission flag XPGR is reset from the set state or immediately after the engine is started, YES is selected in step S1200 and the initial value $t_PGR_{st}$ is set as the estimated amount of fuel vapor present $PGR_{tnk}$ in the subsequent step S1210 (which is stores the initial value immediately after start-up).

Figure 9:
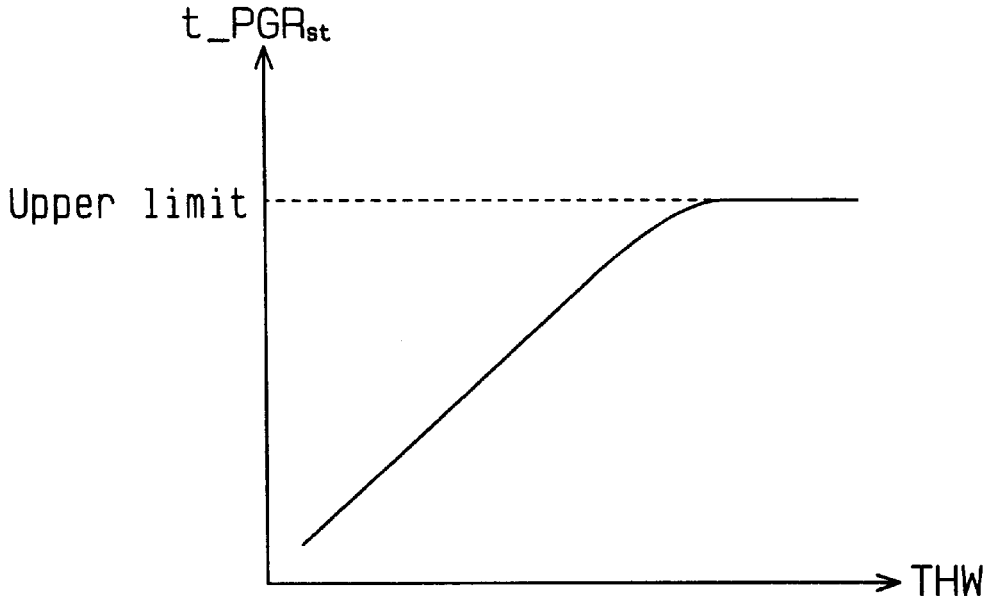
FIG. 9 is a graph showing the relationship between the initial value $t_PGR_{st}$ of an estimated amount of fuel vapor present and a coolant temperature THW which are used in the process in FIG. 8.

Nearly the maximum value for the amount of fuel vapor that may be produced in the fuel tank 18 is used as the initial value $t_PGR_{st}$. Since the maximum value for the amount of fuel vapor to be produced varies according to the operating conditions of the engine 2, the initial value $t_PGR_{st}$ may be altered in accordance with the coolant temperature THW at the start-up time as shown by, for example, the graph in FIG. 9. In the graph in FIG. 9, the upper limit of the initial value $t_PGR_{st}$ is restricted. Of course the initial value $t_PGR_{st}$ can be constant.

Figure 10:
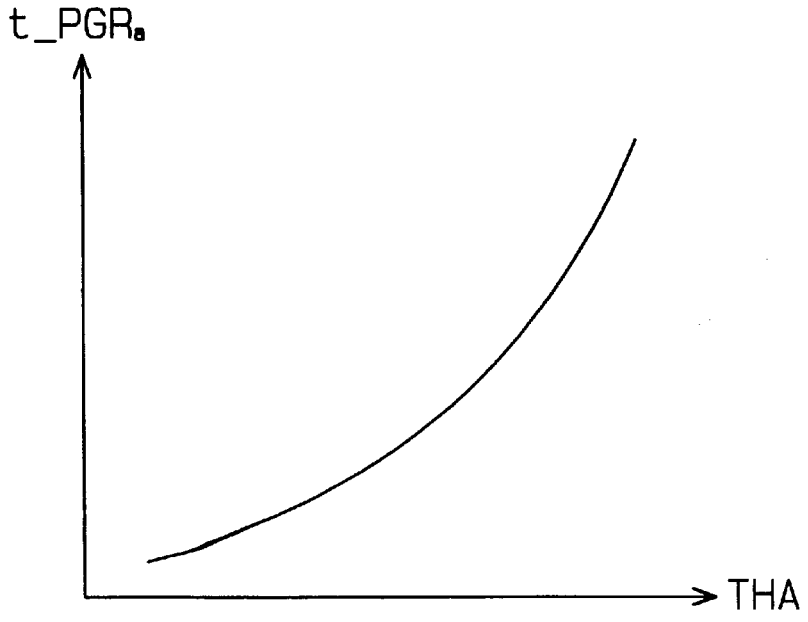
FIG. 10 is a graph showing the relationship between a first produced amount $t_PGR_a$ and an intake air temperature THA which are used in the process in FIG. 8.

After step S1210 or after the ECU 34 selects NO in step S1200, when the permission flag XPGR has been switched to the reset state from the set state or it is not immediately after start-up, in the next step S1220, the ECU 34 calculates an estimated produced vapor amount $t_PGR_b$ in step S1220 using an equation 3.

$$t_PGR_b - t_PGR_a + t_PGR_s \quad (3)$$

where the first produced amount $t_PGR_a$ represents an amount of gas generation that reflects the fuel temperature in the fuel tank 18. It is known that, in the first embodiment, the fuel temperature in the fuel tank 18 and the temperature of the intake air flowing in the air-intake passage 8 tend to vary similarly. Thus, the first produced amount $t_PGR_a$ is acquired based on the intake air temperature THA from a graph shown in FIG. 10, which has the intake air temperature THA as a parameter.

Figure 11:
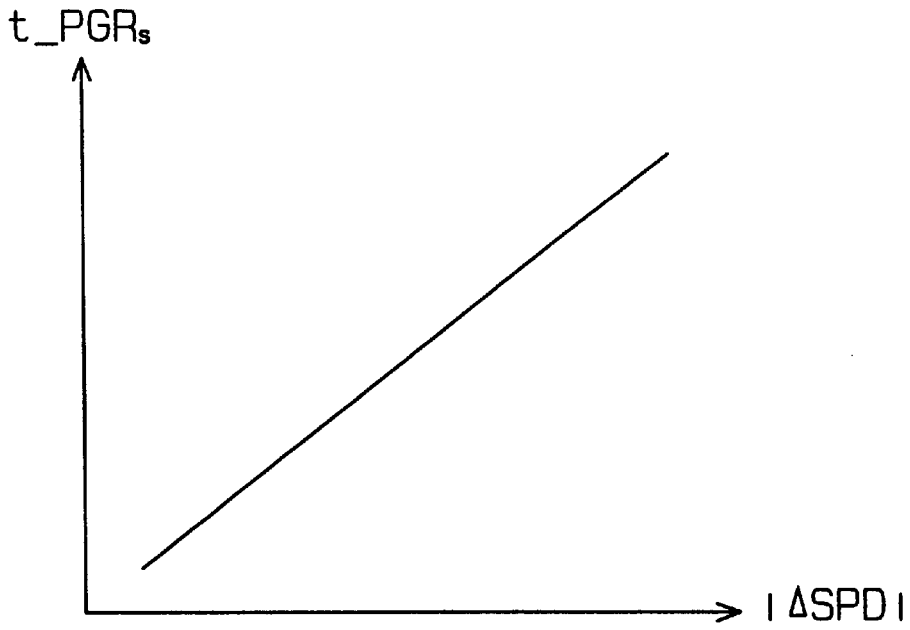
FIG. 11 is a graph showing the relationship between a second produced amount $t_PGR_s$ and the absolute value speed |ΔSPD| of a change in the vehicle speed which are used in the process in FIG. 8.

The second produced amount $t_PGR_s$ represents an amount of gas generation that reflects the level of waves produced on the surface of the fuel in the fuel tank 18. When the level of the waves produced on the surface of the fuel in the fuel tank 18 (i.e., the splashing of the fuel) is large, the amount of fuel vapor becomes large, and the second produced amount $t_PGR_s$ is set to a large value. In the first embodiment, since the engine 2 is mounted in a vehicle, a change in the vehicle speed SPD is associated with the level of the waves, and the second produced amount $t_PGR_s$ is set from a map shown in FIG. 11 based on the absolute value of the amount of change in vehicle speed $|\Delta SPD|$.

Next, the ECU 34 computes an estimated purge amount $t_PGR_o$ in step S1230. The estimated purge amount $t_PGR_o$ is calculated based on a purge rate $PGR_{fr}$ as indicated by, for example, a graph in FIG. 12. The purge rate $PGR_{fr}$ indicates the amount of gas discharged into the air-intake passage 8 from the purge pipe 28 and is calculated from the purge rate PGR and the intake air flow rate GA (g/sec) according to an equation 4.

$$PGR_{fr} \leftarrow PGR \times GA \quad (4)$$

Figure 12:
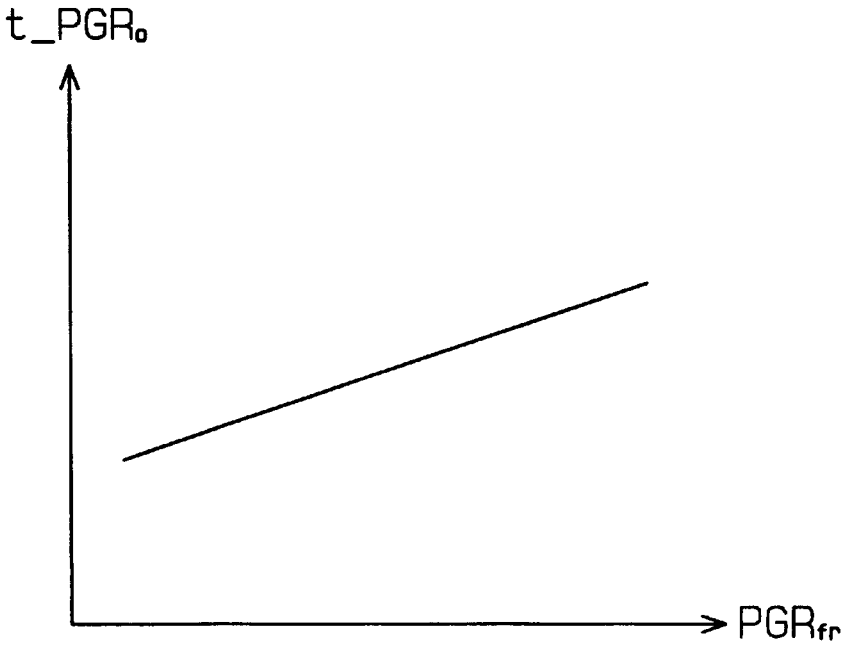
FIG. 12 is a graph showing the relationship between an estimated purge amount $t_PGR_o$ and a purge rate $PGR_{fr}$ which -are used in the process in FIG. 8.

The graph in FIG. 12 is drawn on the assumption that the vapor pressure of the fuel vapor present as seen in the purge rate $PGR_{fr}$ is lower than the normal one.

In the next step S1240, the ECU 34 updates the estimated amount of fuel vapor present $PGR_{tnk}$ according to an equation 5.

$$PGR_{tnk} PGR_{tnk} + t_PGR_b / K_{pa} - t_PGR_o \quad (5)$$

In the equation 5, the estimated amount of fuel vapor present $PGR_{tnk}$ in the fuel tank 18 is estimated based on the balance between the estimated produced vapor amount $t_PGR_b$ in the fuel tank 18 and the estimated purge amount $t_PGR_o$ of the fuel vapor. Here, the atmospheric pressure $K_{pa}$ is acquired as discussed in the foregoing description of step S1020 in FIG. 5. Because the generation of fuel vapor increases as the atmospheric pressure $K_{pa}$ decreases, the estimated amount of fuel vapor present $PGR_{tnk}$ is set to increase as the atmospheric pressure $K_{pa}$ decreases.

In steps 1250 and 1260, the ECU 34 corrects the lower limit of the resulting estimated amount of fuel vapor present $PGR_{tnk}$. That is, the ECU 34 determines in step S1250 whether the estimated amount of fuel vapor present $PGR_{tnk}$ is negative. If $PGR_{tnk}<0$ (YES in step S1250), the ECU 34 corrects the value of $PGR_{tnk}$ to zero in step S1260 and then temporarily terminates this routine. If $PGR_{tnk} \geqq 0$ (NO in step S1250), the ECU 34 temporarily terminates this routine without changing $PGR_{tnk}$.

In the vapor amount estimating routine in FIG. 8, as apparent from the above, the amount of fuel vapor present in the fuel tank 18 is estimated from the balance between the amount of fuel vapor produced and the purge amount of fuel vapor by repeating steps S1220–S1240. Every time the permission flag XPGR for learning the base air-fuel ratio feedback coefficient is reset (YES in step S1200), the amount of fuel vapor present in the fuel tank 18 is re-estimated from the beginning by setting the initialized value in step S1210.

The base air fuel ratio feedback coefficient learning routine (step S340), which is executed in the above-described learning control routine, will be discussed below with reference to the flowchart in FIG. 13.

In this routine, first, the ECU 34 determines in step S410 whether the aforementioned average value FAFAV of the air-fuel ratio feedback coefficient FAF is smaller than 0.98. When FAFAV<0.98, the ECU 34 selects YES in step S410 and subtracts an amount of change P from the base air-fuel ratio feedback coefficient KG(m) of a drive section m in the subsequent step S420. Thereafter, the ECU 34 temporarily terminates the routine.

When FAFAV≧0.98, the ECU 34 selects NO in step S410 and determines whether the average value FAFAV is greater than 1.02 in the following step S430. When FAFAV>1.02, the ECU 34 selects YES in step S430. In step S440, the ECU 34 adds the amount of change β to the base air-fuel ratio feedback coefficient KG(m), after which the ECU 34 temporarily terminates the routine.

When 0.98≦FAFAV≦1.02, the ECU 34 selects NO in step S410 and NO in step S430 and then temporarily terminates the routine without changing the base air-fuel ratio feedback coefficient KG(m) of the drive section m.

Note that zero is set as the initial value of the base air-fuel ratio feedback coefficient KG(m) when the ECU 34 is powered on.

The purge-concentration learning routine described in step S350 in FIG. 4 will now be discussed in detail according to the flowchart in FIG. 14.

In step S510, the ECU 34 determines whether the grading value FAFSM of the air-fuel ratio feedback coefficient FAF, or the average value of the air-fuel ratio feedback coefficients over a long period of time, is smaller than 0.98. When FAFSM<0.98, the ECU 34 selects YES in step S510. In this case, as the grading value FAFSM of the air-fuel ratio feedback coefficient FAF indicates leanness, the ECU 34 determines that the current purge-concentration learned value FGPG is too large. In other words, the ECU 34 determines that the amount of fuel vapor in the purged gas has been overestimated up to this step. Therefore, the ECU 34 subtracts an amount of change a from the purge-concentration learned value FGPG in step S520 and temporarily terminates the routine.

When FAFSM≧0.98, the ECU 34 selects NO in step S510 and determines whether the grading value FAFSM is greater than 1.02 in the subsequent step S530. When FAFSM>1.02, the ECU 34 selects YES in step S530. In this case, because the grading value FAFSM of the air-fuel ratio feedback coefficient FAF indicates richness, the ECU 34 determines that the current purge-concentration learned value FGPG is too small. In other words, the ECU 34 determines that the amount of fuel vapor in the purged gas has been underestimated. Therefore, the ECU 34 adds the amount of change a to the current purge-concentration learned value FGPG and temporarily terminates the routine.

When 0.98≦FAFSM≦1.02, the ECU 34 selects NO in step S510 and selects NO in the next step S530. In this case, the ECU 34 temporarily terminates the routine without changing the purge-concentration learned value FGPG.

Unlike the base air-fuel ratio feedback coefficient KG(m), the purge-concentration learned value FGPG is not obtained for every drive section of the engine 2 but is common to all the drive sections of the engine 2.

A purge-rate control routine shown in FIG. 15 will now be discussed. This routine is likewise executed by interruption at every given crank angle.

In this routine, the ECU 34 first determines in step S610 if the air-fuel ratio feedback control is under way. When the air-fuel ratio feedback control is under way, the ECU 34 selects YES in step S610 and determines in the next step S620 if the coolant temperature THW is equal to or higher than 50° C. When THW≧50° C., the ECU 34 selects YES in step S620 and computes the purge rate PGR in step S630. After calculating the purge rate PGR, the ECU 34 sets a purge execution flag XPGON (XPGON←1) in step S640 and temporarily terminates the routine.

When NO is selected in either step S610 or step S620, i.e., when the air-fuel ratio feedback control is not under way or the coolant temperature THW<50° C., however, the process goes to step S650. In step S650, the ECU 34 sets the purge rate PGR to zero. The ECU 34 resets the purge execution flag XPGON (XPGON←0) in step S660 and temporarily terminates the routine.

A purge-rate PGR computing routine in step S630 will now be discussed according to a flowchart illustrated in FIG. 16.

Figure 17:
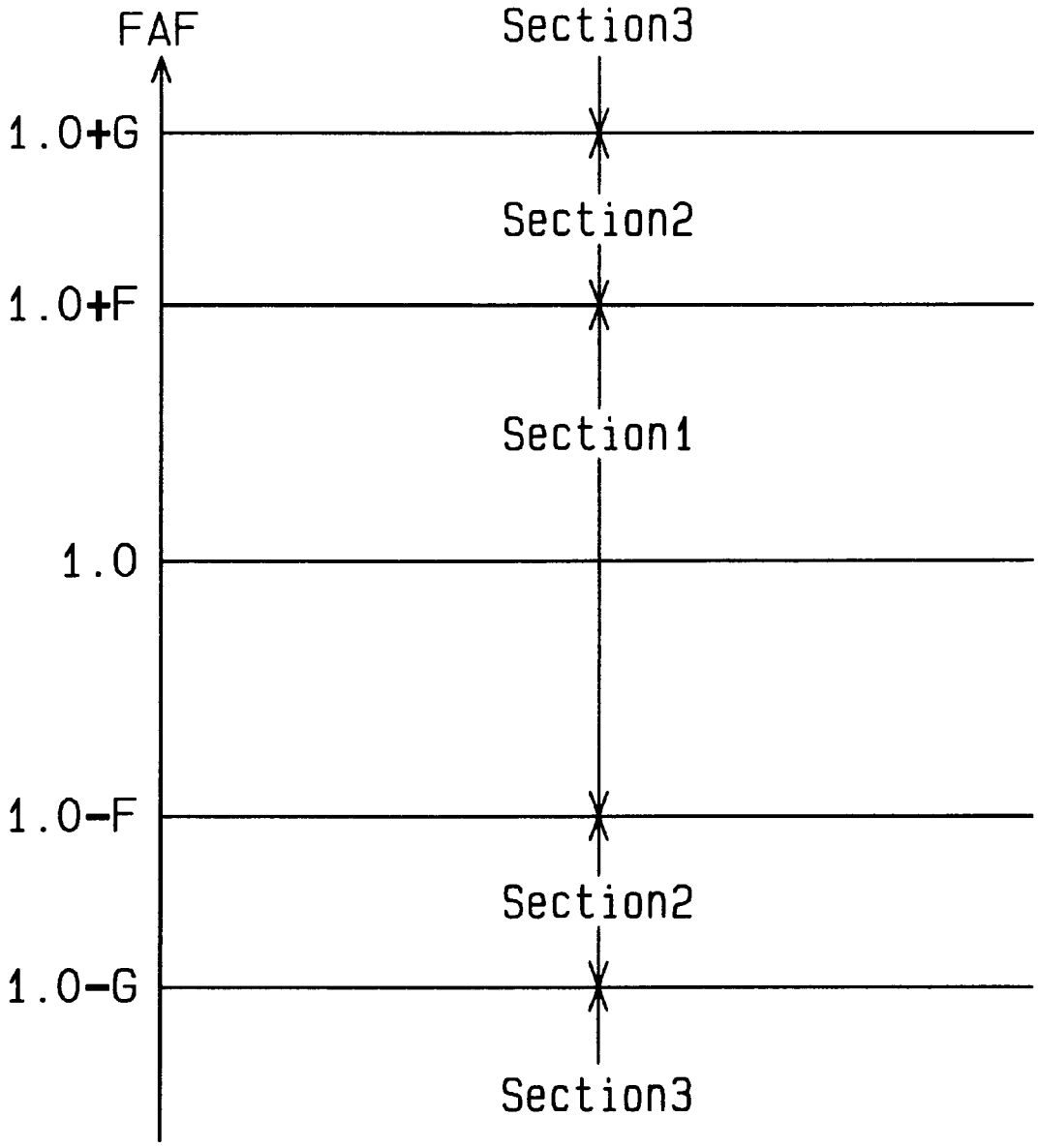
FIG. 17 is a drawing for explaining section determination which is carried out in the routine in FIG. 16.

In this routine, first, the ECU 34 determines in step S710 to what section the air-fuel ratio feedback coefficient FAF belongs. As exemplified in FIG. 17, the air-fuel ratio feedback coefficient FAF is classified into a section 1, a section 2 or a section 3 in accordance with the value of the air-fuel ratio feedback coefficient FAF. When the air-fuel ratio feedback coefficient FAF lies within 1.0±F, section 1 is chosen. When the air-fuel ratio feedback coefficient FAF lies between 1.0±F and 1.0+G, section 2 is chosen. When the air-fuel ratio feedback coefficient FAF is greater than 1.0+G or smaller than 1.0−G, section 3 is chosen. F and G have the relationship 0<F<G.

When it is determined in step S710 that the air-fuel ratio feedback coefficient FAF belongs to section 1, the ECU 34 increases the purge rate PGR by a purge rate increment D in step S720. When it is determined in step S710 that the air-fuel ratio feedback coefficient FAF belongs to section 2, the purge rate PGR is not altered. When it is determined in step S710 that the air-fuel ratio feedback coefficient FAF belongs to section 3, the ECU 34 decreases the purge rate PGR by a purge rate decrement E in step S730.

In step S740, a guard process is carried out for the value of the purge rate PGR that has been changed in the process of step S720 or step S730 or for the value of the purge rate PGR that has not changed because it was determined in step S710 that the air-fuel ratio feedback coefficient FAF belonged to section 2. In this guard process, the purge rate PGR is set to a predetermined upper limit when it exceeds the upper limit and is set to a predetermined lower limit when it falls below the lower limit. Then, the routine is temporarily terminated.

Figure 15:
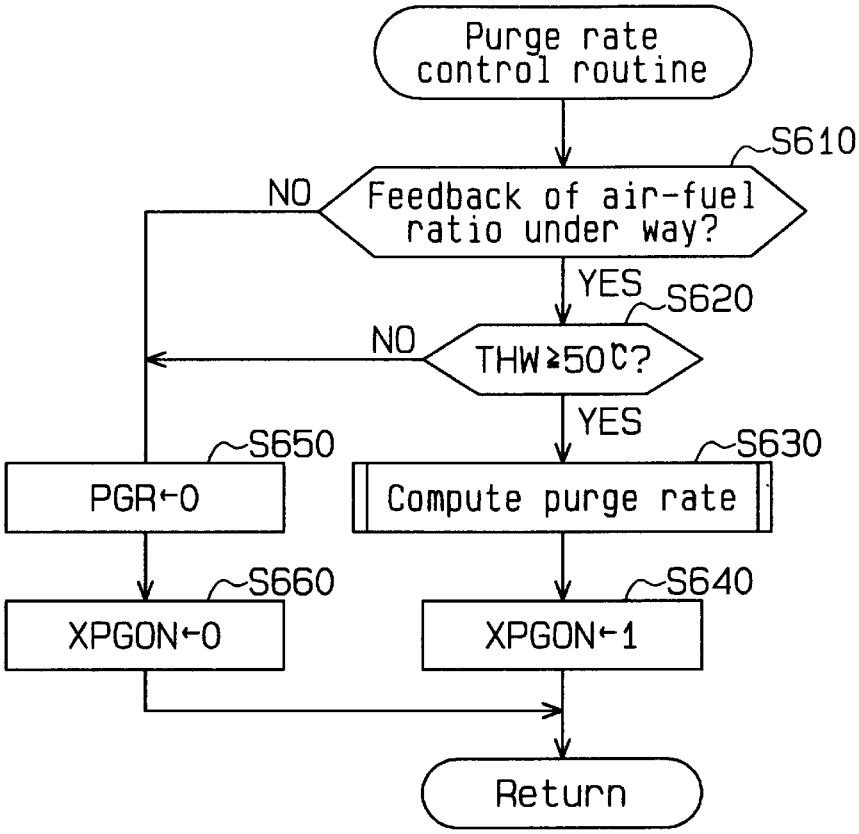
FIG. 15 is a flowchart illustrating a purge-rate control routine.
Figure 18:
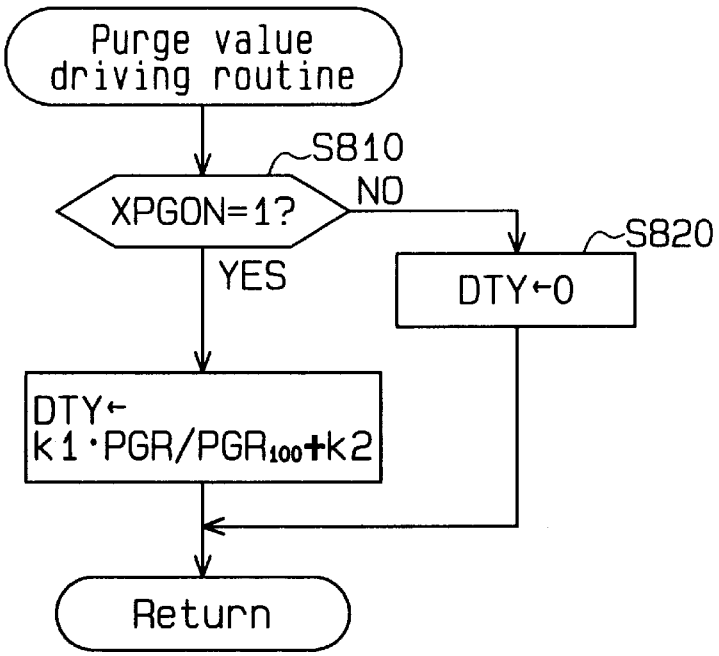
FIG. 18 is a flowchart illustrating a purge-valve driving routine.

A purge-valve driving routine shown in FIG. 18 uses the purge rate PGR and the purge execution flag XPGON both acquired in the purge-rate control routine in FIG. 15. This routine is executed by interruption at every given crank angle.

When this routine starts, the ECU 34 determines in step S810 whether the purge execution flag XPGON is set. When the flag XPGON is in the reset state (XPGON=0), the ECU 34 selects NO in step S810 and sets the duty ratio DTY to zero in step S820. Thereafter, the ECU 34 temporarily terminates the routine.

Figure 19:
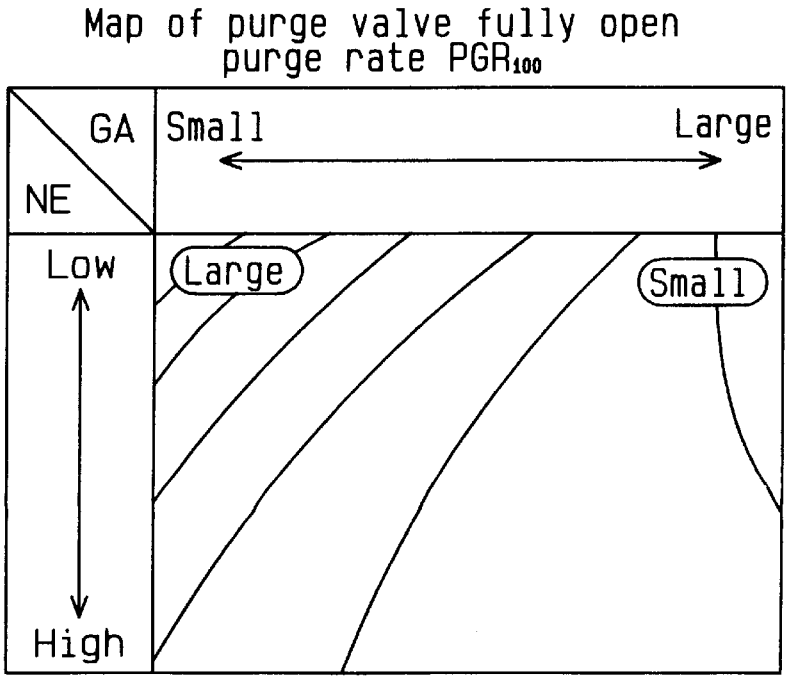
FIG. 19 is a map which is used in determining a purge-valve fully-open purge rate $PGR_{100}$ used in the routine in FIG. 18 from an intake air flow rate GA and an engine speed NE.

When the purge execution flag XPGON is set (XPGON=1), the ECU 34 selects YES in step S810 and computes the duty ratio DTY according to an equation 6.

$$DTY-k1-PGR/PGR_{100}+k2 \quad (6)$$

where $PGR_{100}$ indicates the purge rate when the purge valve 30 is fully open (hereinafter referred to as fully-open-mode purge rate) and k1 and k2 are compensation coefficients which are determined according to the battery voltage or the atmospheric pressure. $PGR_{100}$ is determined from the engine speed NE of the engine 2 and the intake air flow rate GA in accordance with a map shown in FIG. 19. The intake air flow rate GA is used as a parameter indicating the load of the engine 2. The map in FIG. 19 is set through experiments previously conducted. In FIG. 19, the constant values of the fully-open-mode purge rate $PGR_{100}$ are shown as contour lines. As apparent from FIG. 19, the smaller the intake air flow rate GA is, the greater the purge-valve fully-open purge rate $PGR_{100}$ is. Further, the lower the engine speed NE is, the greater the purge-valve fully-open purge rate $PGR_{100}$ is set. In an area where the intake air flow rate GA is significantly large, however, the purge-valve fully-open purge rate $PGR_{100}$ decreases as the engine speed NE decreases.

Figure 20:
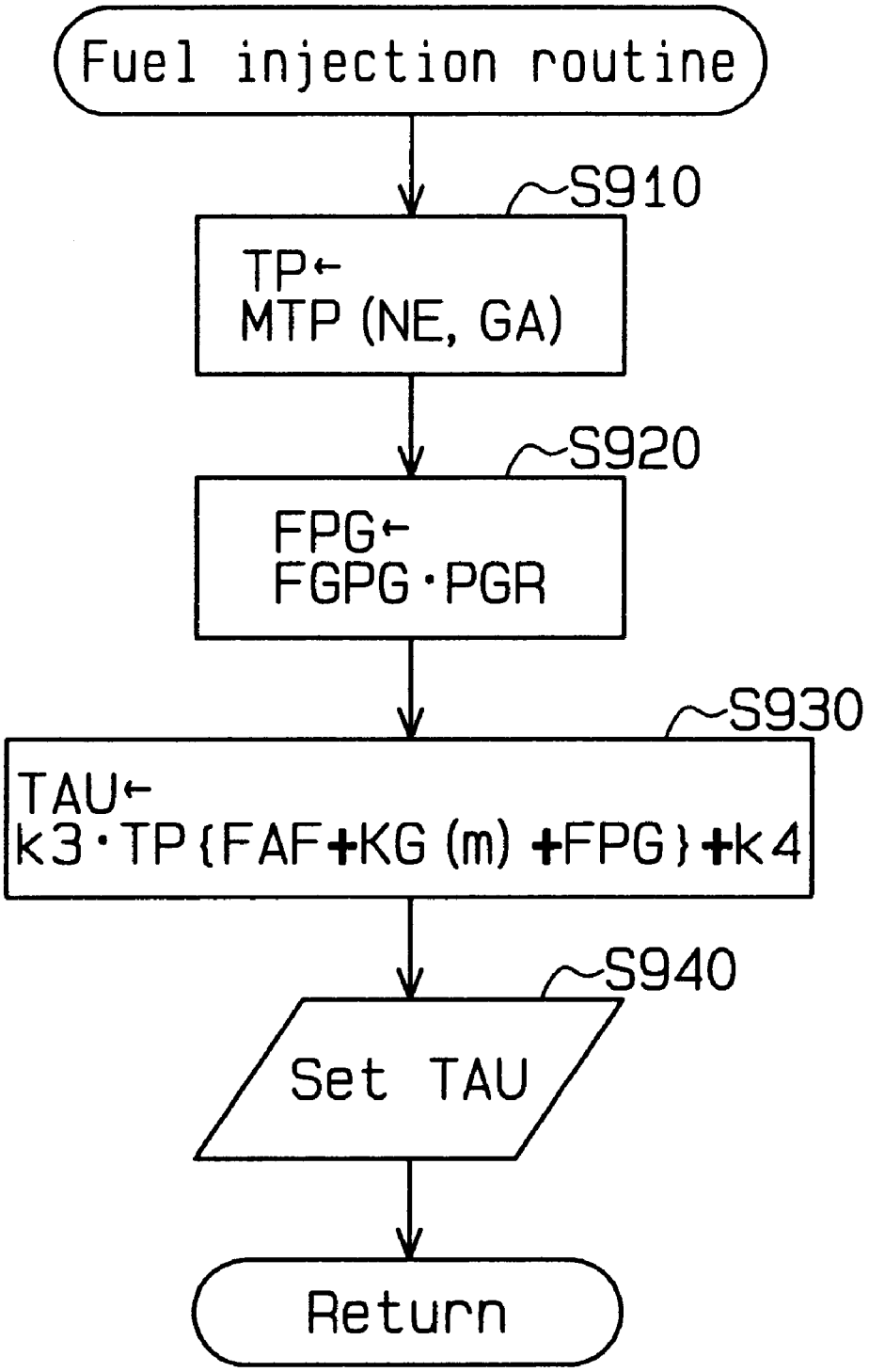
FIG. 20 is a flowchart illustrating a fuel injection routine.

Based on the acquired base air-fuel ratio feedback coefficient KG(m), the purge-concentration learned value FGPG and the purge rate PGR, a fuel injection routine shown in FIG. 20 is carried out. This routine is executed by interruption at every given crank angle.

When this routine is commenced, the ECU 34 acquires a basic fuel-injection-valve open time TP in step S910 using an unillustrated map MTP based on the engine speed NE of the engine 2 and the intake air flow rate GA.

Figure 14:
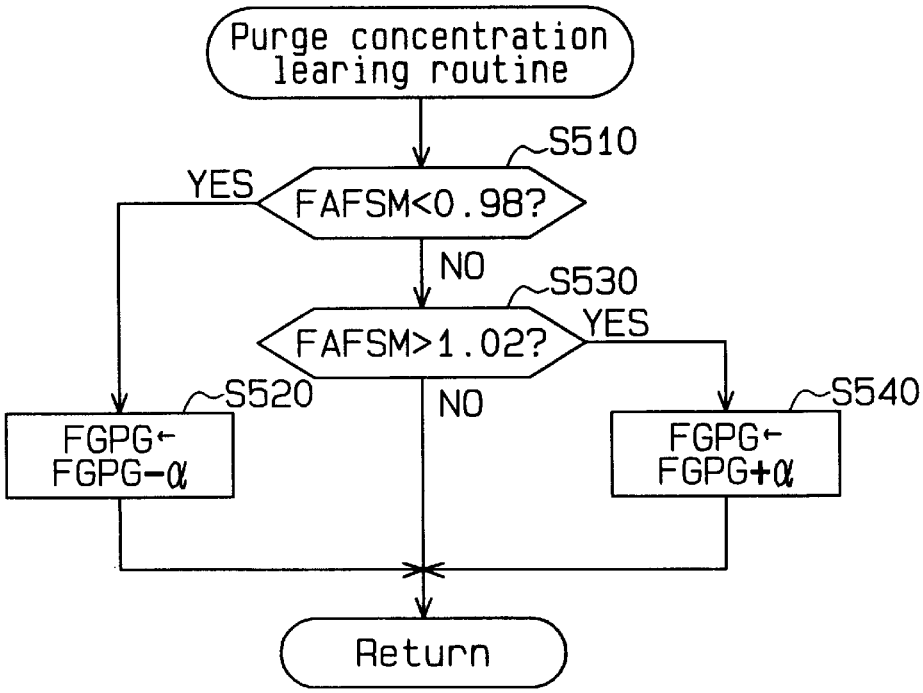
FIG. 14 is a flowchart illustrating a purge-concentration learning routine.
Figure 16:
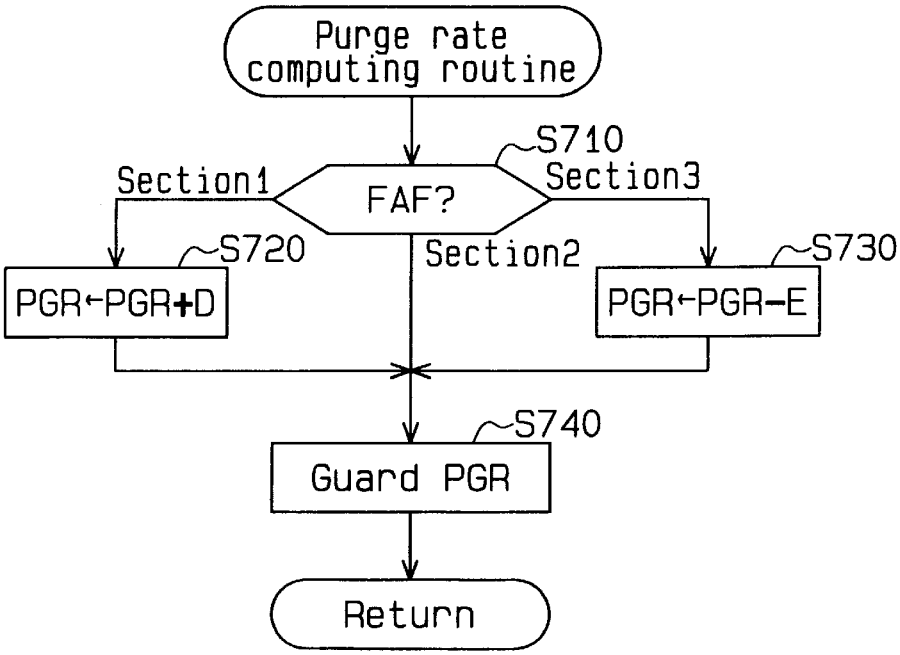
FIG. 16 is a flowchart illustrating a purge-rate computing routine.

In the next step S920, the ECU 34 computes a purge compensation coefficient FPG according to an equation 7 based on the purge-concentration learned value FGPG learned in the purge-concentration learning routine illustrated in FIG. 14 and the purge rate PGR determined in the purge-rate computing routine illustrated in FIG. 16.

$$FPG-FGPG\times PGR \quad (7)$$

Figure 13:
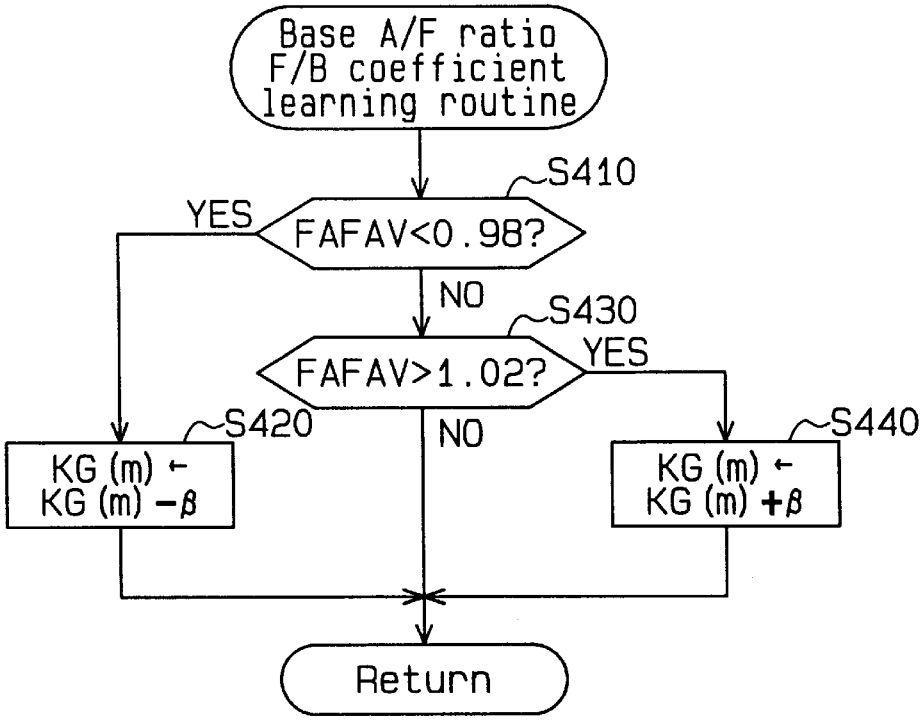
FIG. 13 is a flowchart illustrating a base air fuel ratio feedback coefficient learning routine.

In step S930, the ECU 34 computes a fuel-injection-valve open time TAU according to an equation 8 based on the air-fuel ratio feedback coefficient FAF computed in the air-fuel-ratio control routine illustrated in FIG. 2, the base air-fuel ratio feedback coefficient KG(m) computed in the base air-fuel-ratio-feedback-coefficient learning routine illustrated in FIG. 13 and the purge compensation coefficient FPG acquired in step S920.

$$TAU\leftarrow k3\cdot TP\cdot\{FAF+KG(m)+FPG\}+k4 \quad (8)$$

where k3 and k4 are compensation coefficients including a warm-up increment and a start-up increment.

The ECU 34 outputs the fuel-injection-valve open time TAU in step S940 and temporarily terminates the routine.

Figure 7:
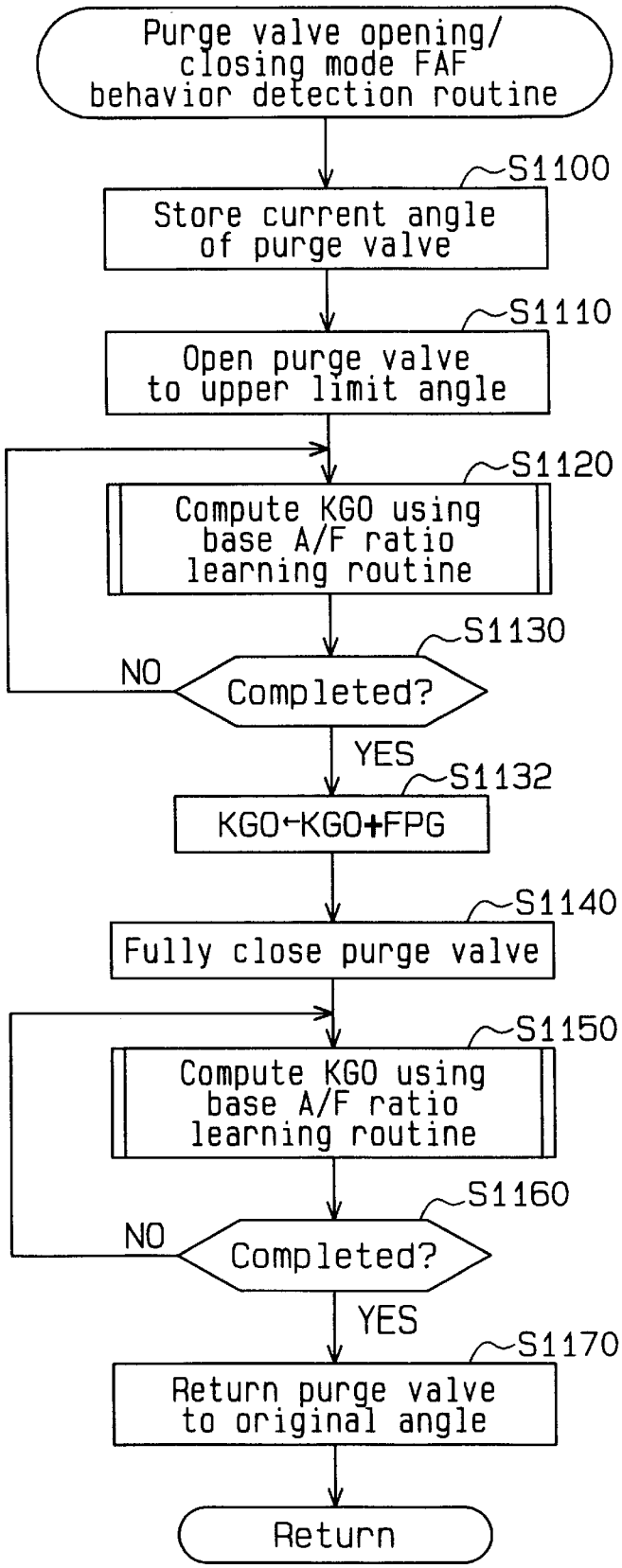
FIG. 7 is a flowchart illustrating a routine for detecting the behaviors of the air-fuel ratio feedback coefficient at the time of opening or closing a purge valve.

In the first embodiment, the vapor pipe 24, the canister 26, the purge pipe 28 and the purge valve 30 are the purge means. The air-fuel-ratio control routine in FIG. 2 illustrates the operation of the air-fuel-ratio feedback control means. The purge-concentration learning routine in FIG. 14 illustrates the operation of the concentration learning means. The base air fuel ratio feedback coefficient learning routine in FIG. 13 illustrates the operation of the base air fuel ratio feedback coefficient learning means. The fuel injection routine in FIG. 20 illustrates the operation of the fuel-injection-amount control means. The vapor amount estimating routine in FIG. 8 illustrates the operation of the fuel-vapor-amount estimating means. The purge-valve-opening/closing-mode FAF-behavior detecting routine in FIG. 7 illustrates the operation of the air-fuel-ratio-feedback-coefficient behavior detection means. Steps S1010 and S1060 illustrate the operation of the learning control means.

The first embodiment has the following effects.

(1) The vapor amount estimating routine in FIG. 8 estimates the amount of fuel vapor present in the fuel tank 18 based on the balance between the amount of fuel vapor produced in the fuel tank 18 and the purge amount of fuel vapor, not from the value of the air-fuel ratio feedback coefficient FAF or the tendency for the coefficient FAF to a change. The concentration of fuel vapor to be purged is estimated from the estimated vapor amount in the fuel tank. When the amount of fuel vapor present in the fuel tank 18 is estimated to be small in step S1010 in the learning permission determining routine, it can be determined that the concentration of the fuel vapor flowing out of the fuel tank 18 is lean, and learning of the base air-fuel ratio feedback coefficient KG(m) is permitted. When the amount of fuel vapor present in the fuel tank 18 is small, the purge-concentration learning routine can be inhibited.

When the amount of fuel vapor present in the fuel tank 18 is estimated as large, on the other hand, the concentration of the fuel vapor flowing out of the fuel tank 18 is possibly rich, so that learning of the base air-fuel ratio feedback coefficient KG(m) can be inhibited and the purge-concentration learning routine can be permitted.

As a result, the base air-fuel ratio feedback coefficient KG(m) can be learned again when it is appropriate, and if the base air-fuel ratio feedback coefficient KG(m) has been learned inaccurately, it can be returned to an adequate value. Since the base air-fuel ratio feedback coefficient KG(m) is maintained at a correct value, the concentration of fuel vapor in the purge-concentration learning routine is learned correctly.

(2) In the purge-valve-opening/closing-mode FAF-behavior detecting routine of FIG. 7, the behavior of the air-fuel ratio feedback coefficient FAF is detected in both the open state and closed state of the purge valve 30. By comparing the behavior of the coefficient FAF in those two states, the concentration of fuel vapor to be purged is determined. When the concentration of fuel vapor to be purged is lean, the level of the air-fuel ratio feedback coefficient FAF obtained when the purge valve 30 is open is the same as or slightly higher than the level of the air-fuel ratio feedback coefficient FAF when the purge valve 30 is closed. When the concentration of fuel vapor to be purged is rich, on the other hand, the level of the air-fuel ratio feedback coefficient FAF obtained when the purge valve 30 is open is lower than the level of the air-fuel ratio feedback coefficient FAF when the purge valve 30 is closed.

In the purge-valve-opening/closing-mode FAF-behavior detecting routine, therefore, one of conditions for permitting learning of the base air-fuel ratio feedback coefficient KG(m) and for inhibiting learning of the concentration of the fuel vapor is that the concentration of fuel vapor to be purged is determined to be lean based on the behavior of the coefficient FAF in the open states and closed state of the purge valve 30. Further, when it is determined that the concentration of fuel vapor to be purged is not lean, learning of the base air-fuel ratio feedback coefficient KG(m) is inhibited and execution of the purge-concentration learning routine is permitted.

As apparent from the above, the concentration of fuel vapor to be purged can be accurately determined by opening and closing the purge valve 30 to switch the purge system between a purge state and a non-purging state. When the concentration of fuel vapor to be purged is lean or fuel vapor is hardly present, the base air-fuel ratio feedback coefficient KG(m) is learned again.

Because the base air-fuel ratio feedback coefficient KG(m) can be learned again when the concentration of fuel vapor to be purged is lean, or fuel vapor is hardly present, if the base air-fuel ratio feedback coefficient KG(m) has been learned inaccurately, it can be changed to an appropriate value. Since the base air-fuel ratio feedback coefficient KG(m) is maintained at a correct value, the concentration of fuel vapor to be purged in the purge-concentration learning routine is learned correctly.

(3) When the purge-valve-opening/closing-mode FAF-behavior detecting routine of FIG. 7 is performed, a period occurs where the purge valve is closed. In this period, however, the level of the air-fuel ratio feedback coefficient is merely detected, unlike the prior art, where the base air-fuel ratio feedback coefficient is learned in this period. That is, the closed state of the purge valve can be short. The purge amount does not therefore drop significantly.

Figure 5:
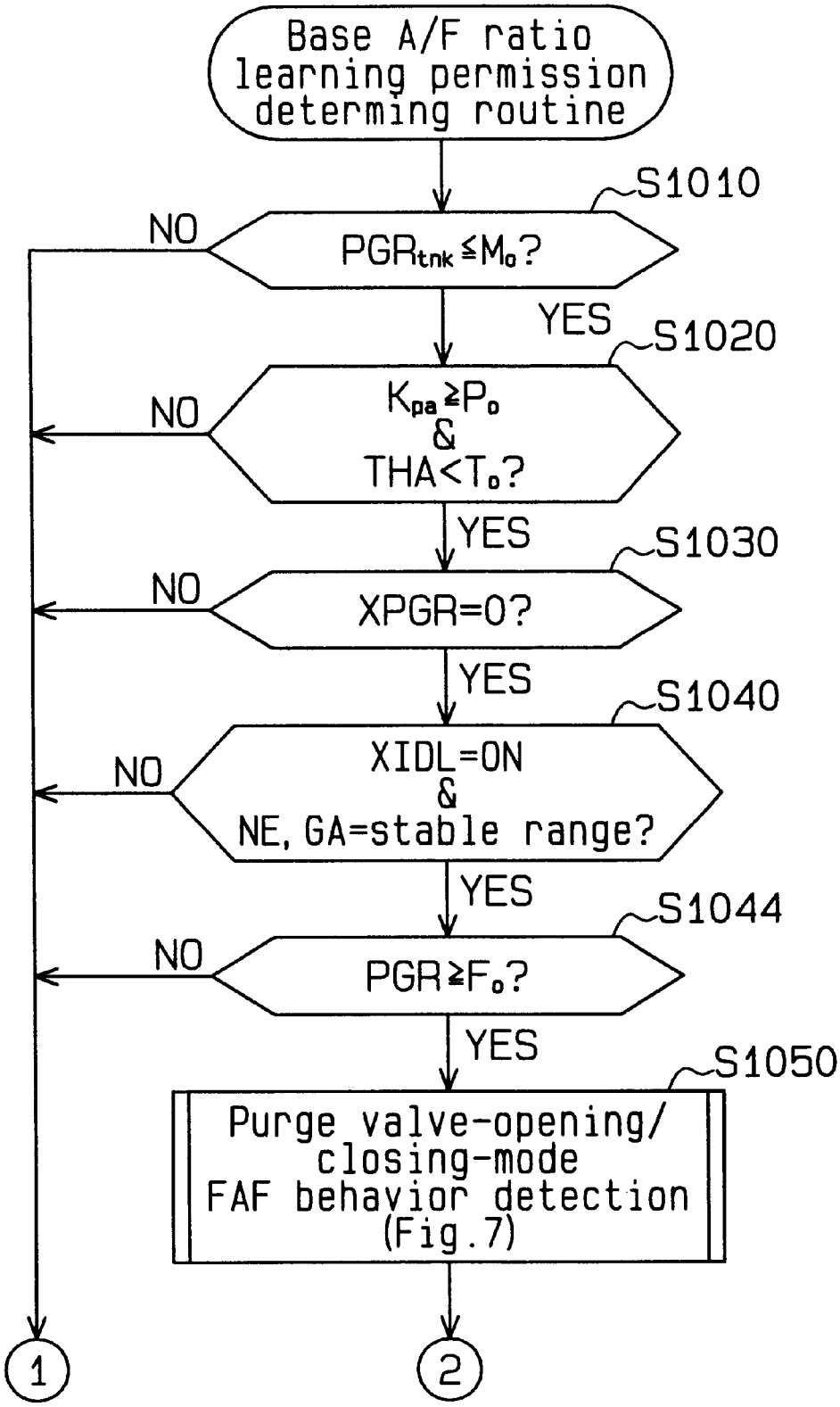
FIG. 5 is a flowchart illustrating a learning permission determining routine.

(4) Since learning of the base air-fuel ratio feedback coefficient KG(m) is permitted only through the decision process in steps S1020–S1044 in FIG. 5, relearning of the base air-fuel ratio feedback coefficient KG(m) is carried out more reliably when the concentration of fuel vapor to be purged is lean or fuel vapor is hardly present.)

(5) The decision regarding the estimated amount of fuel vapor present $PGR_{tnk}$ in step S1010 is made first, and when the estimated amount of fuel vapor present $PGR_{tnk}$ is less than the reference value $M_o$, the purge-valve-opening-closing-mode FAF-behavior detecting routine in step S1050 is activated to determine the two behaviors. Even when there is a period when the purge valve 30 is closed, therefore, purging opportunities are not significantly lost.

(6) The intake air temperature THA is used to acquire the estimated produced vapor amount $t_PGR_b$ in step S1220. Since the intake air temperature THA indicates a value according to the fuel temperature in the fuel tank 18, it is possible to acquire an estimated produced vapor amount $t_PGR_b$ that reflects the pressure of the fuel vapor in the fuel tank 18. When the intake air temperature sensor is used in the air-intake passage 8 for fuel injection control or the like, a temperature sensor need not be provided in the fuel tank 18. In this case, the manufacturing cost for the air-fuel ratio control apparatus is reduced.

(7) Further, the estimated produced vapor amount $t_PGR_b$ in the fuel tank 18 is obtained according to the speed change $|\Delta SPD|$. Since the engine 2 is mounted in a vehicle, a change in the speed of this vehicle, $|\Delta SPD|$, causes movement of the fuel in the fuel tank 18 and causes waves in the fuel. The greater the amount of waves, the fuel vapor is produced. It is therefore possible to more precisely acquire the estimated produced vapor amount $t_PGR_b$ by obtaining the estimated produced vapor amount $t_PGR_b$ according to fuel temperature in the fuel tank 18 (actually the intake air temperature THA) and the speed change $|\Delta SPD|$.

(8) In addition to the fuel temperature in the fuel tank 18 and the speed change, the atmospheric pressure Kpa is also considered in obtaining the estimated produced vapor amount $t_PGR_b$. When the atmospheric pressure $K_{pa}$ is low, the generation of fuel vapor is increased. It is thus possible to more precisely acquire the estimated produced vapor amount $t_PGR_b$.

(9) The purge-valve-opening/closing-mode FAF-behavior detecting routine in FIG. 7 checks the behavior of the air-fuel ratio feedback coefficient FAF using the base air fuel ratio feedback coefficient learning routine in FIG. 13.

This eliminates the need for a special routine for checking the behavior of the air-fuel ratio feedback coefficient FAF.

It is thus possible to reduce the capacity of the memory to be installed in the ECU 34.

Second Embodiment

Figure 21:
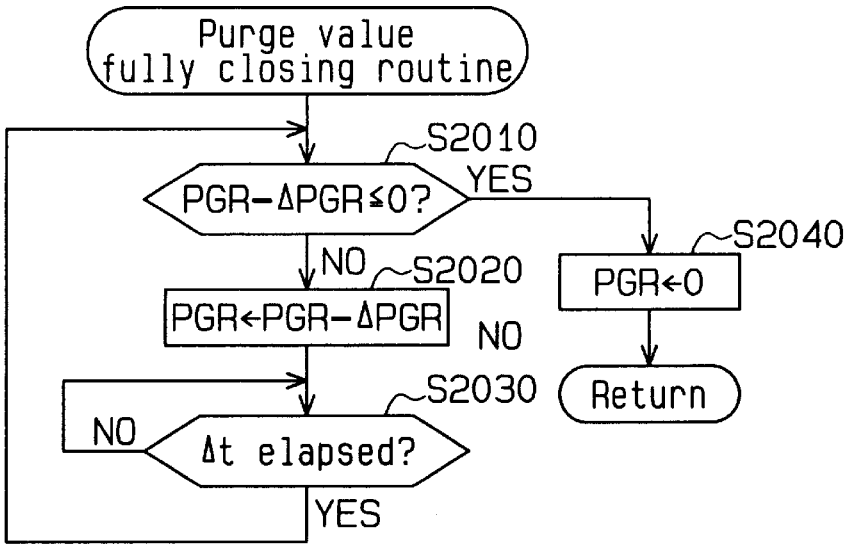
FIG. 21 is a flowchart illustrating a purge-valve fully closing routine according to a second embodiment.

A description of the second embodiment follows, focusing on differences from the first embodiment. In the second embodiment, a purge-valve fully closing routine illustrated in a flowchart in FIG. 21 is executed instead of step S1140 in the purge-valve-opening/closing-mode FAF-behavior detecting routine in FIG. 7. The remaining structure is substantially the same as that of the first embodiment.

In the purge-valve fully closing routine in FIG. 21, the ECU 34 subtracts a purge rate decrement ΔPGR, previously set for gradual reduction, from the current purge rate PGR and determines whether the subtracted value is equal to or smaller than zero in step S2010. When PGR−ΔPGR>0, the ECU 34 selects NO in step S2010 and proceeds to step S2020. In step S2020, the ECU 34 sets the subtracted value (PGR−ΔPGR) as the purge rate PGR.

In the next step S2030, the ECU 34 determines whether a time Δt has elapsed since the completion of the process of step S2020. When the time Δt has not elapsed, the ECU 34 selects NO in step S2030 and repeats the decision process of step S2030 until the time Δt passes.

When the time At elapses, the ECU 34 selects YES in step S2030 and determines again if PGR−ΔPGR≦0 in step S2010. As long as PGR−ΔPGR>0, NO is selected in step S2010 and steps S2020 and S2030 are repeated. As a result, the purge rate PGR becomes gradually smaller at the rate of ΔPGR/Δt. Given that the maximum value of the purge rate PGR is 5%, −0.5% per second is set as the purge rate reducing speed ΔPGR/Δt. The purge rate PGR is subjected to duty control in the purge-valve driving routine illustrated in FIG. 18, which determines the angle of the purge valve 30.

When PGR−ΔPGR≦0, the ECU 34 sets the purge rate PGR to zero in step S2040 and terminates the routine. After the purge valve 30 is fully closed in this manner, the process returns to step S1150 shown in FIG. 7.

Figure 22:
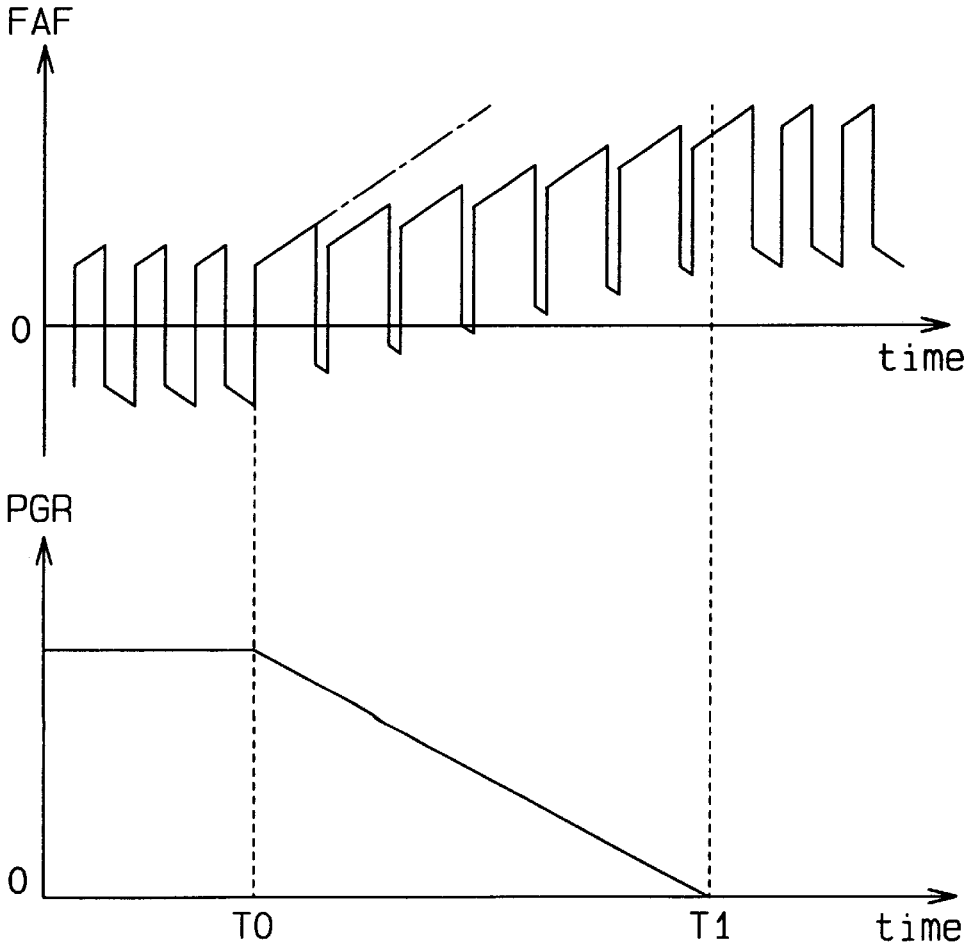
FIG. 22 is a timing chart showing the behaviors of a purge rate PGR and air-fuel ratio feedback coefficient FAF according to the second embodiment.

Referring to FIG. 22, a description follows of how the purge rate PGR and the air-fuel ratio feedback coefficient FAF change in the period during which the routine in FIG. 21 is being performed. At the beginning point in FIG. 22, the base air-fuel ratio feedback coefficient KG has been underestimated.

The purge-valve fully closing routine gradually closes the purge valve 30 from time $T_0$, and the purge valve is fully closed at time T1. It is apparent that steering the air-fuel ratio to a target air-fuel ratio is being attempted in the period of $T_0$–T1 by changing (slightly increasing trendwise) the air-fuel ratio feedback coefficient FAF as indicated by the solid line. In the period of $T_0$–T1, the rich skip process for the air-fuel ratio feedback coefficient FAF shown in step S122 in the air-fuel-ratio control routine of FIG. 2 and the lean skip process in step S112 are repeatedly executed, thus changing the value of the air-fuel ratio feedback coefficient FAF. Thus, even while the purge valve 30 is gradually closed, the air-fuel ratio can be kept at the target air-fuel ratio.

The long and short dashed line in FIG. 22 indicates the behavior of the air-fuel ratio feedback coefficient FAF when the purge valve 30 is fully closed immediately. In this case, since the rich skip process for the air-fuel ratio feedback coefficient FAF is not executed for some time after time $T_0$, the air-fuel ratio feedback coefficient FAF continues increasing, making the air-fuel ratio excessively lean.

The second embodiment has the following effect in addition to the effects (1) to (9) of the first embodiment.

(10) The purge-valve-opening/closing-mode FAF-behavior detecting routine allows the purge valve 30 to gradually close. Even if the learned value has erroneously been set, therefore, the air-fuel-ratio control routine increases the air-fuel ratio feedback coefficient FAF. This makes it possible to cope with a change in air-fuel ratio. The air-fuel ratio is therefore kept at an appropriate value as shown in FIG. 22. The engine speed stabilizes even when the purge-valve-opening/closing-mode FAF-behavior detecting routine is executed.

Third Embodiment

A description of the third embodiment follows, focusing on the differences from the first embodiment. In the third embodiment, a purge-valve fully closing routine illustrated in the flowchart in FIG. 23 and an interruption routine illustrated in the flowchart in FIG. 24 are executed instead of step S1140 in the purge-valve-opening/closing-mode FAF-behavior detecting routine in FIG. 7. Otherwise, the third embodiment is substantially the same as the first embodiment.

Figure 23:
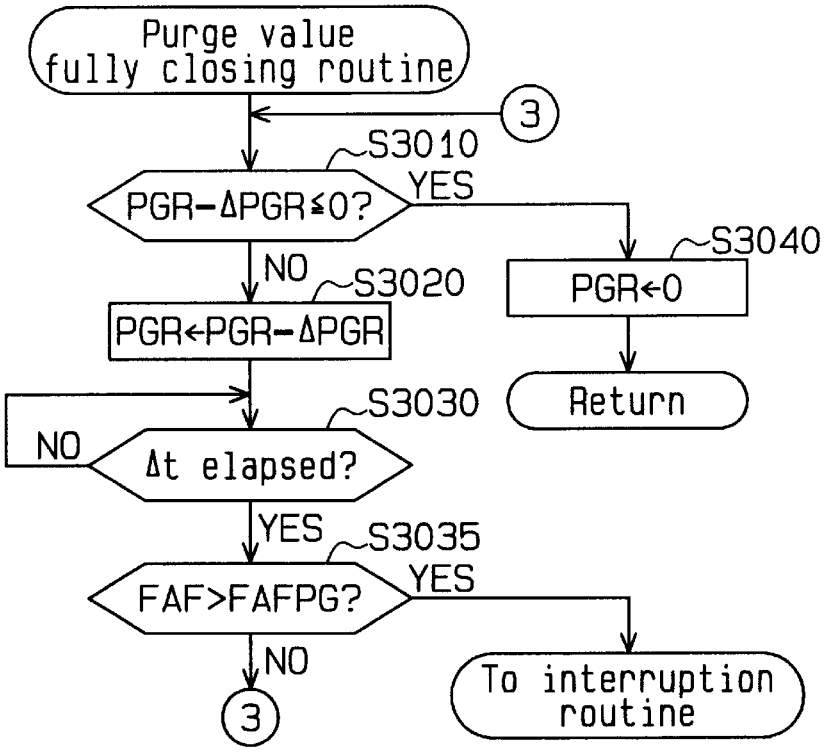
FIG. 23 is a flowchart illustrating a purge-valve fully closing routine according to a third embodiment.
Figure 24:
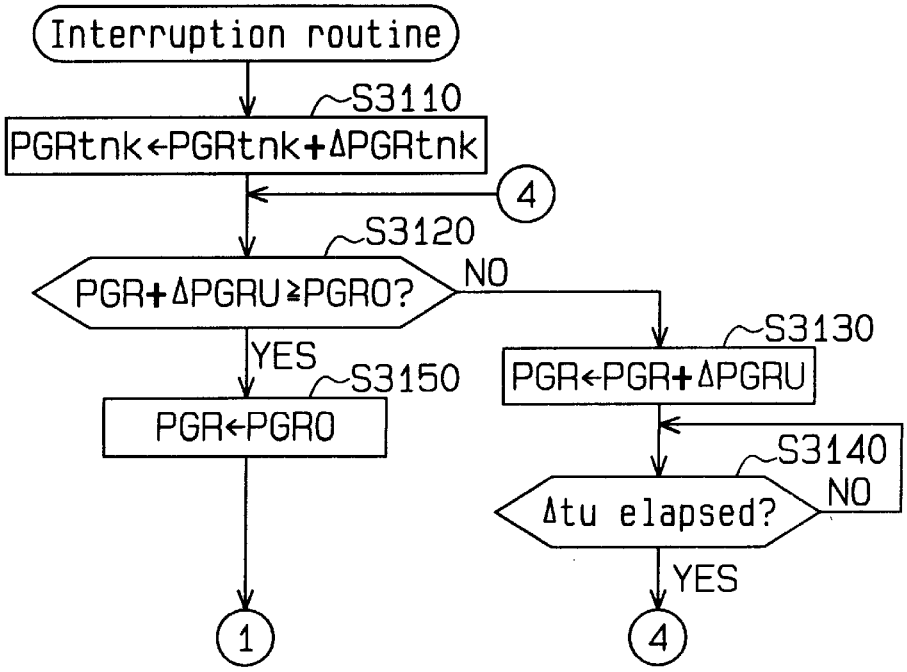
FIG. 24 is a flowchart illustrating an interruption routine according to the third embodiment.

In the purge-valve fully closing routine in FIG. 23, first, the ECU 34 determines whether a value obtained by subtracting the purge rate decrement ΔPGR, set for gradual reduction, from the current purge rate PGR is equal to or smaller than zero (step S3010). When PGR−ΔPGR>0 (NO in step S3010), this value (PGR−ΔPGR) is set as the purge rate PGR (step S3020). Next it is determined whether the time Δt has elapsed since the execution of step S3020 (step S3030). When the time Δt has not elapsed (NO in step S3030), the decision process of step S3030 is repeated until the time At passes. The process up to this point is the same as that in the second embodiment.

When the time Δt elapses (YES in step S3030), it is determined whether the air-fuel ratio feedback coefficient FAF is greater than a rich decision value FAFPG (step S3035). The rich decision value FAFPG is used to determine whether an increase in the air-fuel ratio feedback coefficient FAF is continuing due to erroneous learning at the time of gradually closing the purge valve 30. That is, it is determined in step S3035 whether it is difficult to maintain the appropriateness of the air-fuel ratio using the increase in the air-fuel ratio feedback coefficient FAF computed in the air-fuel-ratio control routine (FIG. 2).

When FAF≦FAFPG (NO in step S3035), it is determined again whether PGR−ΔPGR≦0 (step S3010). As long as PGR−ΔPGR>0 (NO in step S3010) and FA≦FAFPG (NO in step S3035), steps S3020 and S3030 are repeated so the purge rate PGR gradually decreases at the rate of ΔPGR/Δt. This purge-rate reducing rate ΔPGR/Δt is the same as explained in the description of the second embodiment. The purge rate PGR is then subjected to duty control in the purge-valve driving routine (FIG. 18), which determines the angle of the purge valve 30.

When PGR−ΔPGR≦0 (YES in step S3010), the purge rate PGR is set to zero (step S3040), and the purge-valve fully closing routine is terminated. Since the purge valve 30 is fully closed in this manner, the process goes to step S1150 (FIG. 7).

Figure 25:
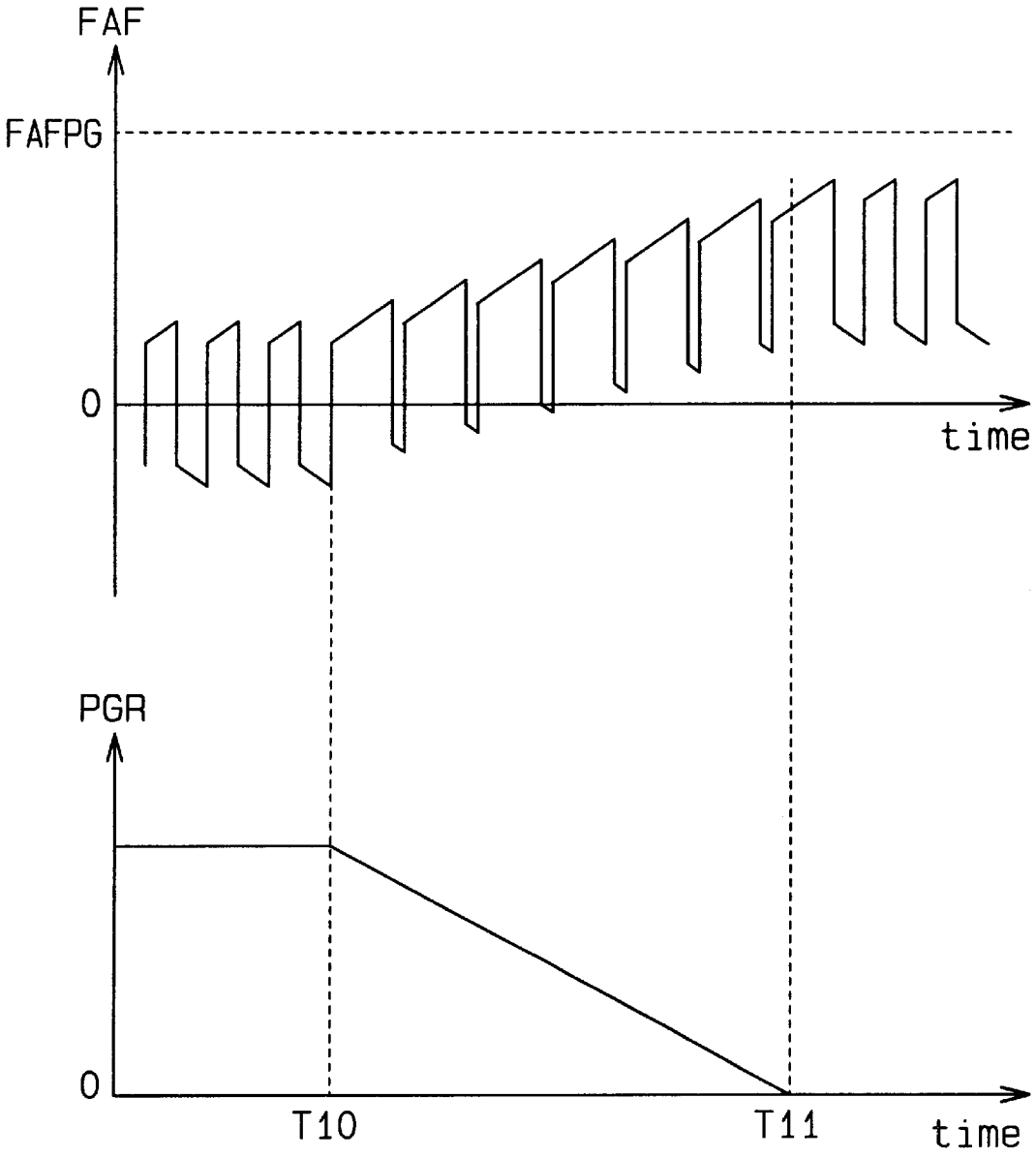
FIG. 25 is a timing chart showing the behaviors of the purge rate PER and air-fuel ratio feedback coefficient FAF according to the control of the third embodiment.

FIG. 25 shows the behaviors of the purge rate PGR and the air-fuel ratio feedback coefficient FAF during the above period. FIG. 25 shows a change in the air-fuel ratio feedback coefficient FAF when the purge valve 30 is fully closed with the base air-fuel ratio feedback coefficient KG having been underestimated. Referring to FIG. 25, the purge-valve fully closing routine starts to gradually close the purge valve 30 from time T10, and the purge valve 30 is fully closed at time T11. It is apparent that steering the air-fuel ratio to the target air-fuel ratio is attempted during this period by changing (slightly increasing trendwise) the air-fuel ratio feedback coefficient FAF as indicated by the solid line. In the period of T10 T11, the rich skip process and the lean skip process, which are repeatedly executed, frequently correct the air-fuel ratio feedback coefficient FAF. As a result, the air-fuel ratio is corrected to approach the target air-fuel ratio even while the purge valve 30 is being gradually closed.

Let us consider a case where the base air-fuel ratio feedback coefficient KG is learned to be a further underestimated value. In this case, even if the purge valve 30 is gradually closed, the air-fuel ratio becomes much more lean.

It is therefore unlikely that the air-fuel ratio will remain at an appropriate level with the air-fuel ratio feedback coefficient FAF computed in the air-fuel-ratio control routine (FIG. 2).

Under such a situation, the air-fuel-ratio control routine (FIG. 2) keeps executing the processes of steps S100, S102, S104, S106, S108 and S110 so that the air-fuel ratio feedback coefficient FAF continuously increases.

While steps S3010–S3035 in the purge-valve fully closing routine (FIG. 23) are repeated to gradually close the purge valve 30, the inequality FAF>FAFPG will eventually be satisfied (YES in step S3035). In this case, a routine to interrupt the purge-valve-opening/closing-mode FAF-behavior detecting routine is executed.

The interruption routine is illustrated in the flowchart in FIG. 24. In the first step S3110, the ECU 34 adds a specified increment $\Delta PGR_{tnk}$ to the estimated amount of fuel vapor present $PGR_{tnk}$, which was discussed in the description of the first embodiment. The reason for increasing the estimated amount of fuel vapor present $PGR_{tnk}$ is that the concentration of the fuel vapor in the gas to be actually purged can be predicted to be richer than that indicated by the estimated amount of fuel vapor present $PGR_{tnk}$ computed in the vapor amount estimating routine.

Next, a purge rate increment ΔPGRU, previously set for gradual increase, is added to the current purge rate PGR, and it is then determined whether the resultant value is equal to or greater than the angle PGRO of the purge valve 30 stored in step S1100 (FIG. 7) (step S3120). When PGR+ΔPGRU<PGRO (NO in step S3120), this value (PGR+ΔPGRU) is set as the purge rate PGR (step S3130). Next it is determined whether the time Δtu has elapsed since the execution of step S3130 (step S3140). When the time Δtu has not elapsed (NO in step S3140), the decision process of step S3140 is repeated until the time Δtu has passed.

When the time Δtu elapses (YES in step S3140), it is determined again whether PGR+ΔPGRU≧PGRO (step S3120). As long as PGR+ΔPGRU<PGRO (NO in step S3120), steps S3130 and S3140 are repeated so that the purge rate PGR gradually increases at the rate of ΔPGRU/Δtu. This purge-rate increasing rate ΔPGRU/Δtu may be the same as or different from the purge-rate reducing rate ΔPGR/Δt. The purge rate PGR, which is increased in this manner, is then subjected to duty control in the purge-valve driving routine (FIG. 18), which determines the angle of the purge valve 30.

When PGR+ΔPGRU≧PGRO (YES in step S3120), the angle PGRO is set as the purge rate PGR (step S3150), and the purge valve 30 returns to that angle immediately before the purge-valve fully closing routine is initiated. Then, the process moves to step S1090 (FIG. 6).

When the interruption routine is entered, step S1150 (FIG. 7) is not executed so that the behavior detection value KGC in non-purge mode with the purge valve 30 fully closed is not acquired, and step S1060 (FIG. 6) is also not performed so that the behavior detection value in purge mode KGO is not compared with the behavior detection value KGC in non-purge mode. That is, setting the permission flag XPGR for the base air-fuel ratio feedback coefficient (step S1070 in FIG. 6) by the purge-valve-opening/closing-mode FAF-behavior detecting routine is not carried out. However, the estimated amount of fuel vapor present $PGR_{tnk}$ is incremented in the process of step S3110. At the end of the interruption routine, therefore, the process moves to step S1090 to determine the size of the estimated amount of fuel vapor present $PGR_{tnk}$. When the estimated amount of fuel vapor present $PGR_{tnk}$ is greater than a reference value Q for determining whether the concentration is rich (YES in step S1090), the process of resetting the permission flag XPGR is performed (step S1094).

Figure 26:
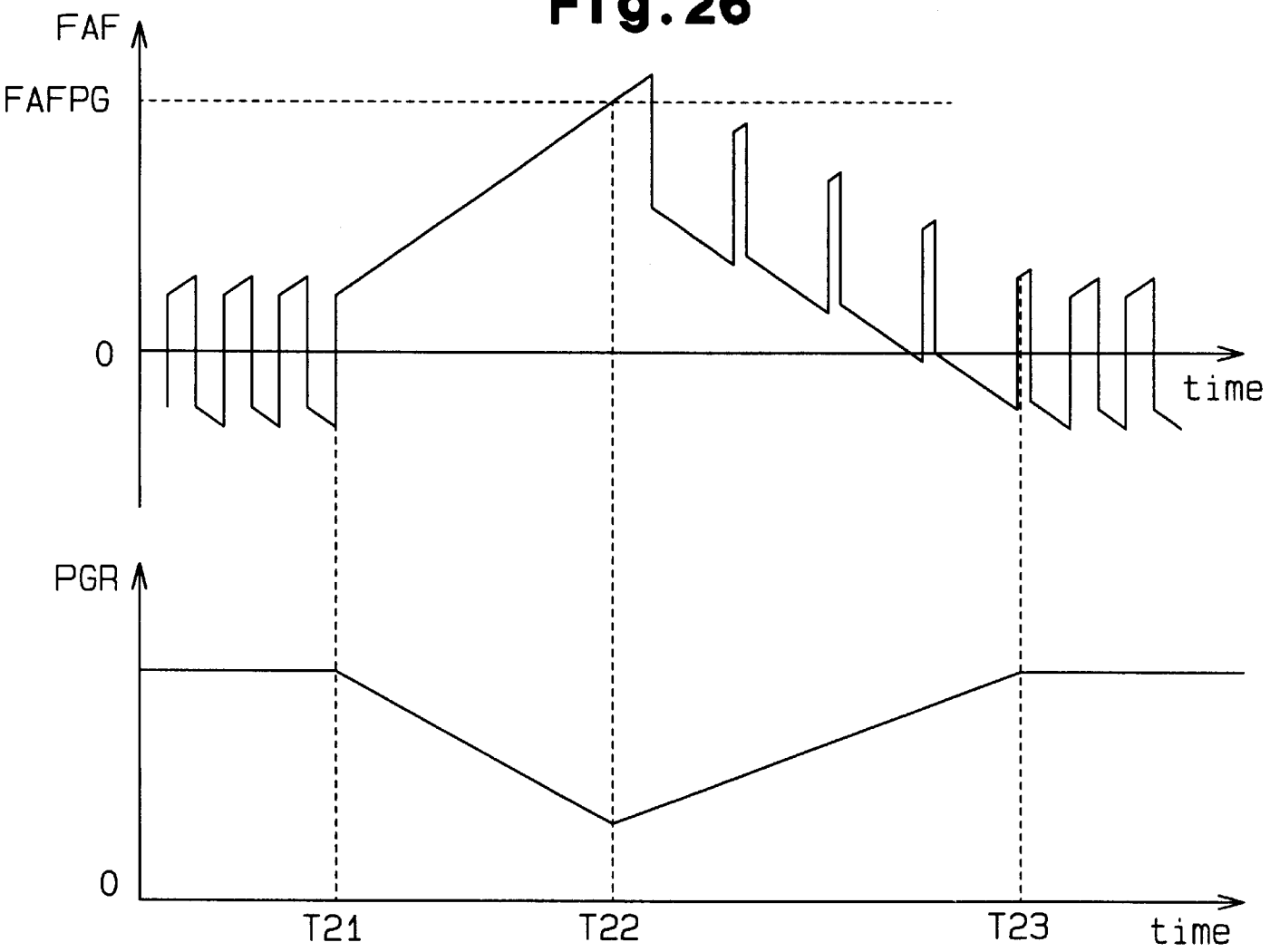
FIG. 26 is a timing chart showing the behaviors of the purge rate PER and air-fuel ratio feedback coefficient FAF according to the control of the third embodiment.

The discussion of the behaviors of the purge rate PGR and the air-fuel ratio feedback coefficient FAF follows referring to FIG. 26. At time T21, the purge valve 30 is gradually closed by the purge-valve fully closing routine. As the purge valve 30 is closed, the air-fuel ratio rapidly becomes more lean due to the inaccurate learning of the base air-fuel ratio feedback coefficient KG. The air-fuel ratio feedback coefficient FAF thus keeps increasing.

At time T22, the air-fuel ratio feedback coefficient FAF exceeds the richness decision value FAFPG (YES in step S3035). Consequently, the interruption routine is initiated so that the purge rate PGR increases from time T22 and returns to the original state at time T23.

While the purge rate PGR is decreasing, therefore, the air-fuel ratio feedback coefficient FAF, which has continued to increase, decreases according to the rise in the purge rate PGR and returns to the original level. At the time the air-fuel ratio feedback coefficient FAF decreases, the rich skip and lean skip are repeated, which indicates that the air-fuel ratio can be maintained at the target air-fuel ratio.

In the third embodiment, the purge-valve-opening/closing-mode FAF-behavior detecting routine in FIG. 7 and the interruption routine in FIG. 24 correspond to the operation of the air-fuel-ratio-feedback-coefficient behavior detection means.

The third embodiment has the following effects in addition to those of the second embodiment.

(11) In the process of closing the purge valve 30 (step S1140) by the purge-valve-opening/closing-mode FAF-behavior detecting routine (1050 in FIG. 5 and FIG. 7), the situation where the air-fuel ratio feedback coefficient FAF continues to increase is determined based on the richness decision value FAFPG (step S3035). When it is determined that the air-fuel ratio feedback coefficient FAF is continuing to increase (YES in step S3035), it is very likely that, because of the erroneous setting of the learned value, the air-fuel ratio will not be appropriately maintained by increasing the air-fuel ratio feedback coefficient FAF.

According to the third embodiment, therefore, when the decision in step S3035 is YES, closing of the purge valve 30 is stopped and an operation to open the purge valve 30 is started. Also, detection of the behavior of the air-fuel ratio feedback coefficient FAF with the purge valve 30 closed is interrupted. This can prevent an overly lean state from continuing, thus keeping the rotation of the engine 2 stable.

(12) When executing the interruption routine, the estimated amount of fuel vapor present $PGR_{tnk}$ is corrected (step S3110). That is, correction of the estimated amount of fuel vapor present $PGR_{tnk}$ is carried out in addition to the process of setting the angle of the purge valve 30 back and interrupting the detection of the behavior of the air-fuel ratio feedback coefficient FAF. This allows the estimated amount of fuel vapor present $PGR_{tnk}$ to be properly set, thus making the subsequent decision on the estimated amount of fuel vapor present $PGR_{tnk}$ (steps S1010, S1090 and S1250) more accurate.

Fourth Embodiment

Figure 27:
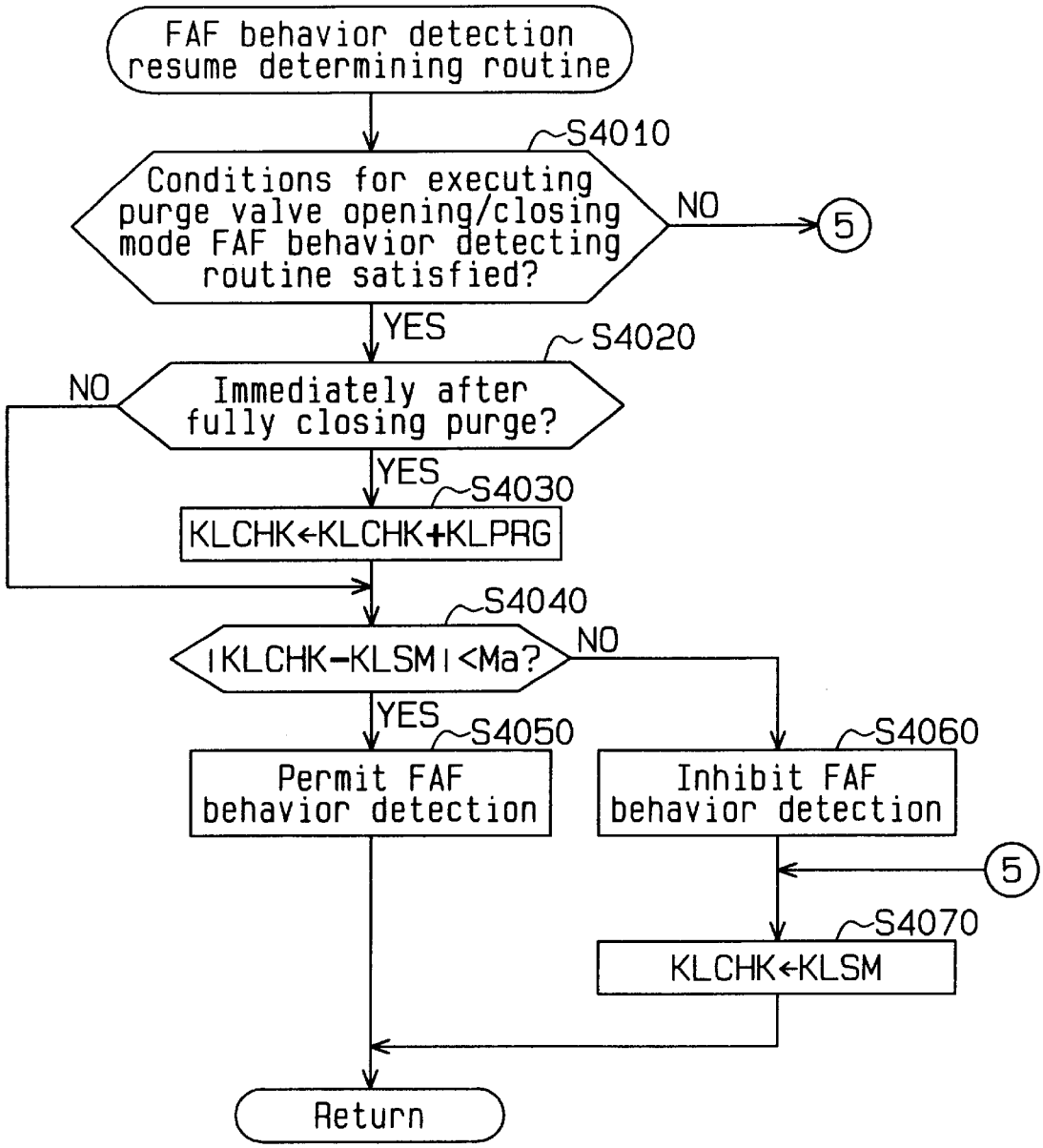
FIG. 27 is a flowchart illustrating an FAF-behavior-detection resume determining routine according to a fourth embodiment.
Figure 28:
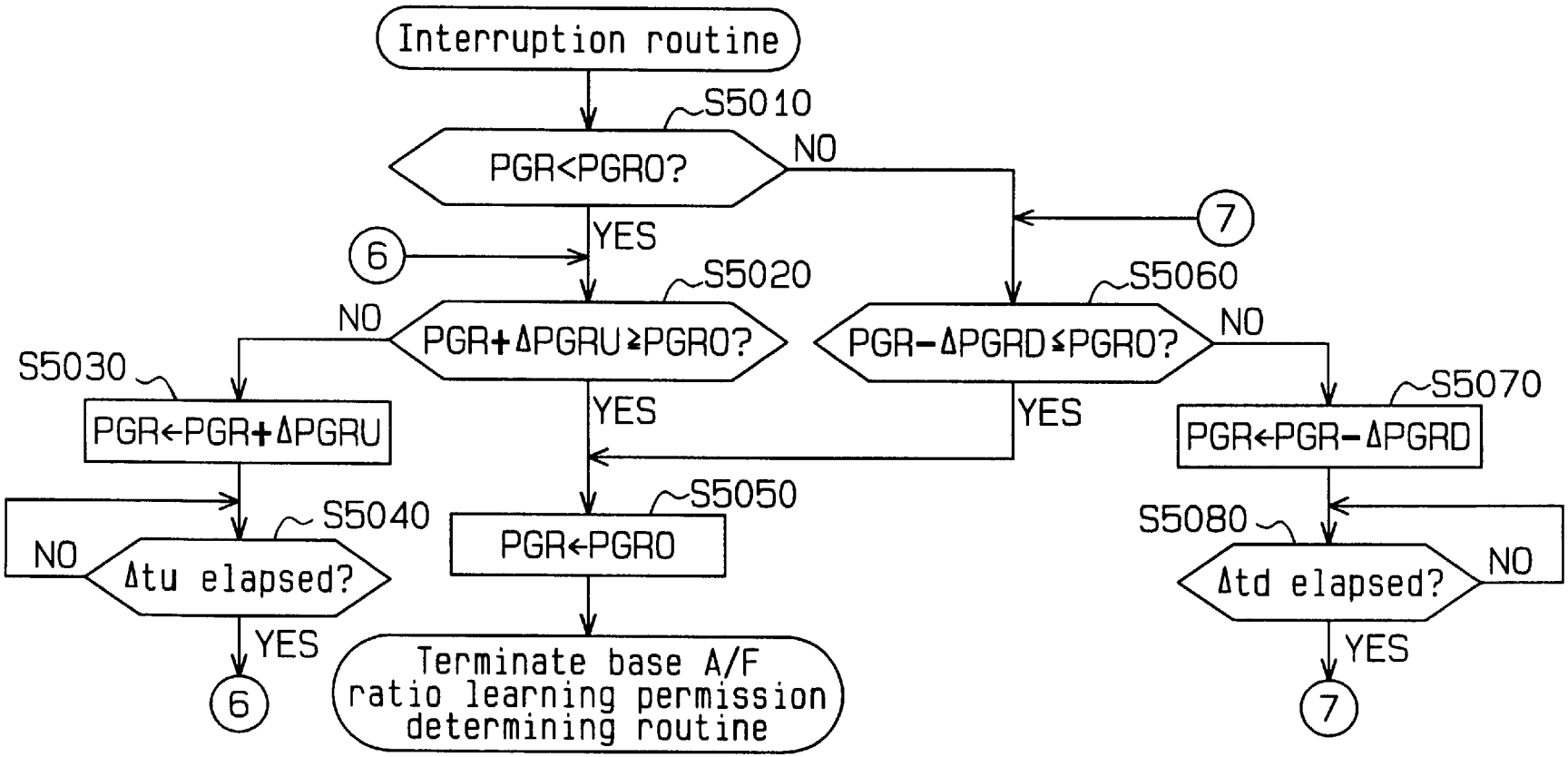
FIG. 28 is a flowchart illustrating an interruption routine according to the fourth embodiment.

A description of a fourth embodiment follows, focusing on the differences from the first embodiment. In the fourth embodiment, an FAF-behavior-detection resume determining routine illustrated in FIG. 27 is repeatedly executed at every given cycle. When inhibition of FAF behavior detection is set in the FAF-behavior-detection resume determining routine in FIG. 27 in the purge-valve-opening/closing-mode FAF-behavior detecting routine in FIG. 7, the process is immediately stopped and an interruption routine shown in FIG. 28 is executed. In the last step of this interruption routine, the learning permission determining routine shown in FIGS. 5 and 6 is terminated. Otherwise, the fourth embodiment is substantially the same as the first embodiment.

Figure 29:
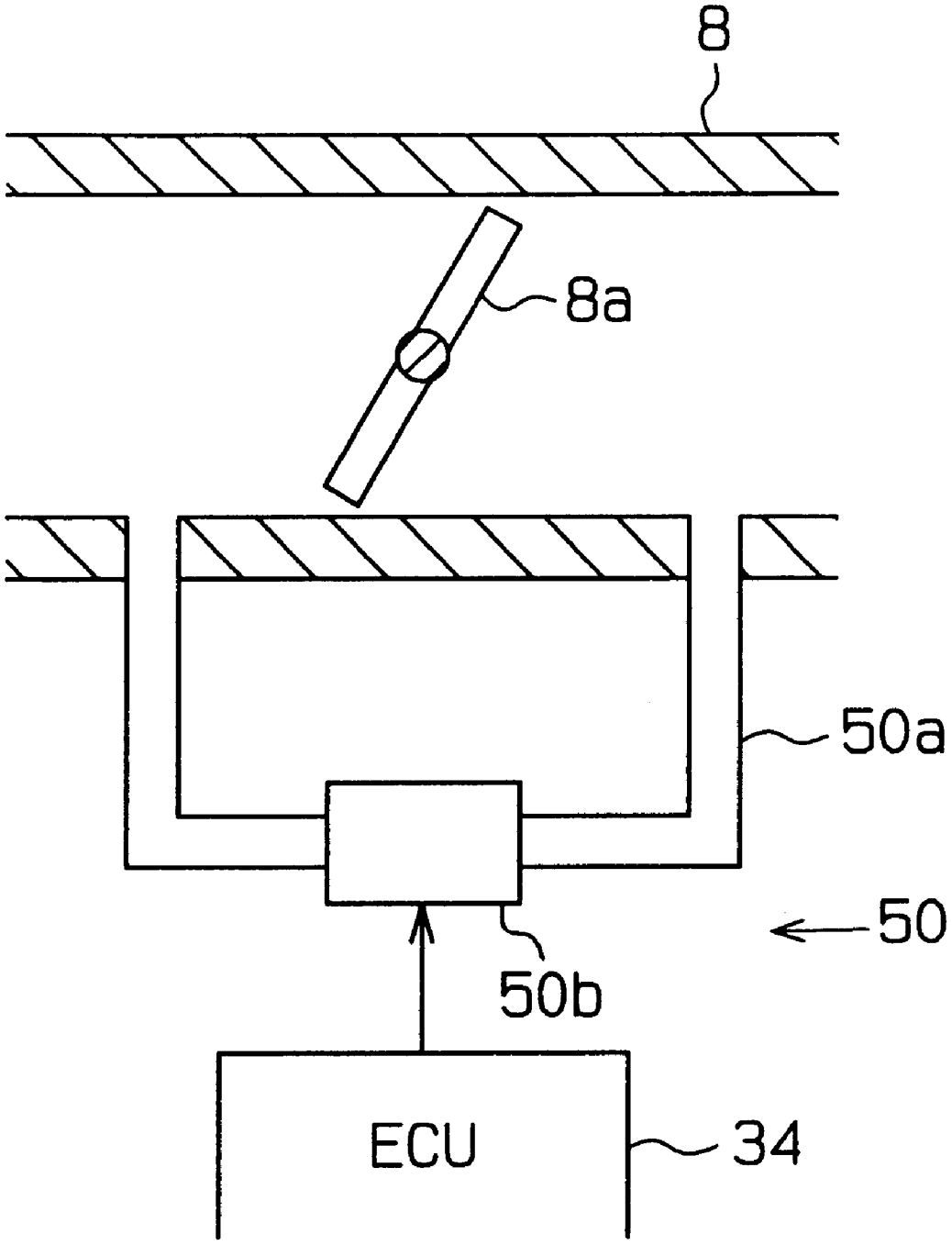
FIG. 29 is a diagram depicting an INC system according to the fourth embodiment.

An ISC (Idle speed Control) system 50 shown in FIG. 29 is provided in the air-intake passage 8 in the fourth embodiment. The ISC system 50 has an air-intake bypass passage 50*a* for bypassing the throttle valve 8*a*, and an ISCV (Idle speed Control Valve) 50*b* provided in the air-intake bypass passage 50*a*. The angle of the ISCV 50*b* is controlled by the ECU 34 to maintain the necessary engine speed when the engine is idling.

The FAF-behavior-detection resume determining routine in FIG. 27 will now be discussed. When this routine starts, the ECU 34 determines whether the conditions for executing the purge-valve-opening/closing-mode FAF-behavior detecting routine (step 51050 in FIG. 5 and FIG. 7) illustrated in steps S1010–S1044 have been satisfied (step S4010). When the conditions are not met (NO in step S4010), the ECU 34 stores the current load KLSM in a memory 40 as a stored value KLCHK (step S4070). The load KLSM here is expressed by an intake air flow rate GN per rotation of the engine 2.

Thereafter, the ECU 34 temporarily terminates the routine. As long as the conditions are not satisfied in step S4010, the latest load KLSM is always stored as the stored value KLCHK in step S4070.

When all the conditions in steps S1010–S1044 in FIG. 5 are met and the purge-valve-opening/closing-mode FAF-behavior detecting routine (step S1050 in FIG. 5 and FIG. 7) is initiated, the conditions in step S4010 are simultaneously met. Accordingly, first, it is determined whether the purge valve 30 has just been fully closed by the purge-valve fully closing routine (step S1140) in FIG. 7 (step S4020).

While the processes (steps S1100–S1132) prior to the purge-valve fully closing routine (step S1140) in the purge-valve-opening/closing-mode FAF-behavior detecting routine (step S1050) are being performed (NO in step S4020), the ECU 34 determines whether the absolute value of the difference between the stored value KLCHK and the load KLSM is less than a behavior-detection-stop decision value Ma according to an equation 9 (step S4040).

$$|KLCHK-KLSM|<Ma \quad (9)$$

When a variation in load KLSM since the initiation of the purge-valve-opening/closing-mode FAF-behavior detecting routine (FIG. 7) lies within the behavior-detection-stop decision value Ma (YES in step S4040), the ECU 34 permits the purge-valve-opening/closing-mode FAF-behavior detection (step S4050). This permission is signalled by, for example, setting a permission flag. This permission flag is always checked in the purge-valve-opening/closing-mode FAF-behavior detecting routine (FIG. 7). When the permission flag is reset, the interruption routine (FIG. 28) is executed immediately.

As long as a variation in load KLSM lies within the behavior-detection-stop decision value Ma (YES in step S4040), the permission flag is set (step S4050) and the purge-valve-opening/closing-mode FAF-behavior detecting routine (FIG. 7) is resumed.

When the purge valve 30 is fully closed (step S1140 in FIG. 7), the ECU 34 adds a compensation value KLPRG to the stored value KLCHK (step S4030) according to an equation 10 immediately after the purge valve 30 is fully closed (YES in step S4020).

$$KLCHK-KLCHK+KLPRG \quad (10)$$

The correction of he stored value KLCHK is carried out because the purge-valve-opening/closing-mode FAF-behavior detecting routine (FIG. 7) is performed in an idling mode while ISC is conducted. That is, when the purge valve 30 is fully closed, the ISC adds to the amount of intake air supplied from the purge valve 30 by increasing the angle of the ISCV 50*b* in order to maintain the engine speed of the engine 2. Around the point at which the purge valve 30 is fully closed, the amount of air supplied via the air flow meter 16 is increased, although there is actually no change in the amount of intake air supplied to the engine 2. In the decision in step S4040, therefore, it is determined that the load has increased. To prevent this, the compensation value KLPRG is added to the stored value KLCHK, only once, immediately after the purge valve 30 is fully closed.

After the correction of the stored value KLCHK, the decision in step S4020 is NO so that the corrected stored value KLCHK is properly determined in step S4040.

If a variation in load KLSM lies within the behavior-detection-stop decision value Ma (YES in step S4040) even with the purge valve 30 fully closed, the purge-valve-opening/closing-mode FAF-behavior detection continues to be permitted (step S4050).

When such a permitted state continues and the purge-valve-opening/closing-mode FAF-behavior detecting routine (FIG. 7) ends, it is determined based on the result of the FAF-behavior detection whether the permission flag XPGR for learning the base air-fuel ratio feedback coefficient is set or reset (steps S1060–S1094). This way, the learning permission determining routine (FIGS. 5 and 6) is carried out to the end.

A description follows of a case where the decision in step S4040 in the FAF-behavior-detection resume determining routine in FIG. 27 is NO due to a variation in load KLSM. Such a situation occurs when the angle of the ISCV 50*b* changes under ISC because, for example, an unillustrated air-conditioning system is activated or the transmission gear is shifted.

When a variation equal to or greater than the behavior-detection-stop decision value Ma occurs in the load KLSM (NO in step S4040), the purge-valve-opening/closing-mode FAF-behavior detection is inhibited (step S4060) by resetting the permission flag, and the latest load KLSM is set to the stored value KLCHK in step S4070, after which the routine is temporarily terminated.

When the permission flag is reset, the learning permission determining routine (FIGS. 5 and 6) is interrupted spontaneously and the interruption routine shown in FIG. 28 is executed.

In this interruption routine, first, it is determined whether the value of the current purge rate PGR is less than the angle PGRO of the purge valve 30 immediate before the initiation of the purge-valve fully closing routine (step S5010). When PGR<PGRO (YES in step S5010), the ECU 34 then adds the purge rate increment ΔPGRU, which is set for gradual increase, to the current purge rate PGR and then determines whether the resultant value is equal to or greater than the angle PGRO of the purge valve 30 stored in step S1100 (step S5020). When PGR+ΔPGRU<PGRO (NO in step S5020), the ECU 34 sets this value (PGR+ΔPGRU) as the purge rate PGR (step S5030). Next, the ECU 34 determines whether the time Δtu has elapsed since the execution of step S5030 (step S5040). When the time Δtu has not elapsed (NO in step S5040), the ECU 34 repeats the decision process of step S5040 until the time Δtu elapses.

When the time Δtu elapses (YES in step S5040), ECU determines again if PGR+ΔPGRU>PGRO (step S5020). As long as PGR+ΔPGRU<PGRO (NO in step S5020), steps S5030 and S5040 are repeated so that the purge rate PGR gradually increases at the rate of ΔPGRU/Δtu. The purge rate PGR, which increases in this manner, is then subjected to duty control in the purge-valve driving routine (FIG. 18), which determines on the angle of the purge valve 30.

When PGR+ΔPGRU≧PGRO (YES in step S5020), the angle PGRO is set to the purge rate PGR (step S5050). In this manner, the purge valve 30 returns to the angle it had immediately before the purge-valve-opening/closing-mode FAF-behavior detecting routine (FIG. 7) was initiated. Then, the ECU 34 terminates the learning permission determining routine (FIGS. 5 and 6). In other words, neither the processes in steps S1060–S1094 (FIG. 6) nor the process of setting the permission flag XPGR for learning the base air-fuel ratio feedback coefficient based on the result of the purge-valve-opening/closing-mode FAF-behavior detecting routine (FIG. 7) is executed.

When PGR≧PGRO (NO in step S5010), it is determined whether a value obtained by subtracting a purge rate decrement ΔPGRD, which is set for gradual reduction, from the current purge rate PGR is equal to or smaller than the angle PGRO (step S5060). When PGR−ΔPGRD>PGRO (NO in step S5060), this value (PGR−ΔPGRD) is set to the purge rate PGR (step S5070). Next it is determined whether a time Δtd has elapsed since the execution of step S5070 (step S5080). When the time Δtd has not elapsed (NO in step S5080), the decision process of step S5080 is repeated until the time Δtd elapses.

When the time Δtd elapses (YES in step S5080), it is determined again whether PGR−ΔΔPGRD≦PGRO (step S5060). As long as PGR−ΔPGRD>PGRO (NO in step S5060), steps S5070 and S5080 are repeated so that the purge rate PGR gradually decreases at the rate of ΔPGRD/Δtd. The purge rate PGR, which decreases in this manner, is then subjected to duty control in the purge-valve driving routine (FIG. 18), which determines the angle of the purge valve 30.

When PGR−ΔPGRD≦PGRO (YES in step S5060), the angle PGRO is set to the purge rate PGR (step S5050). Accordingly, the angle of the purge valve 30 returns to the angle it had immediately before the initiation of the purge-valve-opening/closing-mode FAF-behavior detecting routine (FIG. 7), Then, the learning permission determining routine (FIGS. 5 and 6) is temporarily terminated. In other words, as mentioned above, neither the processes in steps S1060–S1094 (FIG. 6) nor the process of setting the permission flag XPGR for learning the base air-fuel ratio feedback coefficient based on the result of the purge-valve-opening/closing-mode FAF-behavior detecting routine (FIG. 7) is executed.

Figure 30:
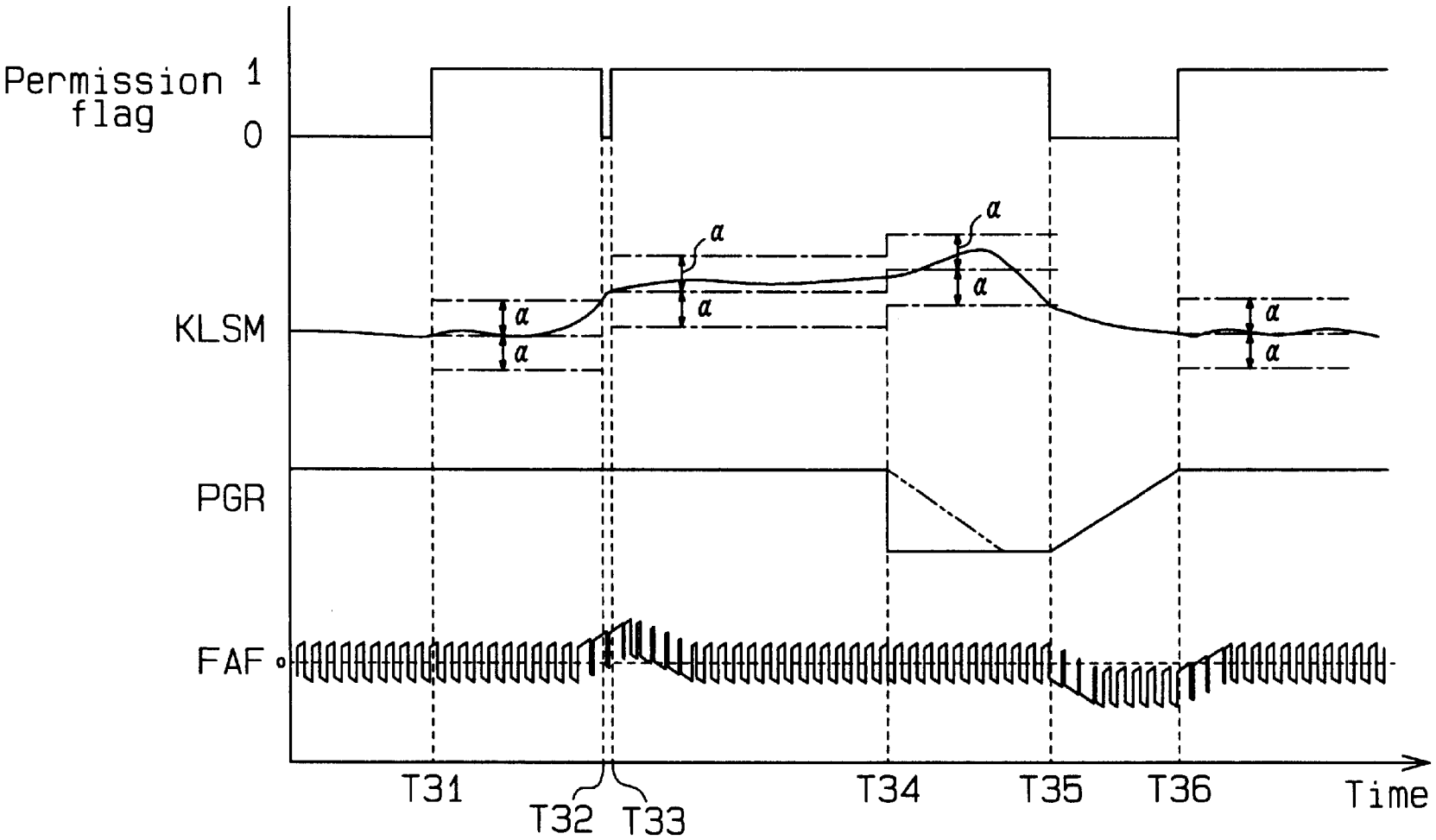
FIG. 30 is a timing chart showing the behaviors of a permission flag, a load KLSM, the purge rate PER and the air-fuel ratio feedback coefficient FAF according to the control of the fourth embodiment.

One example of the behaviors of the load KLSM, the purge rate PGR and the air-fuel ratio feedback coefficient FAF during that period is illustrated in the timing chart of FIG. 30.

At time T31, the conditions in steps S1010–S1044 are satisfied and the purge-valve-opening/closing-mode FAF-behavior detecting routine (FIG. 7) is initiated. When the load KLSM increases due to the activation of the air-conditioning system at time T32 while computation of the behavior detection value in purge mode KGO with the purge valve 30 open is under way, however, |KLCHK−KLSM|≧Ma (NO in step S4040) and the permission flag is reset (step S4060). As a result, the learning permission determining routine (FIGS. 5 and 6) is interrupted and temporarily terminated. Then, the ECU 34 waits again for the conditions in steps S1010–S1044 to be met.

When the conditions in steps S1010–S1044 are met again at time T33, the purge-valve-opening/closing-mode FAF-behavior detecting routine (FIG. 7) is initiated again. Then, since there is no significant change in load KLSM, and |KLCHK−KLSM|<Ma is satisfied during the execution of steps S1100–S1132, the behavior detection value in purge mode KGO can be acquired (steps S1120–S1132) in the purge-valve-opening/closing-mode FAF-behavior detecting routine (FIG. 7).

While the purge valve 30 is fully closed (step S1140) at time T34, the process of step S4030 in the FAF-behavior-detection resume determining routine (FIG. 27) causes the stored value KLCHK to be incremented by the compensation value KLPRG. If there is substantially no change in load KLSM (YES in step S4040), the purge-valve-opening/closing-mode FAF-behavior detecting routine (FIG. 7) continues and so does the process of acquiring the behavior detection value KGC in non-purge mode (steps S1150 and S1160).

When, for example, the air-conditioning system is deactivated during the process of acquiring the behavior detection value KGC in non-purge mode (steps S1150 and S1160), the angle of the ISCV **50*b* is reduced under ISC in order to reduce the engine speed. This makes the inequality |KLCHK−KLSM|≧Ma true (NO in step S4040) at time T35, and the permission flag is reset (step S4060). Then, the learning permission determining routine (FIGS. 5 and 6) is interrupted, and the interruption routine (FIG. 28) is executed. After the angle of the purge valve 30 is gradually set back in this interruption routine, the learning permission determining routine (FIGS. 5 and 6**) is temporarily terminated.

Then, the ECU 34 waits for the conditions in steps S1010–S1044 to be met again. When the conditions are met at time T36, the above-described processes are repeated. When the purge-valve-opening/closing-mode FAF-behavior detecting routine (FIG. 7) is completed before the permission flag is reset, the learning permission determining routine (FIGS. 5 and 6) has been implemented completely.

According to the above-described fourth embodiment, the purge-valve-opening/closing-mode FAF-behavior detecting routine in FIG. 7, the FAF-behavior-detection resume determining routine in FIG. 27 and the interruption routine in FIG. 28 correspond to the operation of the air-fuel-ratio-feedback-coefficient behavior detection means.

The fourth embodiment has the following effects in addition to the effects (1) to (9) of the first embodiments.

(13) There may be a case where the feedback of the air-fuel ratio significantly deviates depending on the load state of the engine 2 such as the ON/OFF state of the air-conditioning system or the gear-shift range due to device-by-device variations in the characteristics of the fuel injection valve 14 and the air flow meter 16. When a certain degree of or variation or more occurs in the load, therefore, the detection precision of the purge-valve-opening/closing-mode FAF-behavior detecting routine (FIG. 7) falls. When a change in the load KLSM of the engine 2 (|KLCHK−KLSM|) becomes greater than the behavior-detection-stop decision value Ma, therefore, the learning permission determining routine (FIGS. 5 and 6) is interrupted.

This can ensure higher detection precision in the purge-valve-opening/closing-mode FAF-behavior detecting routine (FIG. 7). It is thus possible to prevent inaccurate decisions in the learning permission determining routine (FIGS. 5 and 6) and to set the learned value with high precision.

(14) When the state of the purge valve 30 is shifted from the open state to the fully-closed state (step S1140) in the purge-valve-opening/closing-mode FAF-behavior detecting routine (FIG. 7), the ISC system 50 increases the angle of the ISCV 50*b* to compensate for the drop in the amount of intake air caused by closing the purge valve 30. This increases the amount of intake air detected by the air flow meter 16, though the amount of intake air has not substantially changed, so that the load of the engine 2 may appear to increase.

According to the fourth embodiment, therefore, at the time of comparing a change in load KLSM (|KLCHK−KLSM|) with the behavior-detection-stop decision value Ma immediately after the full closing of the purge valve 30, the stored value KLCHK for decision is increased by the compensation value KLPRG (step S4030). This cancels a variation in load of the gas led into the air-intake passage 8 via the purge valve 30. As a result, it is possible to more reliably determine the situation where accurate detection is possible in the purge-valve-opening/closing-mode FAF-behavior detecting routine (FIG. 7), thus increasing the chances of detecting the FAF behavior.

Fifth Embodiment

Figure 31:
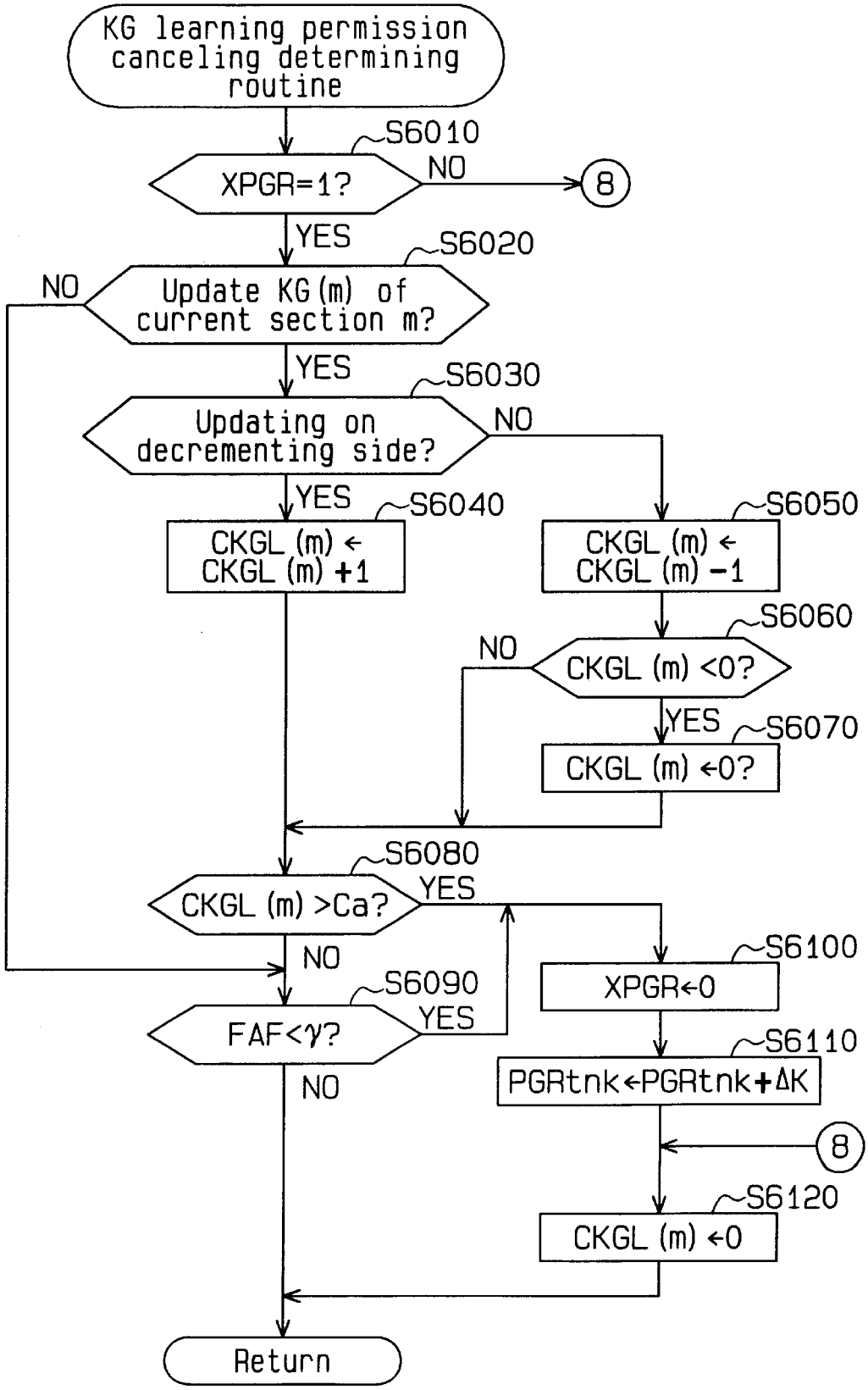
FIG. 31 is a flowchart illustrating a KG-learning-permission-canceling determining routine according to a fifth embodiment.

A description of the fifth embodiment follows, focusing on the differences from the first embodiment. In the fifth embodiment, a KG learning permission canceling determining routine illustrated in FIG. 31 is executed. This routine is repeatedly carried out in the same period as the air-fuel-ratio control routine illustrated in FIG. 2 or the base air fuel ratio feedback coefficient learning routine illustrated in FIG. 13 is performed. Otherwise, the fifth embodiment is substantially the same as the first embodiment.

When the KG learning permission canceling determining routine is initiated, first, the ECU 34 determines whether the permission flag XPGR for learning the base air-fuel ratio feedback coefficient is set (step S6010). When XPGR=0 (reset) (NO in step S6010), the ECU 34 clears a learned-value subtraction counter CKGL(m) set in the current drive section m (step S6120) and temporarily terminates the routine. The drive section m is the same as the drive section m in the base air fuel ratio feedback coefficient learning routine in FIG. 13. Therefore, the learned-value subtraction counter CKGL(m) is set in association with the base air-fuel ratio feedback coefficient KG(m).

When XPGR=1 (set) (YES in step S6010), the ECU 34 determines whether the base air-fuel ratio feedback coefficient KG(m) of the current section m has been updated in the base air fuel ratio feedback coefficient learning routine (step S6020). When XPGR=1, which indicates allowance of the execution of the base air fuel ratio feedback coefficient learning routine (FIG. 13), it is determined whether step S420 or step S440 of this base air fuel ratio feedback coefficient learning routine has been performed.

When KG(m) is not renewed (NO in step S6020), the ECU 34 then determines whether the air-fuel ratio feedback coefficient FAF computed in the air-fuel-ratio control routine (FIG. 2) is less than the purge-increase decision value γ (step S6090). The purge-increase decision value γ has previously been set to a negative value.

When the air-fuel ratio feedback coefficient FAF is smaller than the purge-increase decision value γ, the fuel concentration in the intake air has rapidly become too large. When learning by the base air fuel ratio feedback coefficient learning routine (FIG. 13) is carried out, therefore, the concentration of purged fuel erroneously affects the learning of the base air-fuel ratio feedback coefficient KG(m).

When FA <γ (YES in step S6090), therefore, the ECU 34 resets XPGR (step S6100). This inhibits the base air fuel ratio feedback coefficient learning routine (step S340) from being executed in the learning control routine (FIG. 4).

Then, the process of adding a specified increment ΔK to the estimated amount of fuel vapor present $PGR_{tnk}$ is performed (step S6110) as discussed in the section of the first embodiment. This allows the concentration of the purged fuel to be reflected in the estimated amount of fuel vapor present $PGR_{tnk}$, which has been calculated in the vapor amount estimating routine (FIG. 8) so that the estimated value $PGR_{tnk}$ will be close to the actual concentration of fuel vapor in the gas to be purged. Then, the ECU 34 clears the learned-value subtraction counter CKGL(m) (step S6120) and temporarily terminates the routine.

When FA≧γ in step S6090 (NO in step S6090), the ECU 34 temporarily terminates the KG learning permission canceling determining routine.

When it is determined in step S6020 that KG(m) has been renewed (YES in step S6020), the ECU 34 determines whether or not KG(m) has been updated in the decrementing direction, i.e., in a direction to decrease KG(m) (step S6030). When the updating of KG(m) is reducing KG(m) (YES in step S6030), the ECU 34 increments the learned-value subtraction counter CKGL(m) (step S6040).

When the updating of KG(m) increases KG(m) (NO in step S6030), the ECU 34 decrements the learned-value subtraction counter CKGL(m) (step S6050). Then, the ECU 34 determines whether the learned-value subtraction counter CKGL(m) is smaller than 0 (step S6060). When CKGL(m) <0 (YES in step S6060), the ECU 34 clears the learned-value subtraction counter CKGL(m) to zero (step S6070). This guards the learned-value subtraction counter CKGL(m) from becoming a negative value.

After step S6040 or step S6070, or when the decision in step S6060 is NO, the ECU 34 determines whether the learned-value subtraction counter CKGL(m) is greater than a decrement number decision value Ca (step S6080).

This decrement number decision value Ca is for checking the influence of the concentration of fuel to be purged on updating of KG(m). When the learned-value subtraction counter CKGL(m) becomes larger than the decrement number decision value Ca, therefore, it is understood that the influence of the concentration of purged fuel on the base air-fuel ratio feedback coefficient KG(m) has started.

When CKGL(m)>Ca (YES in step S6080), the ECU 34 resets XPGR (step S6100) to inhibit execution of the base air fuel ratio feedback coefficient learning routine (step S340 in FIG. 4 and FIG. 13) in the learning control routine (FIG. 4). Then, the ECU 34 increments the estimated amount of fuel vapor present $PGR_{tnk}$ by the specified increment ΔK (step S6110), clears the learned-value subtraction counter CKGL (m) (step S6120), and temporarily terminates the routine.

When CKGL(m)≦Ca (NO in step S6080), the ECU 34 executes the aforementioned step S6090. The process according to the result of the decision in step S6090 has been discussed earlier.

Figure 32:
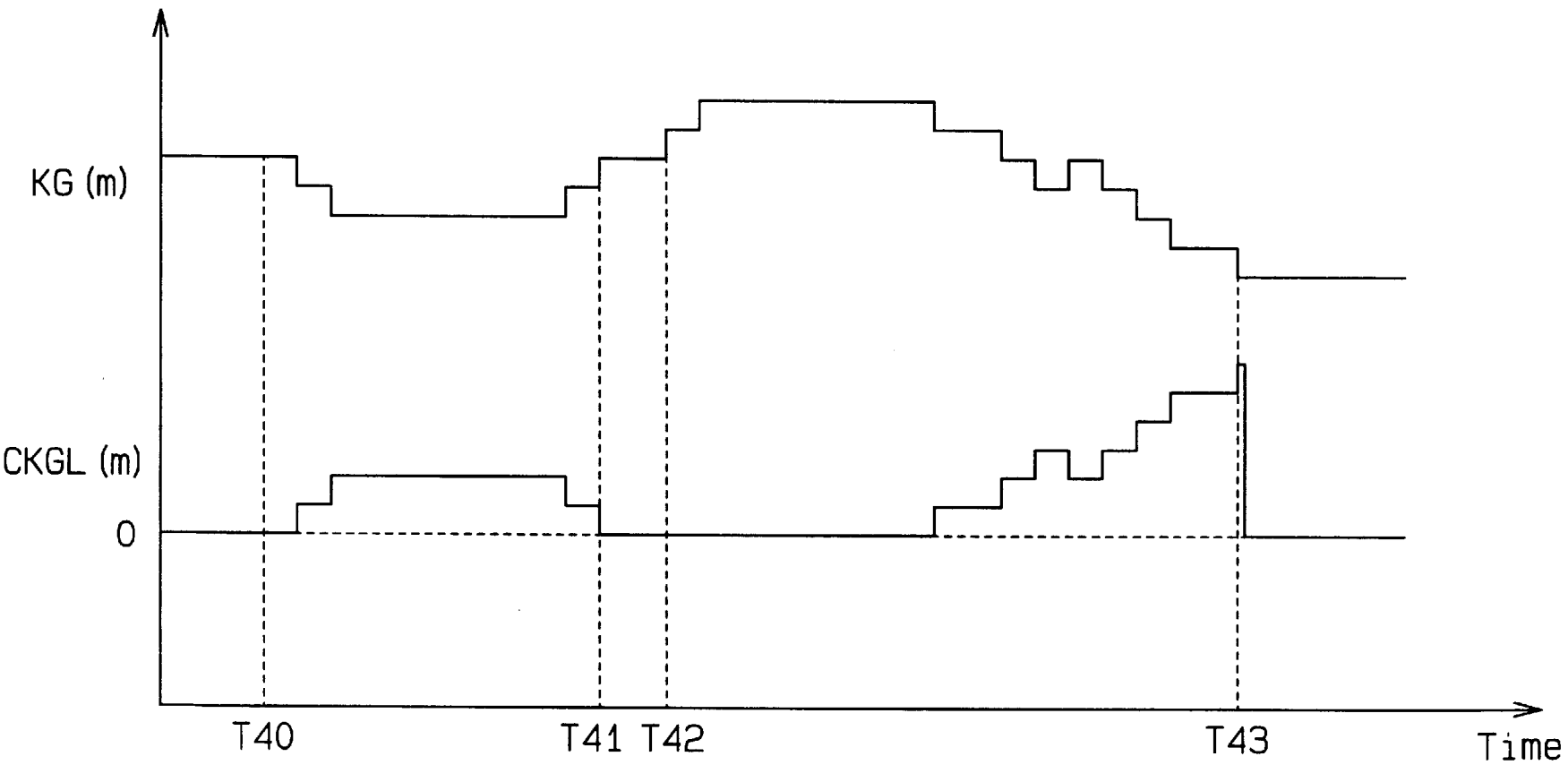
FIG. 32 is a timing chart showing the behaviors of a base air-fuel ratio feedback coefficient KG(m) and a learned-value subtraction counter CKGL(m) according to the control of the fifth embodiment.

One example of a specific process will be discussed according to the timing chart of FIG. 32.

Assume that, at time T40, the permission flag XPGR for learning the base air-fuel ratio feedback coefficient is set (step S1070) in the learning permission determining routine (FIG. 6) and the learning conditions have been satisfied. In this case, the decisions in steps S320 and S330 in the learning control routine (FIG. 4) are both YES and the base air fuel ratio feedback coefficient learning routine (FIG. 13) is executed.

Then, learning of the base air-fuel ratio feedback coefficient KG(m) in the drive section m at that point in time is started. Thus, the coefficient KG(m) changes in accordance with a change in the air-fuel ratio feedback coefficient FAF. In step S6040 or S6050, the coefficient CKGL(m) is also incremented or decremented (T40–T41) in a direction opposite to the change in the coefficient KG(m).

Because the coefficient CKGL(m) does not become negative, unlike in the processes of steps S6060 and S6070, CKGL(m) is kept at zero after CKGL(m) becomes zero at T41, even if the coefficient KG(m) is further incremented (T42).

When the frequency of decrements of KG(m) becomes higher and KG(m) exceeds the decrement number decision value Ca (T43), the permission flag XPGR is reset (step S6100).

This stops the base air fuel ratio feedback coefficient learning routine (step S340) in the learning control routine (FIG. 4), so that updating the coefficient KG(m) is stopped.

After execution of step S6110, step S6120 is executed, causing CKGL(m) to return to zero.

Thereafter, the purge-concentration learning routine (FIG. 14) is activated to learn the purge-concentration learned value FGPG. The coefficient KG(m) will not be renewed until the purge-valve-opening/closing-mode FAF-behavior detecting routine (FIG. 7) is initiated and the permission flag XPGR is set in step S1070 (FIG. 6), and the value of CKGL(m) is kept at zero.

Figure 33:
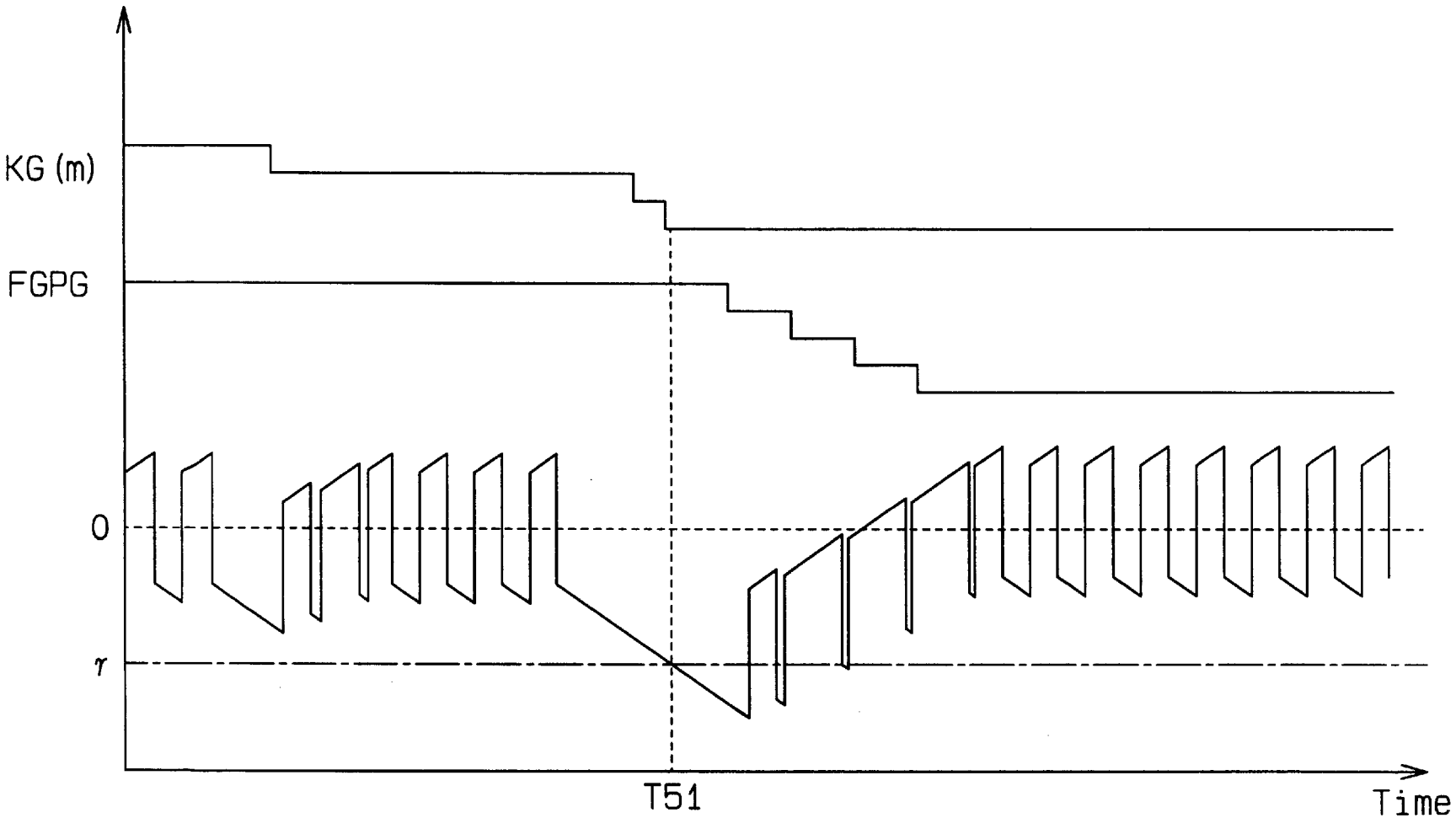
FIG. 33 is a timing chart showing the behaviors of the base air-fuel ratio feedback coefficient Kg(m), a purge-concentration learned value FGPG and a purge-increase decision value γ according to the control of the fifth embodiment.

One example where the amount of fuel vapor to be purged is increased suddenly is illustrated in a timing chart in FIG. 33.

When the permission flag XPGR for learning the base air-fuel ratio feedback coefficient is set, when there has been an abrupt increase in the amount of fuel vapor to be purged at time T51, and when the air-fuel ratio feedback coefficient FAF has decreased rapidly, it is determined in step S6090 that FAF<γ. Consequently, the permission flag XPGR is reset (step S6100). This stops the base air fuel ratio feedback coefficient learning routine (step S340) in the learning control routine (FIG. 4), so that updating of KG(m) is stopped.

Since the permission flag XPGR has been reset, the decision in step S320 in the learning control routine (FIG. 4) is NO and the purge-concentration learning routine (FIG. 14) is activated. After time T51, therefore, the amount of decrementation of FAF will be learned from the purge-concentration learned value FGPG, which is updated by decrementation and FAF returns to zero.

With the above-described structure, the processes in steps S6010–S6090 correspond to the operation of the purge increase detection means, and the process of step S6100 corresponds to the operation of the learning permission canceling means.

The fifth embodiment has the following effects in addition to the effects (1) to (9) of the first embodiment.

(15) In the learning permission determining routine (FIGS. 5 and 6), when the amount of fuel vapor to be purged is lean, updating of KG(m) is permitted by learning FAF. There may however be a case where, after it is once determined that the fuel vapor to be purged is lean, the amount of fuel vapor to be purged suddenly becomes rich due to, for example, a large acceleration applied to the fuel tank 18. In such a case, it is difficult to deal with this situation by immediately resetting the permission flag XPGR in the learning permission determining routine (FIGS. 5 and 6). In the base air fuel ratio feedback coefficient learning routine (FIG. 13), therefore, erroneous learning may be due to the purged fuel vapor so that KG(m) is set to an abnormally small value.

The fifth embodiment can prevent this as follows. When the number of decremental renewals (which are canceled by incremental renewals) among the renewals of KG(m) becomes greater than the decrement number decision value Ca (YES in step S6080), updating of KG(m) is stopped, since erroneous learning of the amount of purged fuel vapor is starting.

This makes it possible to keep the correct learned value of the base air-fuel ratio feedback coefficient KG(m), so that disturbance of the air-fuel ratio can be prevented even if the angle of the purge valve 30 is changed or the drive section m is changed.

(16) When the amount of purged fuel vapor is rapidly increased before it is sufficiently reflected in the updating of KG(m), updating of KG(m) is stopped by detecting that there was an abrupt increase in the air-fuel ratio feedback coefficient FAF. Even when the amount of fuel vapor to be purged increases abruptly, therefore, the correct learned value of the base air-fuel ratio feedback coefficient KG(m) can be maintained. Even if the angle of the purge valve 30 is changed or the drive section m is changed, disturbance of the air-fuel ratio can be prevented.

The above-described embodiments may be modified as follows.

Sixth Embodiment

In the first embodiment, the initial value $t_PGR_{st}$ is acquired according to the coolant temperature THW in step S1210. Alternatively, in a sixth embodiment, the initial value $t_PGR_{st}$ may be acquired based on a factor (such as temperature or atmospheric pressure) on which a prediction of the maximum fuel vapor stored in the fuel tank 18 can be based.

Seventh Embodiment

Although the first produced amount $t_PGR_a$ is set according to the intake air temperature THA in step S1220 in the first embodiment, in a seventh embodiment, the first produced amount $t_PGR_a$ may be obtained directly according to the fuel temperature in a case where a sensor for detecting the fuel temperature is provided in the fuel tank 18. This can provide a more accurate first produced amount $t_PGR_a$.

Eighth Embodiment

In the first embodiment, the condition for setting the permission flag XPGR for learning the base air-fuel ratio feedback coefficient in step S1070 is that the conditions in steps S1010–S1044 should all be met. However, in an eighth embodiment, condition for setting the permission flag XPGR may be just the condition in step S1010, just the conditions in steps S1030–S1044, or just the condition in step S1060, or that the following equation 11 should be satisfied.

$$KGO+FPG-KGC \geqq PGR+H_o \quad (11)$$

Ninth Embodiment

In the first embodiment, the behavior of the air-fuel ratio feedback coefficient FAF is checked using the base air fuel ratio feedback coefficient learning routine in FIG. 13 in the purge-valve-opening/closing-mode FAF-behavior detecting routine in FIG. 7. The behavior of the air-fuel ratio feedback coefficient FAF may be checked by comparing the grading value FAFSM of the air-fuel ratio feedback coefficient FAF in the open state of the purge valve 30 with the grading value FAFSM of the air-fuel ratio feedback coefficient FAF in the closed state of the purge valve 30. Alternatively, in a ninth embodiment, the behavior of the air-fuel ratio feedback coefficient FAF may be checked by a process that is specially provided to detect the behavior of the air-fuel ratio feedback coefficient when the purge valve is opened or closed, instead of using the existing process like the base air fuel ratio feedback coefficient learning routine in FIG. 13.

Tenth Embodiment

Although the second produced amount $t_PGR_s$ is obtained from the graph (FIG. 11) based on the absolute value of a change in vehicle speed, $|\Delta SPD|$, obtained from the vehicle speed, in a tenth embodiment, a vibration sensor may be provided in the fuel tank 18 or elsewhere so that the second produced amount $t_PGR_s$ is obtained according to the degree of vibration.

Eleventh Embodiment

Although it is determined in step S1090 whether the estimated amount of fuel vapor present $PGR_{tnk} \geqq$ the reference value $Q_o$ for determining whether the concentration is rich as the condition for resetting the permission flag XPGR in step S1094, in an eleventh embodiment, whether or not $PGR_{tnk} > M_o$ may be determined using the reference value $M_o$ used in step S1010 instead.

Twelfth Embodiment

Although the purge valve 30 is immediately fully closed in the purge-valve fully closing process (step S1140) in the fourth and fifth embodiments, the purge valve 30 may be closed gradually as indicated by the broken line having two short dashes and one long dash in FIG. 30, as in the second and third embodiments.

Thirteenth Embodiment

Although the limit of decrementally updating of KG(m) is determined by the number of renewals (step S6080), it may be determined directly from the accumulated amount of decremental updating when the amounts of updating in the two updating processes (steps S420 and S440) in the base air fuel ratio feedback coefficient learning routine (FIG. 13) differ from each other.

To achieve the above-described routines by a computer system like the ECU 34, the individual routines should be recorded on a recording medium as computer-readable program codes, for example. Such recording media may include a ROM or back-up RAM, which is installed in the computer system. Other recording media include, for example, a floppy disk, magneto-optical disk, CD-ROM and hard disk on which the individual routines are recorded as computer-readable program codes. In this case, each routine is invoked by loading the associated program codes into the computer system as needed.

It should be apparent to those skilled in the art that the present invention may be embodied in many other specific forms without departing from the spirit or scope of the invention. Therefore, the present examples and embodiments are to be considered as illustrative and not restrictive and the invention is not to be limited to the details given herein, but may be modified within the scope and equivalence of the appended claims.

What is claimed is:

1. An air-fuel ratio control apparatus, adapted for an internal combustion engine equipped with a fuel tank, for controlling the air-fuel ratio of an air-fuel mixture to be supplied to the internal combustion engine, the air-fuel ratio control apparatus comprising:

a purge means for purging fuel vapor from the fuel tank into an air-intake passage of the internal combustion engine;

an air-fuel ratio sensor for detecting the air-fuel ratio;

an air-fuel-ratio feedback control means for computing an air-fuel ratio feedback coefficient for controlling the air-fuel ratio to approach a predetermined target air-fuel ratio;

a concentration learning means for learning the concentration of the fuel vapor purged in the air-intake passage based on the air-fuel ratio feedback coefficient;

a base air fuel ratio feedback coefficient learning means for learning a base air-fuel ratio feedback coefficient based on the air-fuel ratio feedback coefficient;

a fuel-injection-amount control means for controlling an injection amount of fuel based on the air-fuel ratio feedback coefficient, the concentration of the fuel vapor and the base air-fuel ratio feedback coefficient;

a fuel-vapor-amount estimating means for estimating an amount of fuel vapor present in the fuel tank from a balance between an amount of fuel vapor generated in the fuel tank and a purged amount of the fuel vapor; and a learning control means for permitting learning of the base air-fuel ratio feedback coefficient and inhibiting learning of the concentration of the fuel vapor when the estimated amount of fuel vapor is less than a predetermined reference value, and inhibiting learning of the base air-fuel ratio feedback coefficient and permitting learning of the concentration of the fuel vapor when the estimated amount of fuel vapor is greater than the reference value.

2. The air-fuel ratio control apparatus according to claim 1, wherein the fuel-vapor-amount estimating means acquires the amount of fuel vapor generated in the fuel tank in accordance with the temperature in the fuel tank.

3. The air-fuel ratio control apparatus according to claim 1, wherein the fuel-vapor-amount estimating means acquires the amount of fuel vapor generated in the fuel tank in accordance with the temperature in the fuel tank and the amount of waves in the fuel tank.

4. The air-fuel ratio control apparatus according to claim 2, wherein the fuel-vapor-amount estimating means corrects the amount of fuel vapor generated in the fuel tank in accordance with the atmospheric pressure.

5. The air-fuel ratio control apparatus according to claim 1, further comprising:

a purge increase detection means for detecting an increase in the fuel vapor to be purged into the air-intake passage while the learning control means is permitting the base air fuel ratio feedback coefficient learning means to learn the base air-fuel ratio feedback coefficient; and learning permission canceling means for canceling permission to learn the base air-fuel ratio feedback coefficient by the base air fuel ratio feedback coefficient learning means, which has been granted by the learning control means, when the increase in the purged fuel vapor detected by the purge increase detection means is greater than a predetermined decision value.

6. The air-fuel ratio control apparatus according to claim 5, wherein the purge increase detection means detects a change in the fuel vapor to be purged into the air-intake passage based on a change in the base air-fuel ratio feedback coefficient learned by the base air fuel ratio feedback coefficient learning means.

7. The air-fuel ratio control apparatus according to claim 5, wherein the purge increase detection means detects a change in the fuel vapor to be purged into the air-intake passage based on a change in the air-fuel ratio feedback coefficient computed by the air-fuel-ratio feedback control means.

8. The air-fuel ratio control apparatus according to claim 1, wherein the fuel-vapor-amount estimating means estimates the amount of fuel vapor generated in the fuel tank based on the intake air temperature of the internal combustion engine.

9. The air-fuel ratio control apparatus according to claim 1, wherein the fuel-vapor-amount estimating means acquires the purged amount of the fuel vapor based on a purge flow rate which is based on a purge rate and the amount of intake air.

10. The air-fuel ratio control apparatus according to claim 1, further comprising:

a purge valve, provided in the purge means, for regulating the purged amount of the fuel vapor; and an air-fuel-ratio-feedback-coefficient behavior detection means for detecting a first behavior of the air-fuel ratio feedback coefficient computed by the air-fuel-ratio feedback control means with the purge valve open and a second behavior of the air-fuel ratio feedback coefficient computed by the air-fuel-ratio feedback control means with the purge valve closed, and wherein the learning control means permits learning of the base air-fuel ratio feedback coefficient by the base air fuel ratio feedback coefficient learning means and inhibits learning of the concentration of the fuel vapor by the concentration learning means when the amount of fuel vapor present estimated by the fuel-vapor-amount estimating means is smaller than the reference value and when it is determined based on the detected first and second behaviors that the fuel vapor to be purged is lean, and the learning control means inhibits learning of the base air-fuel ratio feedback coefficient by the base air fuel ratio feedback coefficient learning means and permits learning of the concentration of the fuel vapor by the concentration learning means when the estimated amount of fuel vapor present is greater than the reference value or when it is determined based on the detected first and second behaviors that the amount of fuel vapor to be purged is not lean.

11. The air-fuel ratio control apparatus according to claim 10, wherein when the air-fuel-ratio-feedback-coefficient behavior detection means detects the behavior of the air-fuel ratio feedback coefficient by closing the purge valve, the air-fuel-ratio-feedback-coefficient behavior detection means gradually closes the purge valve.

12. The air-fuel ratio control apparatus according to claim 10, wherein when the air-fuel ratio feedback coefficient is changed in a direction to make the fuel concentration higher based on a decision value when the purge valve is closed, the air-fuel-ratio-feedback-coefficient behavior detection means stops closing the purge valve or opens the purge valve from a closed position and stops detecting the behavior of the air-fuel ratio feedback coefficient.

13. The air-fuel ratio control apparatus according to claim 12, wherein the air-fuel-ratio-feedback-coefficient behavior detection means further corrects the amount of fuel vapor to be estimated by the fuel-vapor-amount estimating means.

14. The air-fuel ratio control apparatus according to claim 10, wherein the air-fuel-ratio-feedback-coefficient behavior detection means stops detecting the behavior of the air-fuel ratio feedback coefficient when a change in the load on the internal combustion engine becomes greater than a predetermined decision value during detection of the behavior of the air-fuel ratio feedback coefficient.

15. The air-fuel ratio control apparatus according to claim 14, wherein when the purge valve is shifted from an open state to a closed state, the air-fuel-ratio-feedback-coefficient behavior detection means cancels a variation in the load on the internal combustion engine corresponding to gas having been supplied into the air-intake passage via the purge valve and compares the change in the load of the internal combustion engine with the predetermined decision value.

16. The air-fuel ratio control apparatus according to claim 10, further comprising:

a purge increase detection means for detecting an increase in the fuel vapor to be purged into the air-intake passage while the learning control means is permitting the base air fuel ratio feedback coefficient learning means to learn the base air-fuel ratio feedback coefficient; and learning permission canceling means for canceling permission to learn the base air-fuel ratio feedback coefficient by the base air fuel ratio feedback coefficient learning means, which has been granted by the learning control means, when the increase in the purged fuel vapor detected by the purge increase detection means is greater than a predetermined decision value.

17. The air-fuel ratio control apparatus according to claim 16, wherein the purge increase detection means detects a change in the fuel vapor to be purged into the air-intake passage based on a change in the base air-fuel ratio feedback coefficient learned by the base air fuel ratio feedback coefficient learning means.

18. The air-fuel ratio control apparatus according to claim 16, wherein the purge increase detection means detects a change in the fuel vapor to be purged into the air-intake passage based on a change in the air-fuel ratio feedback coefficient computed by the air-fuel-ratio feedback control means.

19. The air-fuel ratio control apparatus according to claim 10, wherein the fuel-vapor-amount estimating means estimates the amount of fuel vapor generated in the fuel tank based on the intake air temperature of the internal combustion engine.

20. The air-fuel ratio control apparatus according to claim 10, wherein the fuel-vapor-amount estimating means estimates the purged amount of the fuel vapor based on a purge flow rate which is based on a purge rate and the amount of the intake air.

21. An air-fuel ratio control apparatus, adapted for an internal combustion engine equipped with a fuel tank, for controlling the air-fuel ratio of an air-fuel mixture to be supplied to the internal combustion engine, the air-fuel ratio control apparatus comprising:

a purge means for purging fuel vapor from the fuel tank into an air-intake passage of the internal combustion engine;

an air-fuel ratio sensor for detecting the air-fuel ratio;

an air-fuel-ratio feedback control means for computing an air-fuel ratio feedback coefficient for controlling the air-fuel ratio to approach a predetermined target air-fuel ratio;

a concentration learning means for learning the concentration of the fuel vapor purged in the air-intake passage based on the air-fuel ratio feedback coefficient;

a base air fuel ratio feedback coefficient learning means for learning a base air-fuel ratio feedback coefficient based on the air-fuel ratio feedback coefficient;

a fuel-injection-amount control means for controlling a fuel injection amount based on the air-fuel ratio feedback coefficient, the concentration of the fuel vapor and the base air-fuel ratio feedback coefficient;

a purge valve, provided in the purge means, for regulating the purged amount of the fuel vapor;

air-fuel-ratio-feedback-coefficient behavior detection means for detecting a first behavior of the air-fuel ratio feedback coefficient computed by the air-fuel-ratio feedback control means with the purge valve open and a second behavior of the air-fuel ratio feedback coefficient computed by the air-fuel-ratio feedback control means with the purge valve closed; and learning control means for permitting learning of the base air-fuel ratio feedback coefficient by the base air fuel ratio feedback coefficient learning means and inhibiting learning of the concentration of the fuel vapor by the concentration learning means when it is determined based on the first and second behaviors that the fuel vapor to be purged is lean and inhibiting learning of the base air-fuel ratio feedback coefficient by the base air fuel ratio feedback coefficient learning means and permitting learning of the concentration of the fuel vapor by the concentration learning means when it is determined that the fuel vapor to be purged is not lean.

22. The air-fuel ratio control apparatus according to claim 21, wherein the air-fuel-ratio-feedback-coefficient behavior detection means gradually closes the purge valve when detecting the second behavior.

23. The air-fuel ratio control apparatus according to claim 21, wherein the air-fuel-ratio-feedback-coefficient behavior detection means stops detecting the behavior of the air-fuel ratio feedback coefficient when a change in the load on the internal combustion engine becomes greater than a predetermined decision value during detection of the first and second behaviors of the air-fuel ratio feedback coefficient.

24. The air-fuel ratio control apparatus according to claim 23, wherein when the purge valve is shifted from an open state to a closed state, the air-fuel-ratio-feedback-coefficient behavior detection means cancels a variation in the load on the internal combustion engine corresponding to gas having been supplied into the air-intake passage via the purge valve and compares the change in the load on the internal combustion engine with the predetermined decision value.

25. The-air-fuel ratio control apparatus according to claim 21, further comprising:

a purge increase detection means for detecting an increase in the fuel vapor to be purged into the air-intake passage while the learning control means is permitting the base air fuel ratio feedback coefficient learning means to learn the base air-fuel ratio feedback coefficient; and learning permission canceling means for canceling permission to learn the base air-fuel ratio feedback coefficient by the base air fuel ratio feedback coefficient learning means, which has been granted by the learning control means, when the increase in the purged fuel vapor detected by the purge increase detection means is greater than a predetermined decision value.

26. The air-fuel ratio control apparatus according to claim 25, wherein the purge increase detection means detects a change in the fuel vapor to be purged into the air-intake passage based on a change in the base air-fuel ratio feedback coefficient learned by the base air fuel ratio feedback coefficient learning means.

27. The air-fuel ratio control apparatus according to claim 25, wherein the purge increase detection means detects a change in the fuel vapor to be purged into the air-intake passage based on a change in the air-fuel ratio feedback coefficient computed by the air-fuel-ratio feedback control means.

28. The air-fuel ratio control apparatus according to claim 21, wherein the fuel-vapor-amount estimating means estimates the amount of fuel vapor generated in the fuel tank based on the intake air temperature of the internal combustion engine.

29. The air-fuel ratio control apparatus according to claim 21, wherein the fuel-vapor-amount estimating means estimates the purged amount of the fuel vapor based on a purge flow rate which based on a purge rate and the amount of intake air.

30. A computer-readable recording medium on which program codes for allowing a computer to control the air-fuel ratio of an air-fuel mixture to be supplied to an internal combustion engine equipped with a fuel tank are recorded, the program codes causing the computer to function as an air-fuel ratio control apparatus comprising:

a purge means for purging fuel vapor from the fuel tank into an air-intake passage of the internal combustion engine;

an air-fuel-ratio feedback control means for computing an air-fuel ratio feedback coefficient for controlling the air-fuel ratio, which is detected by an air-fuel ratio sensor, to approach a predetermined target air-fuel ratio;

a concentration learning means for learning a concentration of the fuel vapor purged in the air-intake passage based on the air-fuel ratio feedback coefficient;

a base air fuel ratio feedback coefficient learning means for learning a base air-fuel ratio feedback coefficient based on the air-fuel ratio feedback coefficient;

a fuel-injection-amount control means for controlling an injection amount of fuel based on the air-fuel ratio feedback coefficient, the concentration of the fuel vapor and the base air-fuel ratio feedback coefficient;

a fuel-vapor-amount estimating means for estimating an amount of fuel vapor present in the fuel tank from a balance between an amount of fuel vapor generated in the fuel tank and a purged amount of the fuel vapor; and a learning control means for permitting learning of the base air-fuel ratio feedback coefficient and inhibiting learning of the concentration of the fuel vapor when the estimated amount of fuel vapor is less than a predetermined reference value, and inhibiting learning of the base air-fuel ratio feedback coefficient and permitting learning of the concentration of the fuel vapor when the estimated amount of fuel vapor is greater than the reference value.

31. The recording medium according to claim 30, wherein the program codes further cause the computer to function as an air-fuel ratio control apparatus comprising:

a purge valve, provided in the purge means, for regulating the purged amount of the fuel vapor; and an air-fuel-ratio-feedback-coefficient behavior detection means for detecting a first behavior of the air-fuel ratio feedback coefficient computed by the air-fuel-ratio feedback control means with the purge valve open and a second behavior of the air-fuel ratio feedback coefficient computed by the air-fuel-ratio feedback control means with the purge valve closed, and wherein the learning control means permits learning of the base air-fuel ratio feedback coefficient by the base air fuel ratio feedback coefficient learning means and inhibits learning of the concentration of the fuel vapor by the concentration learning means when the amount of fuel vapor present estimated by the fuel-vapor-amount estimating means is smaller than the reference value and when it is determined based on the detected first and second behaviors that the fuel vapor to be purged is lean, and the learning control means inhibits learning of the base air-fuel ratio feedback coefficient by the base air fuel ratio feedback coefficient learning means and permits learning of the concentration of the fuel vapor by the concentration learning means when the estimated amount of fuel vapor present is greater than the reference value or when it is determined based on the detected first and second behaviors that the amount of fuel vapor to be purged is not lean.

32. A computer-readable recording medium on which program codes for allowing a computer to control the air-fuel ratio of an air-fuel mixture to be supplied to an internal combustion engine equipped with a fuel tank are recorded, the program codes causing the computer to function as an air-fuel ratio control apparatus comprising:

a purge means for purging fuel vapor from the fuel tank into an air-intake passage of the internal combustion engine;

an air-fuel-ratio feedback control means for computing an air-fuel ratio feedback coefficient for controlling the air-fuel ratio, which is detected by an air-fuel ratio sensor, to approach a predetermined target air-fuel ratio;

a concentration learning means for learning a concentration of the fuel vapor purged in the air-intake passage based on the air-fuel ratio feedback coefficient;

a base air fuel ratio feedback coefficient learning means for learning a base air-fuel ratio feedback coefficient based on the air-fuel ratio feedback coefficient;

a fuel-injection-amount control means for controlling a fuel injection amount based on the air-fuel ratio feedback coefficient, the concentration of the fuel vapor and the base air-fuel ratio feedback coefficient;

a purge valve, provided in the purge means, for regulating the purged amount of the fuel vapor;

air-fuel-ratio-feedback-coefficient behavior detection means for detecting a first behavior of the air-fuel ratio feedback coefficient computed by the air-fuel-ratio feedback control means with the purge valve open and a second behavior of the air-fuel ratio feedback coefficient computed by the air-fuel-ratio feedback control means with the purge valve closed; and learning control means for permitting learning of the base air-fuel ratio feedback coefficient by the base air fuel ratio feedback coefficient learning means and inhibiting learning of the concentration of the fuel vapor by the concentration learning means when it is determined based on the first and second behaviors that the fuel vapor to be purged is lean and inhibiting learning of the base air-fuel ratio feedback coefficient by the base air fuel ratio feedback coefficient learning means and permitting learning of the concentration of the fuel vapor by the concentration learning means when it is determined that the fuel vapor to be purged is not lean.

* * * * *

UNITED STATES PATENT AND TRADEMARK OFFICE

CERTIFICATE OF CORRECTION

PATENT NO. : 6,230,699 B1
DATED : May 15, 2001
INVENTOR(S) : Noritake Mitsutani

It is certified that error appears in the above-identified patent and that said Letters Patent is hereby corrected as shown below:

Column 14,
Line 25, change "a" to -- α --.

Column 19,
Line 12, change "At" to --Δt --.

Column 20,
Line 59, change "T10 T11" to -- T10-T11 --.

Column 28,
Line 8, change "FA" to -- FAF --.

Signed and Sealed this

Twelfth Day of March, 2002

*Attest:*

*Attesting Officer*

JAMES E. ROGAN
*Director of the United States Patent and Trademark Office*